US006131898A

United States Patent [19]

Hiroi et al.

[11] Patent Number: 6,131,898

[45] **Date of Patent: *Oct. 17, 2000**

[54] IMAGE FORMING APPARATUS

[75] Inventors: Masakazu Hiroi, Kawasaki; Chikara Sato, Hachioji; Katsuya Yamazaki, Toride; Yasuo Fukazu, Abiko; Tomohito Nakagawa, Kashiwa; Takuya Terae, Matsudo; Takayuki Fujii, Toride; Yuichi Yamamoto, Toride; Yuzoh Matsumoto, Toride, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/972,720

[22] Filed: Nov. 18, 1997

[30] Foreign Application Priority Data

Nov. 18, 1996 [JP] Japan ..... 8-306426
Dec. 4, 1996 [JP] Japan ..... 8-324406

[51] Int. Cl.[7] ..... B65H 5/00

[52] U.S. Cl. ..... 271/10.03; 271/10.09; 271/110; 271/111; 271/118

[58] Field of Search ..... 271/10.03, 10.09, 271/10.11, 110, 111, 117, 118

[56] References Cited

U.S. PATENT DOCUMENTS

| | | | |
|---|---|---|---|
| 4,544,148 | 10/1985 | Kitajima et al. . | |
| 4,787,676 | 11/1988 | Sasaki et al. . | |
| 5,205,548 | 4/1993 | Yamada et al. | 271/111 |
| 5,209,465 | 5/1993 | Sayama et al. | 271/110 |
| 5,455,667 | 10/1995 | Hiroi et al. . | |
| 5,621,501 | 4/1997 | Matsuo et al. . | |
| 5,622,364 | 4/1997 | Dutton et al. | 271/110 |
| 5,720,477 | 2/1998 | Morita et al. | 271/117 |
| 5,882,002 | 3/1999 | Kamei et al. | 271/118 |

FOREIGN PATENT DOCUMENTS 0 083 025 7/1983 European Pat. Off. .

*Primary Examiner*—H. Grant Skaggs
*Attorney, Agent, or Firm*—Fitzpatrick, Cella, Harper & Scinto

[57] ABSTRACT

A stack sheet supplying apparatus has a sheet stacking unit, a supply roller for supplying a sheet by contacting with an uppermost sheet in a sheet stack resting on the sheet stacking unit, a lift/lower device for controlling lifting and lower of the supply roller, a drive for driving the lift/lower device, a detector for detecting the fact that the supply roller reaches a supply position after the supply roller is lowered, and a control for turning OFF the drive on the basis of a detected result of the detector.

33 Claims, 35 Drawing Sheets

| FIG. 6A | FIG. 6B |
|---|---|

IMAGE FORMING APPARATUS

BACKGROUND OF THE INVENTION

1. Field of the Invention

The present invention relates to a stack sheet supplying apparatus for supplying stacked sheet one by one from an uppermost one and an image reading apparatus having such a sheet supplying apparatus.

2. Related Background Art

In the past, a sheet supplying apparatus for supplying a sheet such as an original has been used with an image forming apparatus such as a copying machine. Such a sheet supplying apparatus comprises a sheet tray on which a plurality of sheets are stacked as a sheet stack, and a sheet supply roller for supplying a sheet in the sheet stack from an uppermost one toward an image forming portion. A separation means disposed at a downstream side of the sheet supply roller in a sheet conveying direction serves to separate the sheets (when a plurality of sheets are supplied by the sheet supply roller) one by one and convey the separated sheet toward a downstream side. Further, a convey means disposed at a downstream side of the separation means serves to further convey the sheet toward the downstream side.

In the above-mentioned sheet supply roller, it is necessary to supply the sheet by a proper supplying force. To this end, various methods have been proposed.

As a first method, the sheet tray includes a lift mechanism and a height detection means for detecting a height of the sheet stack (height of an uppermost sheet) rested on the tray is provided so that, when the height of the sheet stack is decreased by supplying the sheets successively, the lift mechanism is operated in response to a signal from the height detection means to maintain the uppermost sheet in the sheet stack to the optimum height.

As a second method, a height detection means for detecting a height of the sheet stack (height of an uppermost sheet) rested on the tray is provided so that, when the height of the sheet stack is decreased by supplying the sheets successively, a sheet supply roller is brought to the optimum height in response to a signal from the height detection means.

The height detection means may be a distance measuring sensor, or a sensor of type in which the fact that a sensor flag lever is contacted with the sheet. However, in the above-mentioned first method, since the lift mechanism and the height detection means are required, the entire apparatus becomes expensive. In the above-mentioned second method (using the sensor flag lever), if the sheet is curled, the sensor will detect a curled portion of the sheet, with the result that the sheet supply roller is rotated idly without contacting with the major portion of the sheet, thereby causing poor sheet supply, or skew-feed of the sheet due to insufficient sheet supplying force of the sheet supply roller.

When the sheet is supplied, the sheet supply roller is lowered until it is contacted with the sheet stack. In this case, when the sheet supply roller is contacted with the sheet stack, vibration is normally generated due to the reaction. In such a case, if the sheet supply roller is rotated while the vibration is being generated, the sheet supply becomes unstable. Thus, the sheet supply roller is stopped until the vibration disappears.

However, when the sheet supply roller is stopped in this way, the sheet supplying time (sheet treating time) is increased. This causes a serious problem particularly when a large number of sheets are supplied.

SUMMARY OF THE INVENTION

An object of the present invention is to provide a sheet supplying apparatus in which sheets can be supplied stably regardless of a height of a sheet stack.

Another object of the present invention is to provide a sheet supplying apparatus which is cheap.

A further object of the present invention is to provide a sheet supplying apparatus which can prevent poor sheet supply and skew-feed of the sheet.

A still further object of the present invention is to provide a sheet supplying apparatus in which vibration generated when a sheet supply roller is contacted with a sheet stack is reduced to shorten the stopped time of the sheet supply roller, thereby increasing a sheet supplying speed.

A further object of the present invention is to provide a sheet supplying apparatus which can reduce operating noise and power consumption.

The other object of the present invention is to provide an image forming apparatus having such a sheet supplying apparatus.

To achieve the above objects, according to the present invention, there is provided a sheet supplying apparatus comprising a sheet stacking means, a supply means for supplying a sheet by contacting with an uppermost sheet in a sheet stack rested on the sheet stacking means, a lift/lower means for controlling the lifting and lowering of the supply means, a drive means for controlling the lifting and lowering of the lift/lower means, detection means for detecting the fact that the supply means reaches a supply position after the supply means is lowered, and a control means for turning OFF the drive means on the basis of a detected result of the detection means.

Further, the present invention provides a sheet supplying apparatus comprising a sheet stacking means, a supply means for supplying a sheet by contacting with an uppermost sheet in a sheet stack rested on the sheet stacking means, and a control means for controlling the supply means to shift the supply means between a supply position to be contacted with the uppermost sheet in the sheet stack, a home position to be spaced apart from the sheet stack and a retard position situated between the supply position and the home position, and for lifting and lowering the supply means between the supply position and the retard position to supply a sheet.

According to the present invention, when the sheet is supplied, the supply means (supply roller) is contacted with the sheet stack by its own weight and, by rotating the supply roller, the supply roller supplies the sheet always stable regardless of a height of the sheet stack. Further, if the sheet to be supplied is curled, poor sheet supply and skew-feed of the sheet can be prevented.

On the other hand, when the supply means (supply roller) is lifted to a position spaced apart from the sheet stack by a small distance and is waited there, a shifting amount of the supply roller during the sheet supply can be reduced. As a result, vibration generated when the supply roller is contacted with the sheet stack can be reduced to shorten a stopping time of the supply roller, thereby increasing a sheet supplying speed. Further, since the shifting amount of the supply roller can be reduced, operation noise and power consumption can be reduced.

BRIEF DESCRIPTION OF THE DRAWINGS

FIG. 3A shows a maximum lift position of the sheet supply roller and FIG. 3B shows a maximum lower position of the sheet supply roller;

FIG. 4 is a plan view showing the sheet supply roller and the like;

DETAILED DESCRIPTION OF THE PREFERRED EMBODIMENTS

The present invention will now be explained with reference to the accompanying drawings.

First of all, an embodiment of the present invention will be described with reference to FIGS. 1 to 27.

<Explanation of Entire Construction of Image Forming Apparatus>

Figure 1:
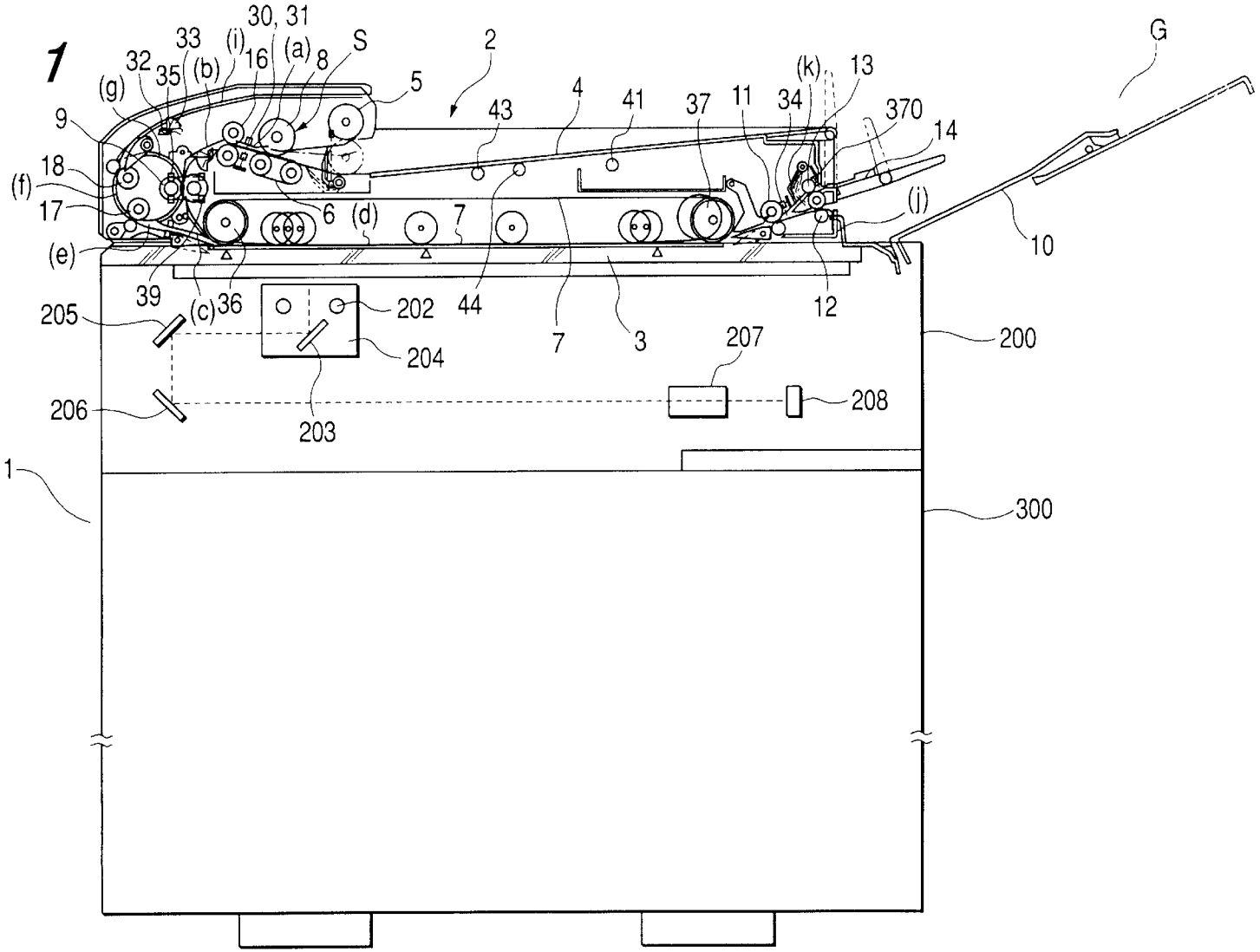
FIG. 1 is a sectional view of an image forming apparatus according to the present invention.

FIG. 1 is a sectional view showing an entire construction of an image forming apparatus G according to the present invention. A main body 1 of the image forming apparatus G (referred to as "main body 1" hereinafter) includes an image reading means (referred to as "reader portion" hereinafter) 200 for optically reading image information on an original (original sheet), and an image outputting portion (referred to as "printer portion" hereinafter) 300 for printing the read image on a predetermined sheet. Above the main body 1, there is provided an automatic original conveying apparatus (referred to as "ADF" hereinafter) 2 as a sheet supplying apparatus for automatically conveying the originals successively.

<Explanation of Reader Portion 200>

The reader portion 200 has a platen 3 constituting an upper surface of the main body 1. Below the platen 3, there is disposed a shiftable scanner unit 204 having a lamp 202 and a mirror 203. The reader portion 200 further includes mirrors 205, 206, a lens 207 and an image sensor 208 and serves to optically read the image information recorded on the original and to read-in image data obtained by photoelectrically converting the read image information. Position control of the scanner unit 204 may be performed by controlling an operation of a conventional stepping motor or may be performed by using a mechanical stopper(s).

<Explanation of Printer Portion 300>

The printer portion 300 is a conventional image forming means, and, since it does not relate to the present invention directly, explanation thereof will be omitted.

<Explanation of ADF 2>

Next, a construction of the ADF 2 will be explained.

<Explanation of Original Tray>

Figure 2:
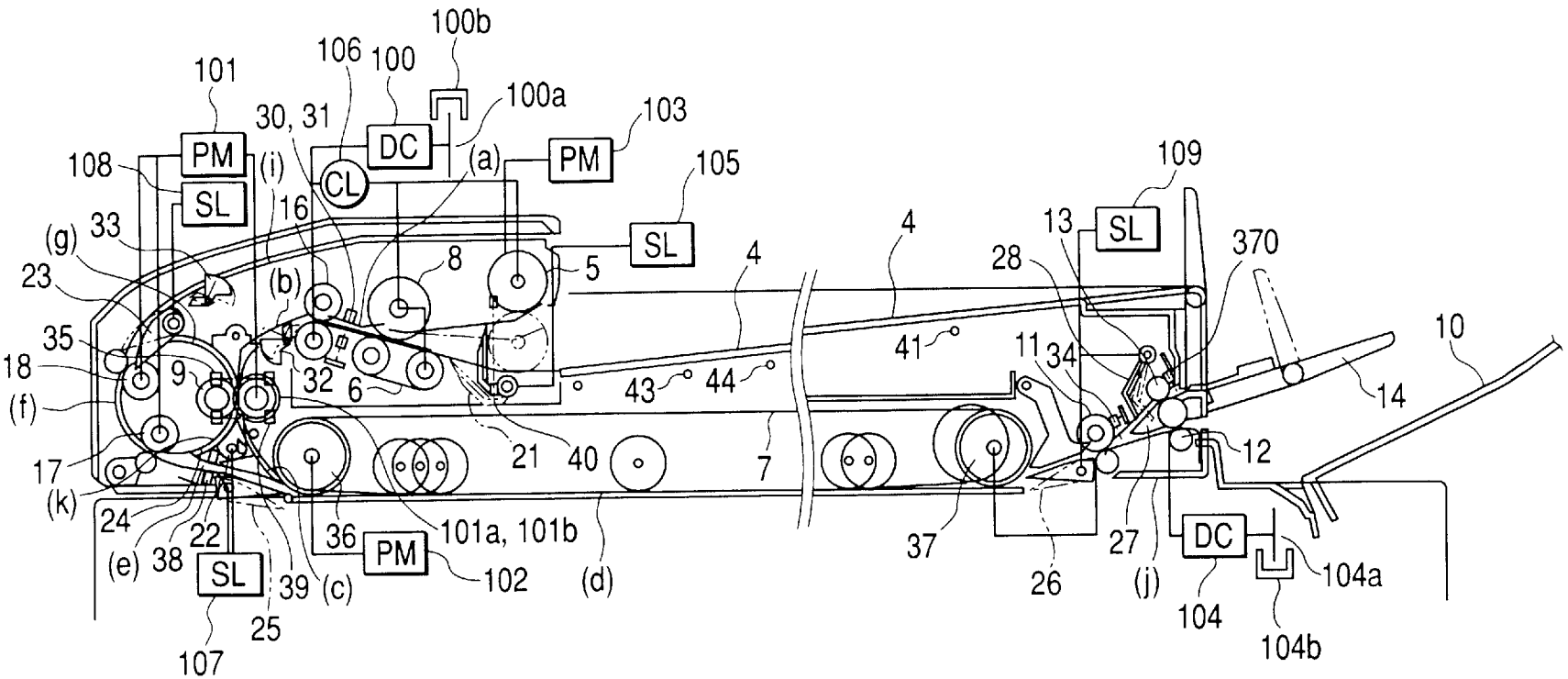
FIG. 2 is a sectional view of a sheet supplying apparatus (auto document feeder; ADF) of the image forming apparatus.

FIG. 2 is a sectional view showing the construction of the ADF in detail. The ADF 2 has an original tray (sheet stacking means) 4 on which a plurality of originals (original sheets) are stacked as an original stack. The original tray 4 is provided with a pair of width-wise direction regulating plates (not shown) slidable in a width-wise direction of the original, by which lateral edges of the originals stacked on the original tray are regulated, thereby maintaining the stability of the sheet supply.

A stopper 21 is rotatably arranged at a left end (downstream end) of the original tray 4. The stopper 21 can selectively be shifted between a position (shown by the solid line in FIG. 2) where the stopper is cocked above the tray to prevent the supplying of the original and a retard position (shown by the two dot and chain line in FIG. 2) where the stopper does not interfere with the original.

<Explanation of Rollers and Original Convey Paths>

Next, rollers disposed within the ADF 2 and convey paths through which the original is conveyed will be explained with reference to FIGS. 2 to 4.

Figure 3A:
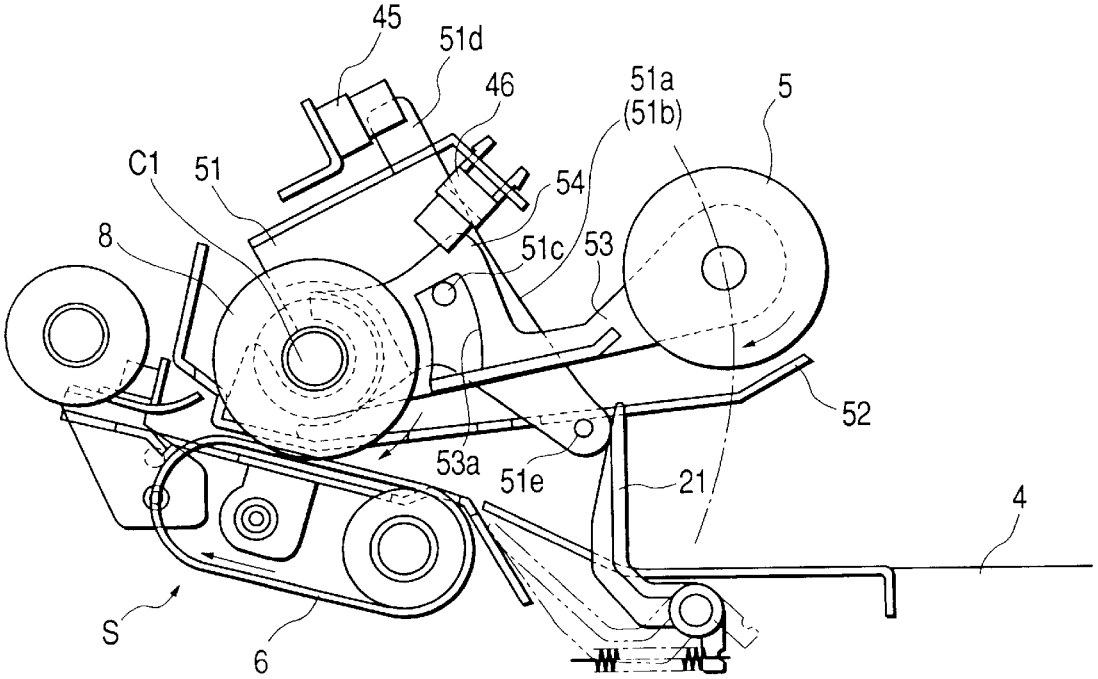
FIGS. 3A and 3B are views showing construction and function of a sheet supply roller disposed at a left end of an original tray of the sheet supplying apparatus, where
Figure 3B:
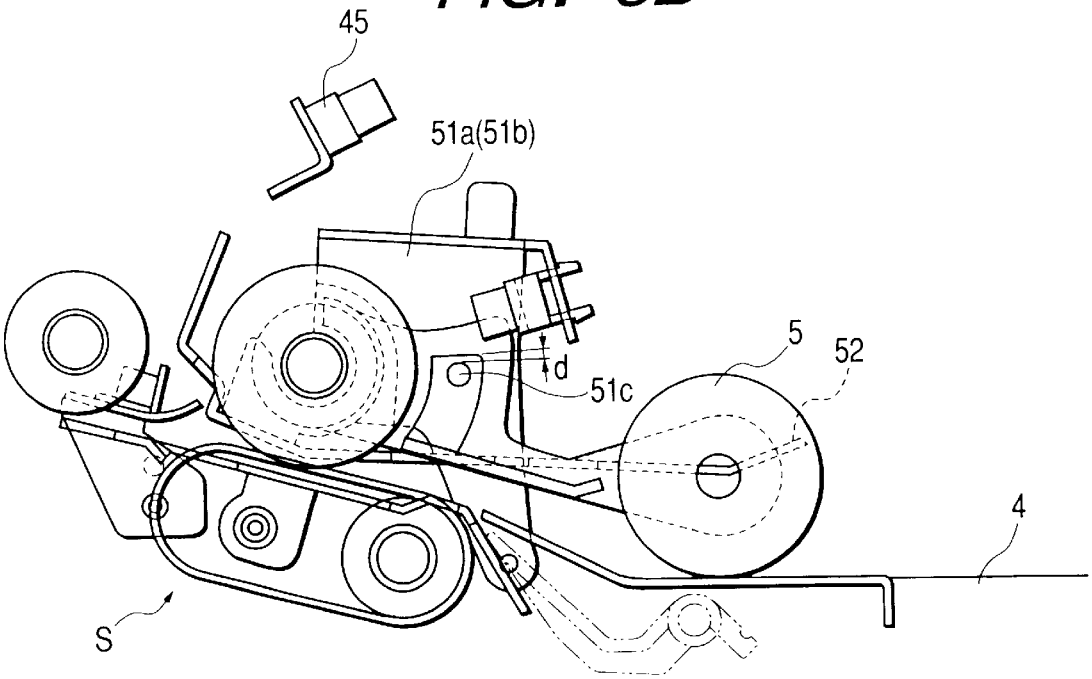
Figure 4:
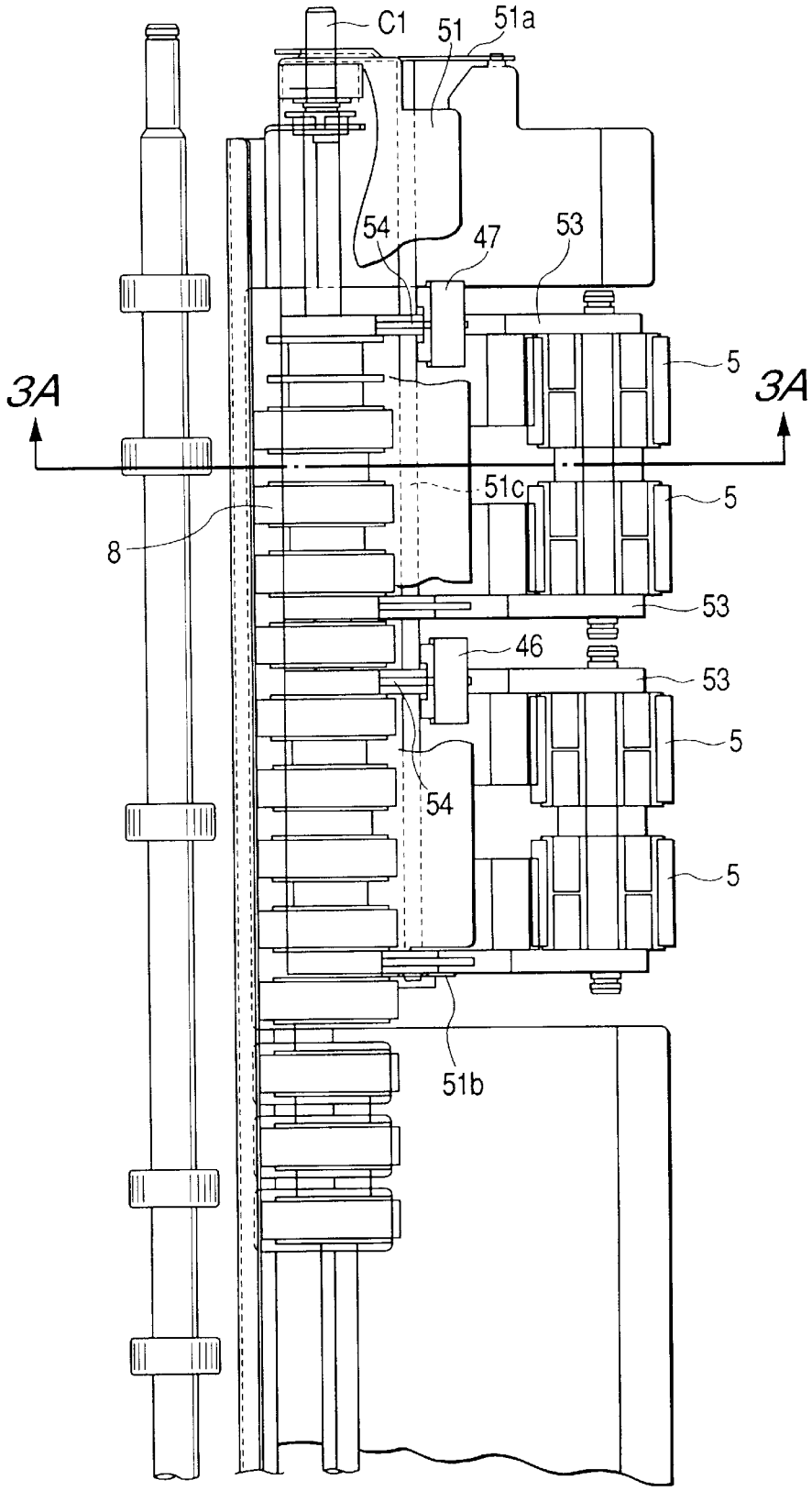

FIGS. 3A and 3B are views showing construction and function of the sheet supply roller 5 (supply rotary member) disposed at the left end of the original tray 4 of the sheet supplying apparatus, where FIG. 3A shows a maximum lift position of the sheet supply roller 5 and FIG. 3B shows a maximum lower position of the sheet supply roller 5. FIG. 4 is a plan view showing the sheet supply roller 5 and the like.

As clearly shown in FIG. 3A, a rock arm (arm member) 53 is disposed at the left end of the original tray 4 for rocking movement around a point C1 in an up-and-down direction and the sheet supply roller 5 is rotatably mounted on a free end of the rock arm 53 (rock means). An arcuate through hole 53*a* (described later) is formed in the rock arm 53. As shown in FIG. 4, the sheet supply roller 5 includes a plurality of roller portions disposed along the width-wise direction of the original.

Further, there is provided a lift/lower arm (holding member) 51 (lift/lower means) rockable around the point C1. The lift/lower arm 51 can be shifted in a vertical direction between a position shown in FIGS. 3A and 3B and a position shown in FIG. 3B. The lift/lower arm 51 has support plates 51*a*, 51*b* spaced apart from each other in a direction parallel to the plane of FIGS. 3A and 3B and an arm shaft 51*c* (engagement means) extending between and passes through the support plates 51*a*, 51*b*. The arm shaft 51*c* also passes through the above-mentioned arcuate through hole 53*a* so that, as the lift/lower arm 51 is rocked, the rock arm is also rocked. An arm shaft 51*e* is supported by the support plates 51*a*, 51*b*.

That is to say, in the illustrated embodiment, the lift/lower arm 51 moved the rock arm 53 in the up-and-down direction, and the rock arm 53 and the sheet supply roller 5 constitute a sheet supply means for successively supplying the originals from an uppermost one toward the inside of the main body 1.

An upper separation guide plate 52 is disposed for rocking movement around the point C1. When the lift/lower arm 51 is positioned in the position shown in FIG. 3A, the separation guide plate 52 is supported by the arm shaft 51*e* of the lift/lower arm from the below, thereby regulating clockwise rotation of the separation guide plate due to its own weight. When the lift/lower arm 51 is positioned in the position shown in FIG. 3B, the separation guide plate 52 is disengaged from the arm shaft 51*e* and the position (guide position) of the separation guide plate is regulated by a stopper (not shown).

When the original is supplied, since the sheet supply roller 5 is lowered until it is contacted with the original stack (fully described later), the sheet supply roller is bounded when it is contacted with the original stack, as is well-known. When the sheet supply roller 5 has a plurality roller portions disposed side by side along the width-wise direction of the original (see FIG. 4), pressure balances between the roller portions 5 (pressure balances regarding the original stack) becomes uneven, with the result that, if the sheet supply is started in the bounding condition, skew-feed of the original will occur. However, in the illustrated embodiment, since the roller portions of the sheet supply roller 5 are independently suspended to easily equalize with the original, the sheet supplying ability can be improved.

A separation convey roller 8 is rotatably mounted around the point C1, and a conventional separation belt 6 is disposed below the separation convey roller 8. The separation convey roller 8 and the separation belt 6 constitute a separation portion S, where the originals are separated by rotating the convey roller 8 and the belt 6 in the directions shown by the arrows. The separation convey roller 8 is provided with a one-way mechanism, so that a convey load generated when the original is pulled from the separation portion S by a first supply roller 16 (described later) is reduced.

As shown in FIG. 2, the first supply roller 16 is rotatably supported at the left of the separation portion S to convey the original sent from the separation portion S toward a downstream side. An original convey path (a) is disposed between the separation portion S and the first supply roller 16.

An original convey path (b) disposed at a downstream side of the first supply roller 16 is curved downwardly and leftwardly and a second supply roller 9 is rotatably disposed in the convey path (b). The original is further conveyed toward the downstream side by the second supply roller 9. While the original is being conveyed by the first supply roller 16, the second supply roller 9 is stopped, with the result that a loop is formed in the original, thereby correcting the skew-feed of the original.

Further, an original convey path (c) extends from below the second supply roller 9 to above a left end of the platen 3, and a drive roller 36 is rotatably disposed above the left end of the platen 3. A turn roller (belt pulley) 37 is rotatably disposed above a right end of the platen 3, and a wide belt 7 extends between these rollers 36, 37 and is wound around these rollers. The wide belt 7 is disposed along the platen 3 to define an original convey path (d) therebetween, and, when the wide belt is rotatingly driven, the original P is conveyed to a predetermined position on the platen 3 or is discharged from the platen.

That is to say, in the illustrated embodiment, the original convey paths (a), (b) and (c) are disposed between the original tray 4 and the platen 3 in a curved fashion, and, by the action of the sheet supply roller 5, separation portion S, first supply roller 16 and second supply roller 9, the originals P on the original tray are successively conveyed to the platen 3.

Although the original convey path (c) is curved downwardly and rightwardly from the second supply roller 9 to the platen 3, and a reverse supply path (h) is curved downwardly and leftwardly from the second supply roller 9. A first reverse roller 17 is rotatably disposed at an end of the supply path (h). The reverse supply roller (h) is connected to the original convey path (d) through a reverse supply/discharge path (e).

A reverse supply path (f) extends upwardly and leftwardly from the first reverse roller 17, and a second reverse roller 18 is rotatably disposed at an end of the supply path (f). Further, the reverse supply path (f) is branched into two reverse supply paths (i), (g) above the second reverse roller 18, and the reverse supply path (i) extends upwardly and rightwardly from the second reverse roller 18 and the reverse supply path (g) extends toward the original convey path (b) to communicate the reverse supply path (f) with the original convey path (b).

In the illustrated embodiment, when the original is surface-reversed (pre-reverse) before it is conveyed to the platen 3, the original is conveyed through the paths in the order of (a)→(b)→(h)→(f)→(i)→(e)→(d), which will be fully described later.

On the other hand, when the original is surface-reversed after the original was conveyed to the platen 3 and the image information on the original was read, the original is conveyed through the paths in the order of (e)→(f)→(g)→(c)→(d), which will be fully described later.

Further, an original discharge path (j) and a sheet discharge tray 10 are disposed at the right side of the wide belt 7. A pair of discharge roller 12 are disposed in the original discharge path (j) so that, after the image information was read, the original on the platen 3 is discharged onto the discharge tray 10.

An open/close manual-insertion original tray 14 is disposed above the discharge tray 10 and a manual-insertion sheet supply roller 13 is disposed at the left end of the tray 14. The supply roller 13 serves to supply an original (single original) P set on the manual-insertion original tray 14 toward a manual-insertion convey path (k). A pair of manual-insertion regist rollers 11 are disposed in the manual-insertion convey path (k) to convey the manually inserted original P to the platen 3. Similar to the second supply roller 9, the pair of regist rollers 11 are stopped while the original is being conveyed, so that a loop is formed in the original, thereby correcting the skew-feed of the original.

On the other hand, a manual-insertion shutter 28 is rotatably supported at a downstream side of the manual-insertion sheet supply roller 13. The manual-insertion shutter 28 can selectively be shifted between a position (shown by the two dot and chain line) where the manual-insertion convey path (k) is blocked by the shutter to prevent the supplying of the manually inserted original (set on the manual-insertion original tray 14) and a waiting position (shown by the solid line) where the shutter does not interfere with the original. With this arrangement, while the original (image on which was read) is being conveyed from the platen 3 to the discharge tray 10, the original set on the manual-insertion original tray 14 is prevented from entering into the manual-insertion convey path (k). While the supplying of the original is being prevented by the manual-insertion shutter 28, although the manual-insertion sheet supply roller 13 is rotatingly driven, a conveying force of the roller 13 is set to small so that the roller 13 can slip on the original.

<Explanation of Flappers>

Next, flappers disposed within the original convey paths will be explained with reference to FIG. 2.

A rockable reverse sheet supply flapper 22 is disposed at a junction between the original convey path (c) and the reverse supply path (h). When the flapper 22 is rocked to a position shown by the solid line, the original convey path (c) is blocked or closed and the reverse supply path (h) is opened, and, when the flapper 22 is rocked to a position shown by the two dot and chain line, the reverse supply path (h) is blocked and the original convey path (c) is opened.

Further, a rockable reverse flapper 23 is disposed at a junction (at a downstream side of the second reverse roller 18 in the original conveying direction) between the reverse supply path (i) and the reverse supply path (g). When the flapper 23 is rocked to a position shown by the solid line, the reverse supply path (g) is blocked and the reverse supply path (i) is opened, and, when the flapper 23 is rocked to a position shown by the two dot and chain line, the reverse supply path (i) is closed and the reverse supply path (g) is opened.

Further, a rockable one-way flapper 24 is disposed at a junction between the reverse supply path (h) and the reverse supply/discharge path (e). The flapper 24 serves as a guide when the original P is conveyed from the reverse supply path (h) to the reverse supply path (f). When the original P is conveyed from the reverse supply paths (g), (f) to the platen 3 through the reverse supply/discharge path (e), the flapper 24 prevents the original P from returning to the reverse supply path (h).

A rockable supply/discharge flapper 25 (cooperating with the reverse sheet supply flapper 22) is disposed at an end of the reverse supply/discharge path (e) near the platen 3. When the original P is conveyed from the reverse supply/discharge path (e) to the platen 3, the flapper 25 is rocked to a position shown by the solid line, thereby preventing a tip end of the original P entering onto the platen 3 from striking against the end of the platen 3, and, when the original P is conveyed from the platen 3 to the reverse supply/discharge path (e), the flapper 25 is rocked to a position shown by the two dot and chain line, thereby permitting smooth conveyance of the original P.

A rockable sheet discharge flapper 26 is disposed between the right end of the platen 3 and the pair of regist rollers 11. When the original P is conveyed from the manual-insertion convey path (k) to the platen 3, the flapper 26 is rocked to a position shown by the solid line, thereby preventing a tip end of the original P entering onto the platen 3 from striking against the end of the platen 3, and, when the original P is discharged from the platen 3 to the original discharge path (j), the flapper 26 is rocked to a position shown by the two dot and chain line, thereby permitting smooth discharge of the original P.

A rockable one-way manual-insertion flapper 27 is disposed at a junction between the original discharge path (j) and the manual-insertion convey path (k). The flapper 27 serves to prevent the original P to be discharged from the platen 3 onto the discharge tray 10 from entering into the manual-insertion convey path (k).

<Explanation of Drive System>

Next, a drive system for driving the rollers and the flappers will be explained with reference to FIG. 2.

The separation convey roller 8, separation belt 6 and sheet supply roller 5 are rotatingly driven by a DC brush motor (referred to as "separate motor" hereinafter) 100 which is PLL-controlled. A separate clutch 106 is disposed between the separate motor 100 and the separation convey roller 8/separation belt 6, so that drive transmission can be turned ON/OFF by the clutch 106. A clock plate 100*a* having a plurality of slits is secured to a motor shaft of the separate motor 100, and separate clock sensor (optical sensor of light permeable type) 100*b* is disposed in a confronting relation to the clock plate 100*a*. When the separate motor 100 is rotated, the separate clock sensor 100*b* generates clock pulses proportional to the number of revolutions of the motor. The rotation of the motor is transmitted to the sheet supply roller 5 by a belt mounted on and wound around the point (shaft) C1 and a shaft of the roller 5.

The second supply roller 9, first reverse roller 17 and second reverse roller 18 are rotatingly driven by a reversible stepping motor (referred to as "convey motor" hereinafter) 101. A clock plate 101*a* having a plurality of slits is secured to a roller shaft of a driven roller of the second supply roller 9, and a reverse clock sensor (optical sensor of light permeable type) 101*b* is disposed in a confronting relation to the clock plate 101*a*. The reverse clock sensor 101*b* generates clock pulses proportional to the number of revolutions of the driven roller. When the original P is conveyed by the second supply roller 9, if the slip is generated, a slip amount can be calculated on the basis of the number of the clock pulses and drive clock number for the convey motor 101.

The drive roller 36 (and, accordingly, the wide belt 7) can be rotatingly driven by a reversible stepping motor (referred to as "belt motor" hereinafter) 102. The number of rotations of the belt motor 102 can be detected by a clock plate having a plurality of slits and a clock sensor of light permeable type. Although the rotation of the drive roller 36 is transmitted to the turn roller 37 through the wide belt 7, since a driving force is transmitted from the turn roller 37 to the pair of regist rollers 11, the conveying speed of the original on the platen 3 is selected to become the same as the conveying speed of the pair of manual-insertion regist rollers 11.

The lift/lower arm 51 is driven by a reversible stepping motor (referred to as "rock motor" hereinafter) 103. The number of rotation of the rock motor 103 (drive means) can be detected by a clock plate having a plurality of slits and a clock sensor of light permeable type.

The discharge roller 12 and the manual-insertion sheet supply roller 13 are rotatingly driven by a DC motor (referred to as "discharge motor" hereinafter) 104 of FG servo control type. A clock plate 104*a* having a plurality of slits is secured to a motor shaft of the discharge motor 104, a discharge clock sensor (optical sensor of light permeable type) 104*b* is disposed in a confronting relation to the clock plate 104*a*. When the discharge motor 104 is rotated, the discharge clock sensor 104*b* generates clock pulses proportional to the number of revolutions of the motor.

The stopper 21 is driven by a stopper solenoid 105. More specifically, when the stopper solenoid 105 is turned OFF, the stopper is positioned at a position shown by the solid line, and, when the solenoid 105 is turned ON, the stopper is rocked to a position shown by the two dot and chain line. The reverse sheet supply flapper 22 and the sheet supply flapper 25 are driven by a path switch solenoid 107. More particularly, when the solenoid 107 is turned OFF, the flappers 22, 25 are positioned at positions shown by the solid line, and, when the solenoid 107 is turned ON, the flappers 22, 25 are rocked to positions shown by the two dot and chain lines.

The reverse flapper 23 is driven by a flapper solenoid 108. More specifically, when the solenoid 108 is turned OFF, the flapper 23 is positioned at a position shown by the solid line, and, when the solenoid 108 is turned ON, the flapper is rocked to a position shown by the two dot and chain line. The discharge flapper 26 and the manual-insertion shutter 28 are driven by a flapper solenoid 109. More specifically, when the solenoid 109 is turned OFF, the flapper 26 and the shutter 28 are positioned at positions shown by the solid line, and, when the solenoid 109 is turned ON, the flapper 26 and the shutter 28 are rocked to positions shown by the two dot and chain lines.

<Explanation of Sensors>

Next, sensors will be described.

As shown in FIG. 3A, the lift/lower arm 51 has a lift/lower flag 51*d*, and a supply roller home sensor (optical sensor of permeable type) 45 is disposed in a confronting relation to the lift/lower flag 51*d* (above the separation portion S). By lifting the lift/lower arm 51, as shown, when a sensor path of the supply roller home sensor 45 is blocked by the lift/lower flag 51*d*, a home position (waiting position) of the lift/lower arm 51 is detected.

Figure 11A:
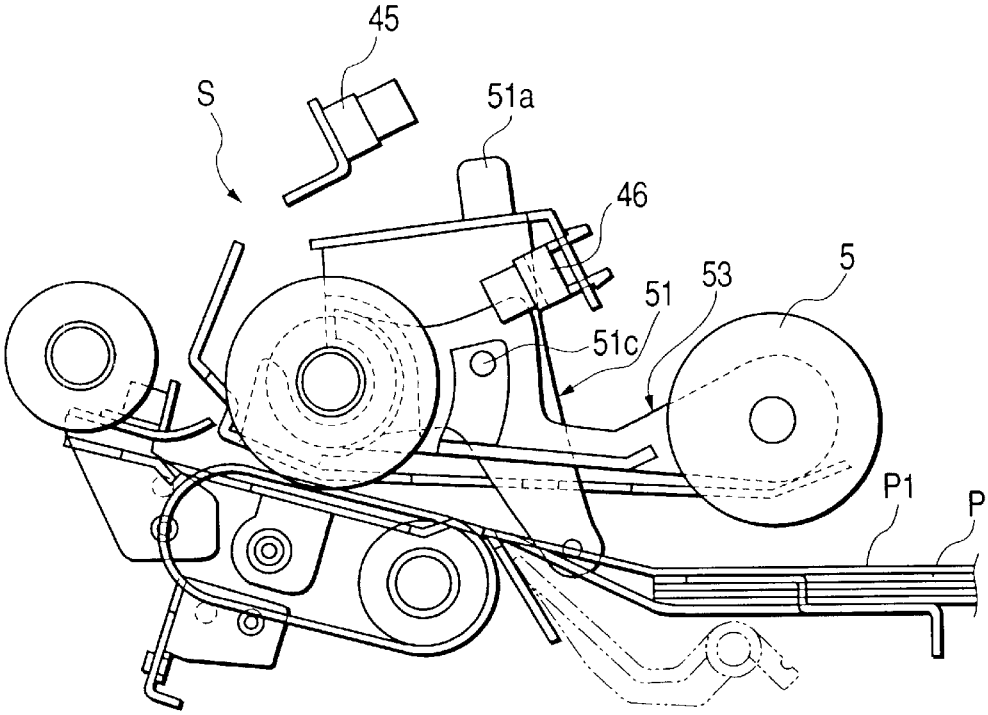
FIG. 11A is a view showing a condition that the sheet supply roller is contacted with the original.
Figure 11B:
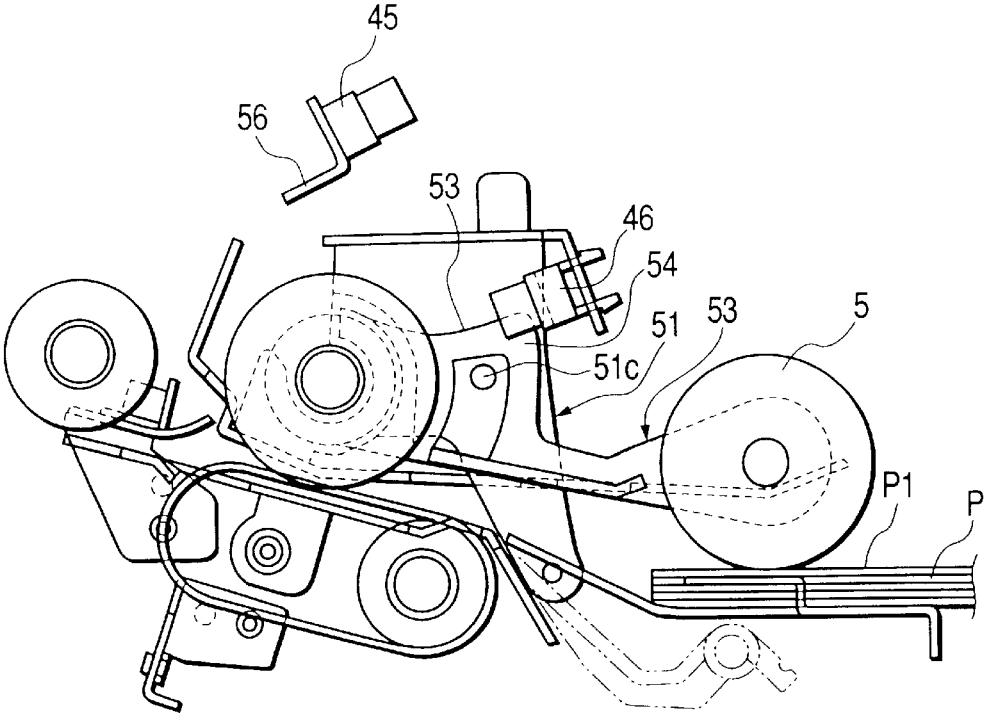
FIG. 11B is a view for explaining a retard position of the sheet supply roller.

As shown in FIG. 3A, a rock arm flag 54 is formed on the rock arm 53 and a rock position sensor 46 (detection means) is attached to the lift/lower arm 51. As shown in FIG. 11B, when the sheet supply roller 5 is contacted with the uppermost original in the original stack, a rocking movement of the rock arm 53 is stopped. On the other hand, since a rocking movement of the lift/lower arm 51 is continued, a relative position between the rock arm and the lift/lower arm is changed, with the result that a sensor path of the rock position sensor 46 is blocked by the rock arm flag 54, thereby generating an ON signal. The rock motor 103 for the lift/lower arm 51 is turned OFF by the ON signal to stop the lift/lower arm 51. That is to say, the rock position sensor 46 and the rock arm flag 54 constitute a contact detect sensor for detecting the contact between the sheet supply roller 5 and the original. In this case, a gap d as shown in Fig. 11B is created between the arm shaft 51*c* and the through hole 53*a*. When there is no original on the tray 4, the same gap d is created as shown in FIG. 3B.

As shown in FIG. 2, an original set detect sensor (optical sensor of permeable type) 40 is disposed in the vicinity of an upstream portion of the stopper 21 to detect the fact that the originals are set. Further, an original trail end detect sensor (optical sensor of reflection type) 41 is disposed at an intermediate portion (spaced apart from the stopper 21 by a distance of 225 mm) of the original tray 4 so that the fact that originals of large size are set on the tray is detected by the original trail end detect sensor 41.

A last original detect sensor (optical sensor of reflection type) 43 is disposed at an intermediate position between the original set detect sensor 40 and the trail end detect sensor 41 so that it can be judged whether an original being conveyed is a last original or not. Further, a sheet width detect sensor 44 is disposed below the original tray 4 so that a width of the original P set on the original tray 4 is detected by detecting the position of the width direction regulating plate 33.

A separate sensor (optical sensor of permeable type) 30 is disposed between the separation convey roller 8 and the first supply roller 16 to detect the original conveyed by the separation convey roller 8. Further, a skew-feed detect sensor (optical sensor of permeable type) 31 is disposed at a position same as that of the separate sensor 30 in the conveying direction and spaced apart from the separate sensor 30 in a thrust direction (width-wise direction of the original) by a predetermined distance. The skew-feed detect sensor 31 cooperates with the separate sensor 30 to detect a skew-feed amount of the original.

A mixed stack detect sensor 32 is disposed at a downstream side and in the vicinity of the first supply roller 16. The mixed stack detect sensor 32 cooperates with the sensors on the original tray 4 to detect the fact that the original having different sizes are stacked on the original tray 4 during the original conveyance. Further, a supply sensor (optical sensor of permeable type) 35 is disposed at an upstream side of and in the vicinity of the second supply roller 9 to detect tip and trail ends of the original P being conveyed through the original convey paths (a), (b), (c) and the reverse supply path (g). A regist sensor (optical sensor of permeable type) 39 is disposed at a downstream side of the supply roller 9 to control a stop position of the original P (on the platen 3) by detecting the trail end of the original P.

A reverse sensor (optical sensor of permeable type) 38 is disposed in the reverse supply/discharge path (e) to detect the original P discharged from the platen 3 or the original P entering onto the platen 3. Further, a reverse detect sensor 33 for detecting the original P by flag movement is disposed in the reverse supply path (i) so that the original P is directed to the reverse supply path (i) by the switching of the reverse flapper 23 can be detected. A manual-insertion regist sensor (optical sensor of permeable type) 34 is disposed at a downstream side of and in the vicinity of the pair of regist rollers 11 in a sheet discharging direction to detect the original from the manual-insertion convey path (k) and the original discharged from the platen 3 into the original discharge path (j).

A manual-insertion original detect sensor 370 for detecting the original P by flag movement is disposed in the vicinity of the manual-insertion sheet supply roller 13 near the manual-insertion original tray 14 to detect the fact that the original is set on the manual-insertion original tray 14.

<Explanation of Reading Positions>

Next, original reading positions will be explained with reference to FIG. 5.

Figure 5:
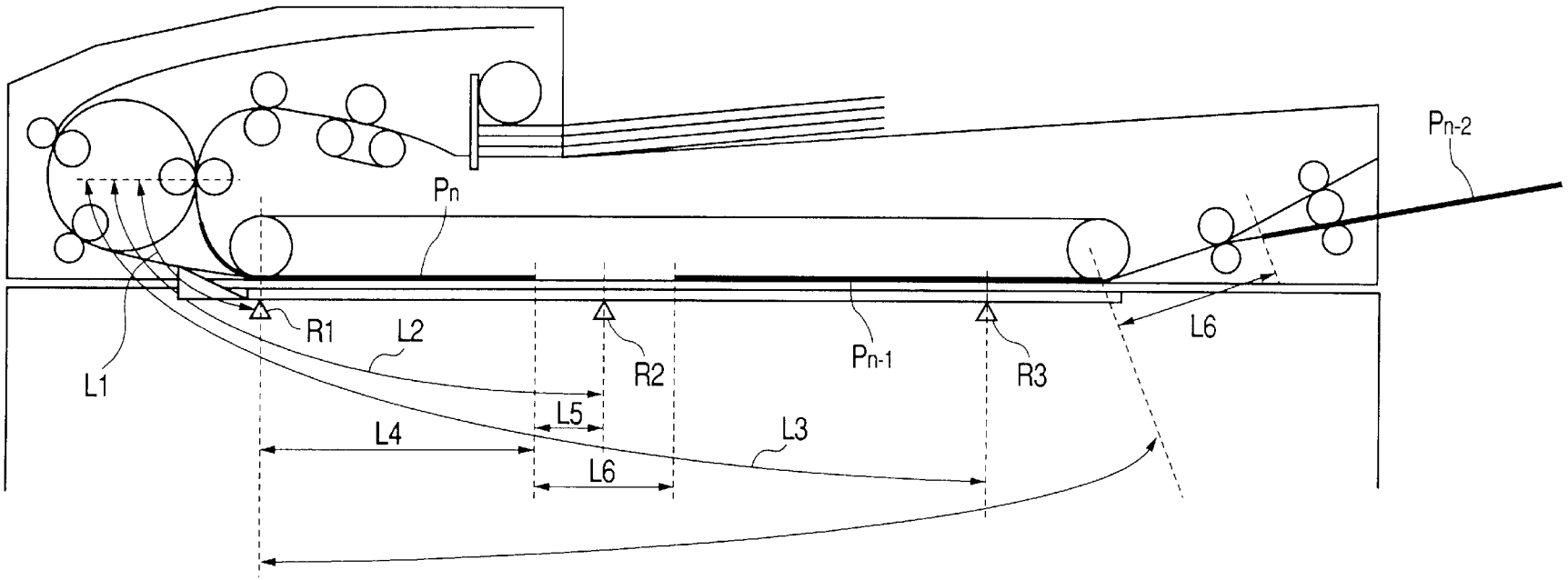
FIG. 5 is a view showing an original reading position on a platen.

FIG. 5 shows the original reading positions on the platen 3. There are original reading positions R1, R2, R3 selected in accordance with original convey modes and sizes of the originals to be conveyed. The reading position R1 (referred to as "first image tip R1" hereinafter) is used in a both-face original mode, and the original rested on this reading position is scanned by a scanner 204 of the main body 1 to read an image on the original. The reading position R2 is used in a half size one-face original convey mode. When the original P reaches this position R2 (referred to as "second image tip R2" hereinafter), the image reading is started. In this mode, the scanner 204 of the main body 1 is fixed, and the image is read while conveying the original.

The reading position R3 is used in a large size one-face original convey mode or is used when an original of half size is longitudinally conveyed. When the original P reaches this position R3 (referred to as "third image tip R3" hereinafter), the image reading is started. Also in this mode, the scanner 204 of the main body 1 is fixed, and the image is read while conveying the original.

In FIG. 5, a symbol L1 denotes a distance from a nip of the second supply roller 9 to the first image tip R1; L2 denotes a distance from the nip of the second supply roller 9 to the second image tip R2; and L3 denotes a distance from the nip of the second supply roller 9 to the third image tip R3. Further, a symbol L4 denotes a distance from the first image tip R1 to the tip end of the original when the original of half size is rested on the left portion of the platen 3; L5 denotes a distance between the second image tip R2 and the tip end of the original stopped at the waiting position; L6 denotes a distance (sheet interval) between a trail end of a preceding original and a trail end of a succeeding original; and L7 denotes a distance from the first image tip R1 to a nip of the manual-insertion regist rollers 11.

When it is assumed that a length of the original of half size in the conveying direction is $L_{ph}$, the stop position of the half size original is controlled to satisfy the following relations:

$$L7<[L4+2\times L6+L_{ph}],$$

$$L2>[L5-L_{ph}].$$

Thus, as shown in FIG. 5, even when the succeeding originals $P_n$, $P_{n-1}$ are stopped on the platen 3, the trail end of the preceding original $P_{n-2}$ leaves the nip in the manual-insertion regist rollers 11 and the trail end of the succeeding original $P_n$ waiting for image formation leaves the nip of the second supply roller 9.

<Explanation of Control Circuit>

Next, a control circuit of the ADF 2 will be explained with reference to FIGS. 6A and 6B.

Figures 6, 6A:
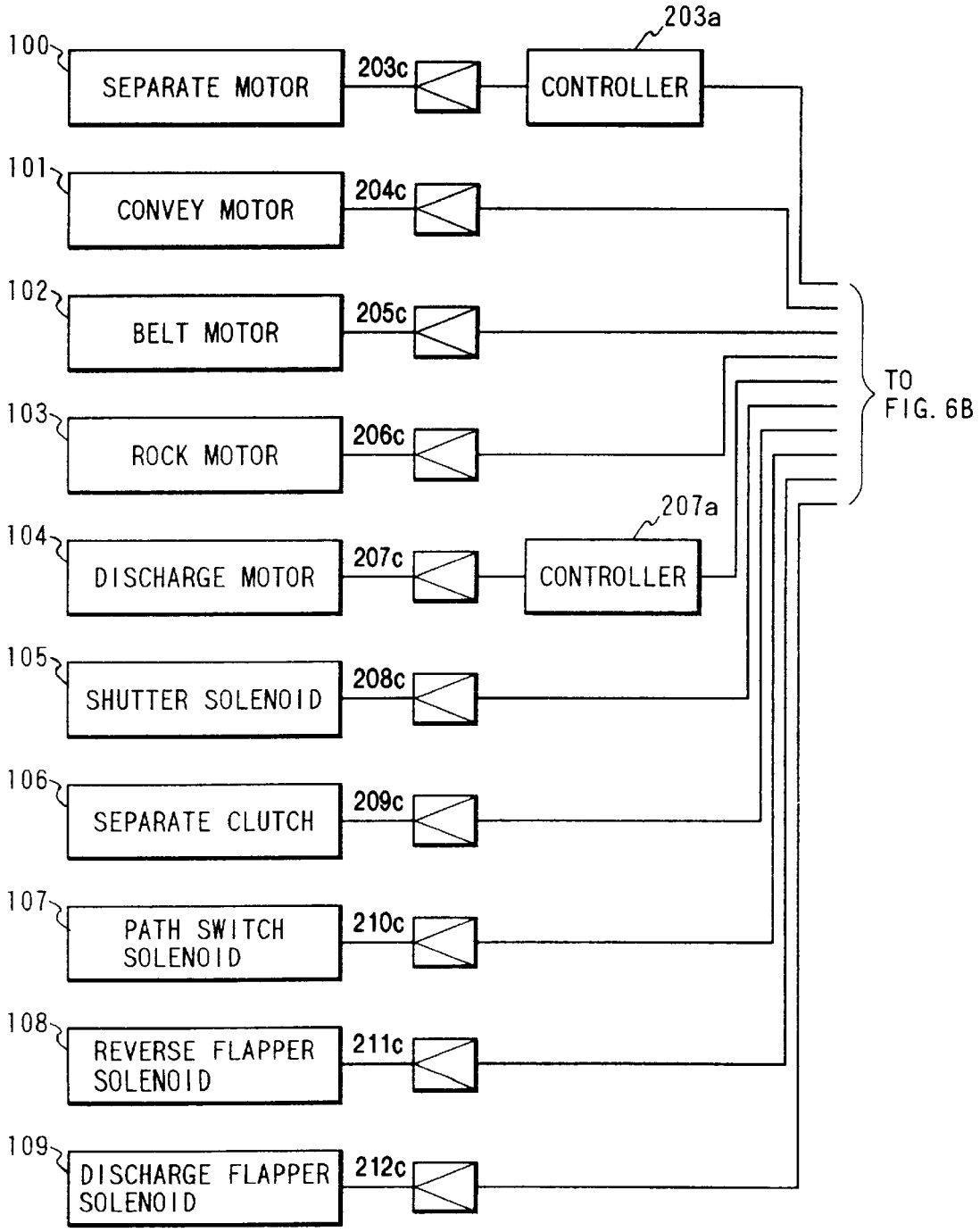
FIG. 6 comprised of FIGS. 6A and 6B is a block diagram showing a control circuit.
Figure 6B:
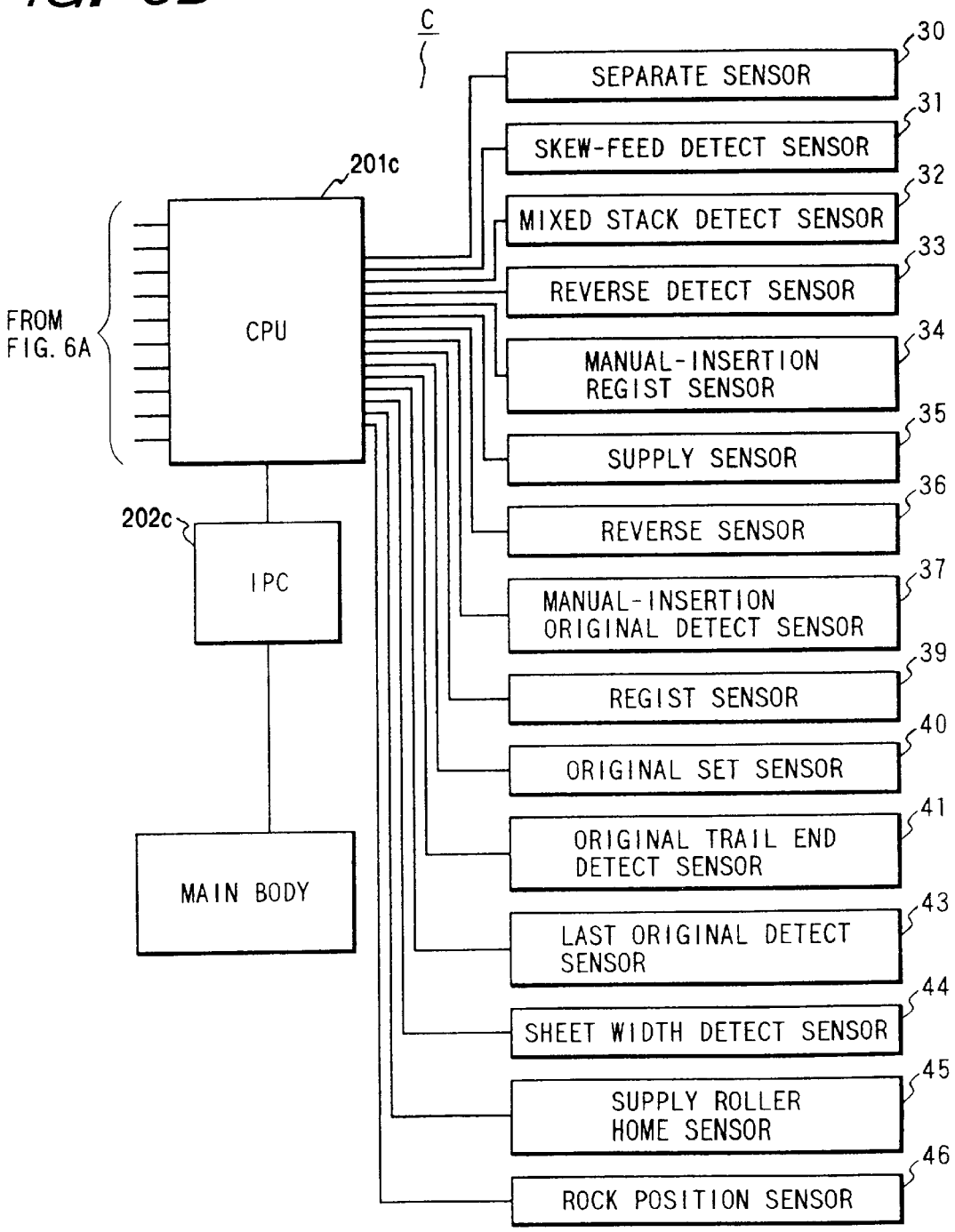

FIGS. 6A and 6B are block diagrams of the control circuit according to the illustrated embodiment. The control circuit C mainly comprises a microprocessor (referred to as "CPU" hereinafter) 201*c* including a RAM (not shown) backed-up by a battery and a ROM (also not shown) for storing control sequence software. Incidentally, the reference numeral 202*c* denotes a communication IC for controlling data communication between the main body of the copying machine and the CPU.

The separate sensor 30, skew-feed detect sensor 31, mixed stack detect sensor 32, reverse detect sensor 33, manual-insertion regist sensor 34, supply sensor 35, reverse sensor 38, manual-insertion original detect sensor 370, regist sensor 39, original set detect sensor 40 original trail end detect sensor 41, last original detect sensor 43, sheet width detect sensor 44, supply roller home sensor 45, rock position sensor 46 are connected to input ports of the CPU 201*c* to monitor the movement of the originals and performance of movable (variable) loads within the apparatus.

On the other hand, the motor 100 and other motors are connected to output port of the CPU 201*c* through a driver circuit 203*c* and other drive circuits. That is to say, the separation motor (DC brush motor) 100 is connected to the CPU 201*c* through the driver 203*c* and a controller 203*a* so that the driving of the motor 100 is controlled by the driver 203*c* and controller 203*a*. Incidentally, reference clocks and ON/OFF signals which becomes as a reference for the number of revolutions of the motor is inputted to the controller 203*a* from the CPU 201*c*.

The convey motor (stepping motor) 101 is connected to the CPU 201*c* through a stepping motor driver 204*c* so that the driving of the motor 101 is controlled by the stepping motor driver 204*c*. The belt motor (stepping motor) 102 is connected to the CPU 201*c* through a stepping motor driver 205*c* so that the motor 102 is driven by the stepping motor driver 205*c* with constant current. The drivers 204*c* receive a phase energizing signal and a motor current control signal from the CPU 201*c*.

The rock motor (stepping motor) 103 is connected to the CPU 201*c* through a driver 206*c* so that the motor 103 is driven by the driver 206*c* with constant current. Further, the discharge motor (DC brush motor) 104 is connected to the CPU 201*c* through a driver 207*c* and an FG servo controller 207*a* so that the driving of the motor 104 is controlled by the driver 207*c* and the FG servo controller 207*a*.

A stopper solenoid 105 is connected to the CPU 201*c* through a driver 208*c* so that the driving of the stopper solenoid 105 is controlled by the driver 208*c*. Further, a separate clutch 106 is connected to the CPU 201*c* through a driver 209*c* so that the driving of the separate clutch 106 is controlled by the driver 209*c*.

A path switch solenoid 107 is connected to the CPU 201 through a driver 210*c* so that the driving of the path switch solenoid 107 is controlled by the driver 210*c*. Further, a reverse flapper solenoid 108 is connected to the CPU 201*c* through a driver 211*c* so that the driving of the reverse flapper solenoid 108 is controlled by the driver 211*c*. A discharge flapper solenoid 109 is connected to the CPU 201*c* through a driver 212*c* so that the driving of the discharge flapper solenoid 109 is controlled by the driver 212*c*.

Operations of the drivers 203*c* to 212 are controlled by signals inputted to the CPU 201*c*.

Next, a function according to the illustrated embodiment will be explained.

[1] Brief Explanation of Function

Figure 7:
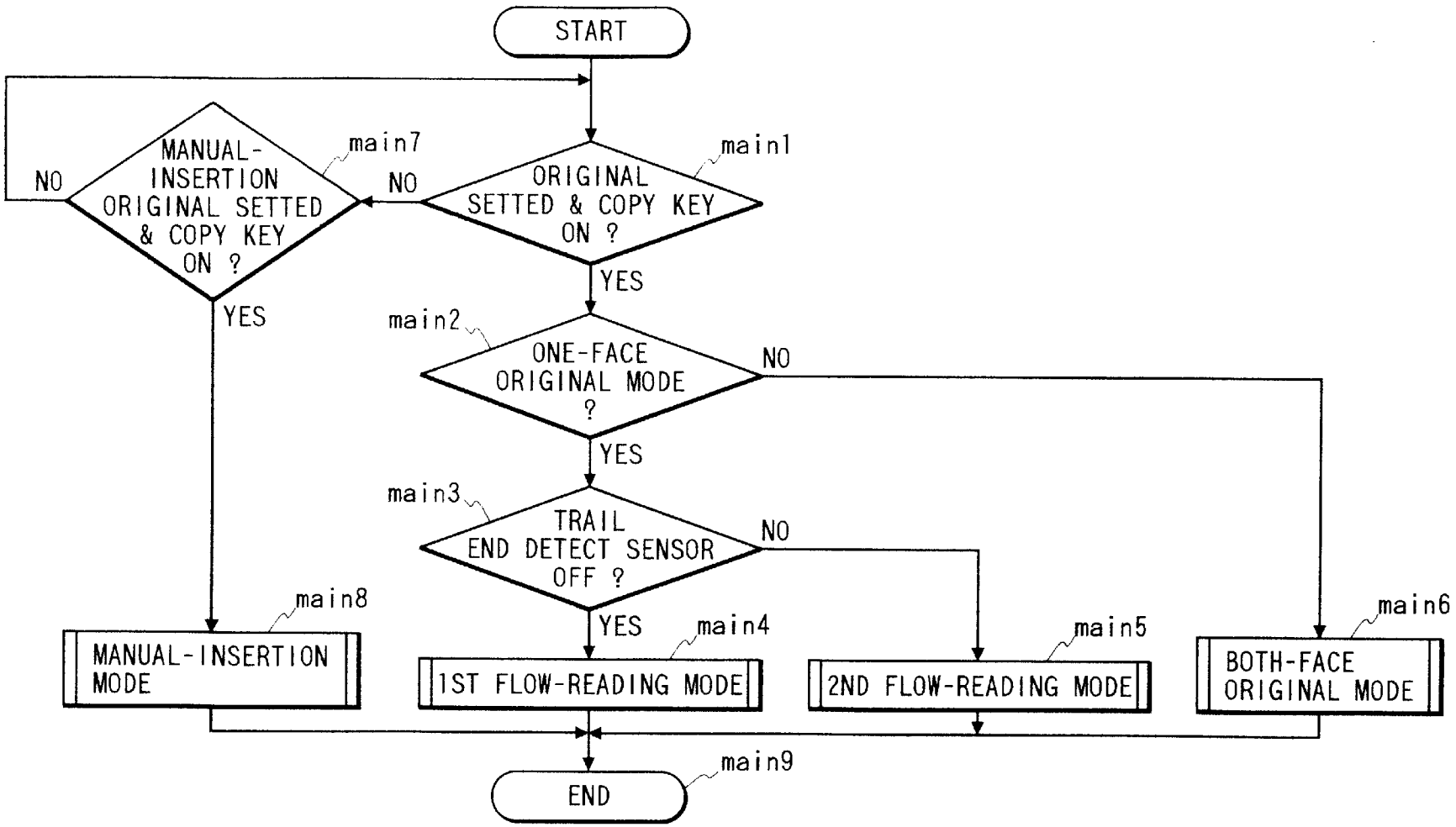
FIG. 7 is a flow chart schematically showing an operation of the image forming apparatus.

First of all, a function will be briefly described with reference to FIG. 7.

When the fact that the originals P are set on the original tray 4 is detected by the original set detect sensor 40 and a start key (copy key) on an operation portion of the main body 1 is depressed by the operator, the operation is started (main 1).

Then, the copy mode sent from the main body 1 is judged (main 2). If the mode is the one-face original mode, it is judged whether the original trail end detect sensor 41 is turned ON or not (main 3). This judgement can determine whether the original P is half size or large size. If the original is half size (Yes), a series of copying treatments is carried out with a first flow-reading mode (described later), and the operation is ended (main 4 and main 9). If the original is large size (No), a series of copying treatments is carried out with a second flow-reading mode (described later), and the operation is ended (main 5 and main 9).

On the other hand, at the time when the copy mode sent from the main body 1 is judged, if the mode is the both-face original mode (main 2), a series of copying treatments is carried out with the both-face original mode, and the operation is ended (main 6 and main 9).

When the original is set on the original tray 14 by the operator, a signal is outputted from the manual-insertion original detect sensor 370. In this condition, when the start key (copy key) on the operation portion of the main body 1 is depressed by the operator, a series of copying treatments is carried out with a manual-insertion mode (described later), and the operation is ended (main 7, main 8 and main 9).

[2] One-face Original Convey Mode

First of all, regarding the one-face original convey mode, a half size one-face original convey mode and a large size one-face original convey mode will be described, respectively.

[2-1] Half Size One-face Original Convey Mode

Figure 8:
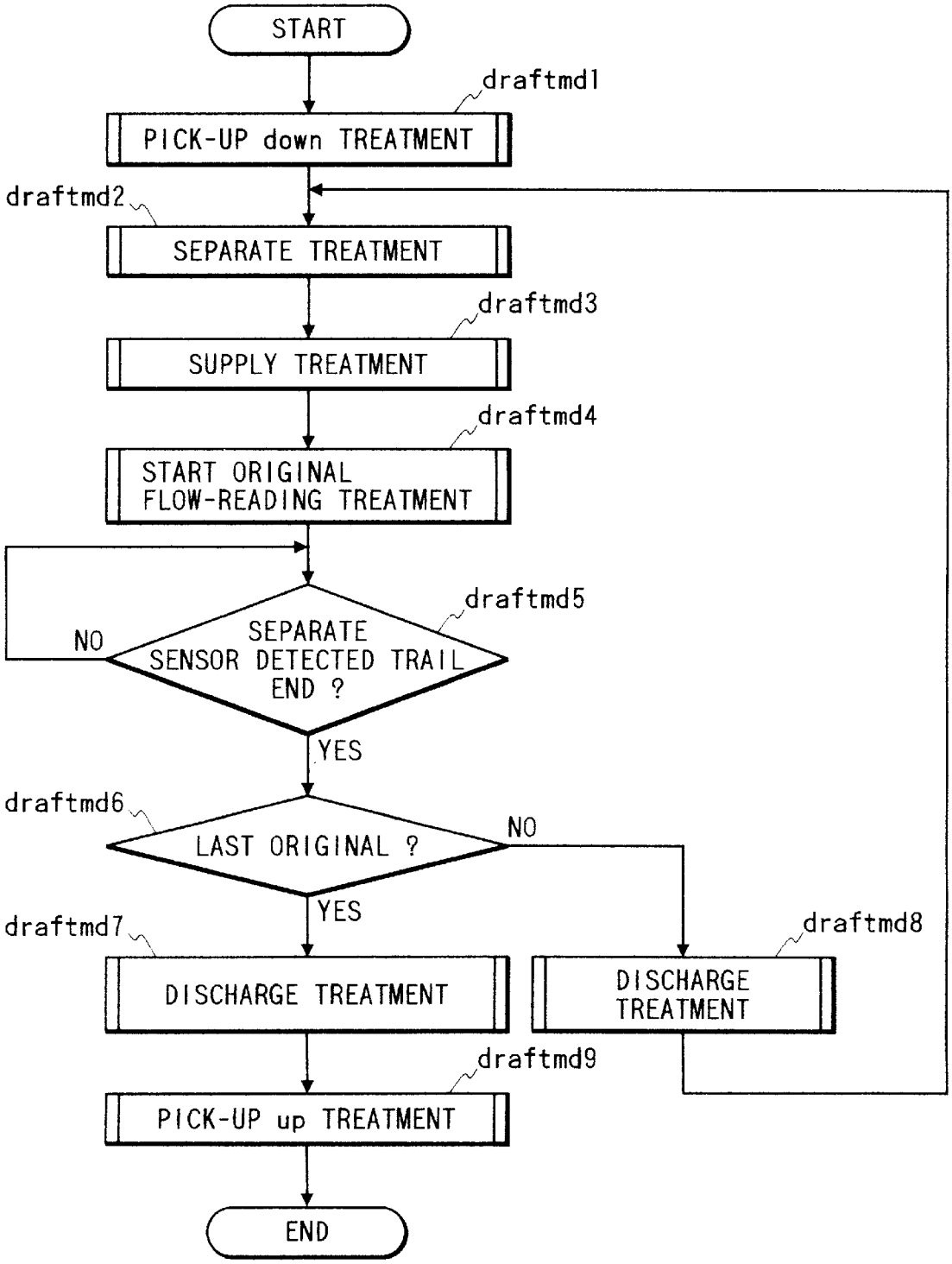
FIG. 8 is a flow chart briefly showing an operation for conveying a one-face original of half size.

First of all, the operation of the half size one-face original convey mode will be explained with reference to a flow chart showing such an operation in FIG. 8.

When the original of half size is conveyed, pick-up DOWN treatment (fully described later) is firstly effected, so that the sheet supply roller 5 is lowered to contact with the original stack P1 (draftmd 1). Thereafter, separation treatment (fully described later) is effected, so that only the uppermost original P1 is separated from the original stack (draftmd 2), and then sheet supply treatment is carried out (draftmd 3).

When the original is conveyed to the predetermined position on the platen 3, original flow-reading treatment (first flow-reading mode) is carried out, so that the image on the original is read in a condition that the scanner 204 of the main body 1 is fixed (draftmd 4). Thereafter, if the trail end of the original is detected by the separate sensor 30 (draftmd 5), the original set detect sensor 40 judges whether the original being conveyed is a last original or not (draftmd 6).

If not the last original, discharge treatment (fully described later) for discharging the original onto the discharge tray 10 is effected (draftmd 8). And, the above-mentioned treatments (draftmd 2 to draftmd 6) are repeated.

On the other hand, if the original being conveyed is the last original, the discharge treatment is effected (draftmd 7), and pick-up UP treatment (fully described later) is effected so that the sheet supply roller 5 is returned to the upper limit position (draftmd 9), and the series of treatments are finished.

Next, the conveyance of the one-face original of half size will be fully explained with reference to FIGS. 9A to 9F and FIGS. 10A and 10B. FIGS. 9A to 9F schematically show flows of the original when the original of half size is conveyed, and FIGS. 10A and 10B are flow charts showing the conveyance of the original of half size.

Normally, as shown in FIG. 3A, since the sheet supply roller 5 is positioned at the upper position (home position) above the separation guide plate 52, the operator can set the original stack without interference with the sheet supply roller 5. In the following explanation, it is regarded that the originals (imaged surfaces thereof facing upwardly) stacked on the original tray 4 are "original P1", "original P2", "original P3" from the above in order. When the particular original is not designated, the original is denoted by "P".

When the operator inputs the copying condition to the operation portion of the main body 1 and depresses the start key (copy key), the size of the original is detected by the sheet width detect sensor 44 on the platen 3. The path switch solenoid 107 is turned OFF to maintain the reverse supply flapper 22 in the position shown by the solid line in FIG. 2, thereby closing the original convey path (c) and opening the reverse supply path (h). In this mode, the path switch solenoid 107 is ON-controlled (ent 1) to shift the reverse supply flapper 22 to the position shown by the two dot and chain line in FIG. 2, thereby closing the reverse supply path (f) and opening the original convey path (c).

Then, the separate motor 100, convey motor 101 and belt motor 102 are driven (ent 2) to rotate the sheet supply roller 5, separation belt 6, separation convey roller 8, first supply roller 16, second supply roller 9 and wide belt 7. Separate treatment (fully described later) is effected by the separation belt 6 and the separation convey roller 8 to convey the uppermost original P1 through the original convey path (a), and the original P1 is conveyed through the original convey paths (b), (c) by the first and second supply rollers 16, 9 (see FIG. 9A). The first supply roller 16, second supply roller 9 and wide belt 7 are controlled so that convey speeds thereof are equal to each other.

Before the original P1 passed through the separation portion S is conveyed by the first supply roller 16, the skew-feed of the original is detected by the separate sensor 30 and the skew-feed sensor 31.

When the sheet supply roller 5 is not required to convey the original after the first supply roller 16 starts to convey the original, the lift/lower arm 51 is lifted to lift the sheet supply roller 5 together with the rock arm 53, thereby separating the sheet supply roller from the original stack. When the originals are conveyed continuously, the sheet supply roller 5 is not lifted up to the home position in FIG. 3A but is lifted to a position (waiting position shown in FIG. 11A) spaced apart from the uppermost original P1 in the original stack by a distance of 3 to 5 mm. The gap (FIG. 11B) between the shaft 51*c* and the through hole 53*a* is selected so that, in the waiting position (intermediate stop position), the sheet supply roller 5 is spaced apart from the original stack by a small distance. This position is controlled by a signal from the rock position sensor 46. Thus, the shifting amount of the sheet supply roller 5 is suppressed to the minimum, with the result that the vibration generated when the sheet supply roller 5 is contacted with the original stack is reduced, thereby improving the sheet supplying ability and shortening the time for starting the next original supply.

That is to say, although the rock arm 53 is lifted via the shaft 51*c* by lifting the lift/lower arm 51, in this case, only the lift/lower arm 51 is lifted by a distance corresponding to the above-mentioned gap to restore the relative position between the lift/lower arm and the rock arm 53, thereby turning the sensor 46 OFF. From this OFF condition, when the lift/lower arm 51 is further lifted by a small distance, the rock arm 53 is also lifted integrally, thereby separating the sheet supply roller 5 from the original stack P. When the motor 103 is turned OFF at this timing, the sheet supply roller is stopped as shown in FIG. 11A. Accordingly, only by lifting the lift/lower arm by the small distance regardless of the height of the original stack, the roller 5 is separated from the original stack. Thus, the separation (disengagement) of the roller 5 can be effected at a high speed.

When the sheet supply roller 5 is lifted as mentioned above, the separate clutch 106 is turned OFF to stop the separation belt 6 and the separation convey roller 8. Incidentally, the separation convey roller 8 is constituted by the one-way roller, this roller is rotatingly driven by the movement of the original P1 being conveyed.

At the same time when the separate motor 100 is driven, a size check counter is driven to count clock signals from a reverse clock (ent 3). On the other hand, the fact that the original P1 has been conveyed to the original convey path (c) is ascertained by detecting the tip end of the original by means of the regist sensor 39 (ent 4).

When the trail end of the original is detected by the separate sensor 30 (ent 5), a separate OFF counter is driven to count clock signals from a separate clock (ent 6). When the clock signals corresponding to the distance L3 between the first supply roller 16 and the separate sensor 30 are counted (ent 7), since the trail end of the original has left the first supply roller 16, the separate motor 100 is turned OFF, thereby stopping the first supply roller 16 (ent 8). In this case, the skew-feed is corrected, as will be described later.

When the trail end of the original is detected by the supply sensor 35 (ent 9), the size check counter is stopped (ent 10), and size check treatment (fully described later) is effected on the basis of the data from the size check counter (ent 11).

When the trail end of the original is detected by the supply sensor 35 (ent 9), a regist counter is driven to count clock signals from a belt energizing clock (ent 12). When the clock signals corresponding to the distance L4 between the supply sensor 35 and the second supply roller 9 are counted (ent 13), the convey motor 101 is turned OFF (ent 14), thereby stopping the second supply roller 9. Thus, the rotation of the second supply roller 9 is stopped at a time when the trail end of the preceding original P1 leaves the nip of the second supply roller 9.

When the trail end of the preceding original P1 leaves the nip of the sheet supply roller 5, the sheet supply roller 5 waiting at the waiting position shown in FIG. 11A is lowered again, thereby preparing for the sheet supplying operation for the succeeding original P2. When the trail end of the preceding original P1 leaves the nip of the first supply roller 16, the separate clutch 106 is turned ON, thereby starting the sheet supply of the succeeding original P2 by using the sheet supply roller 5 (refer to FIG. 9A).

As mentioned above, although the rotation of the second supply roller 9 is stopped when the trail end of the preceding original P1 leaves the nip of the second supply roller 9, since the sheet supply of the succeeding original P2 by using the sheet supply roller 5 is effected at a high speed, at a time when the rotation of the second supply roller 9 is stopped, the succeeding original P2 has been conveyed to a position where the tip end thereof reaches an upstream vicinity of the second supply roller 9 (position where the supply sensor 35 is positioned). And, when the tip end of the succeeding original P2 is detected by the supply sensor 35, control for correcting the skew-feed is effected, as is in the preceding original P1.

On the other hand, the preceding original P1 has already entered into the original convey path (d) on the platen 3 and is conveyed only by the wide belt 7. At the time when the count of the regist counter is finished (ent 15), the belt motor 102 is stopped (ent 16). As a result, the preceding original P1 is temporarily stopped at a position where the trail end thereof advances from the nip of the second supply roller 9 by a predetermined distance (refer to FIG. 9B). Namely, a distance between the trail end of the preceding original P1 and the nip of the second supply roller 9 is represented by the following equation:

$$L8=L2-L5-(\text{size of original})$$

where, L2 is a distance from the second image tip position R2 to the nip of the second supply roller 9 and L5 is a distance from the second image tip position R2 to the tip end of the preceding original P1.

However, in the condition that the preceding original P1 is temporarily stopped as mentioned above, since the trail end of the preceding original P1 leaves the nip of the second supply roller 9, a value of L8 becomes positive (plus).

Incidentally, at the same time when the driving of the belt motor 102 is stopped (ent 16), the path switch solenoid 107 is turned OFF (ent 17). When the original P1 is stopped temporarily in this way, the control circuit C outputs a convey completion signal to the main body 1, and, a convey start signal from the main body 1 is waited.

When the control for correcting the skew-feed of the succeeding original P2 is finished and the control circuit C receives the convey start signal from the main body 1, the control circuit C drives the wide belt 7 to convey the preceding original P1 at an image forming speed.

Meanwhile, the second supply roller 9 is maintained in the stopped condition and the succeeding original P2 is waiting. However, when a distance (referred to as "sheet interval") between the trail end of the preceding original P1 and the tip end of the succeeding original P2 becomes a predetermined value, the second supply roller 9 is driven to convey the succeeding original P2 at the same image forming speed as the preceding original P1. The driving and the conveying speed of the second supply roller 9 are controlled so that, when the sheet-to-sheet distance becomes L6, the conveying speed of the wide belt 7 becomes equal to the conveying speed of the second supply roller 9.

When the preceding original P1 reaches the second image tip position R2, the control circuit C outputs an image tip reach signal to the main body 1, with the result that the reading of the image on the preceding original P1 is started (first flow-reading mode).

In this mode, in the condition that the trail end of the original P1 is contacted with the second supply roller 9, the scanner 204 is fixed at a position where the scanner is not opposed to the original P1. That is to say, when it is assumed that a length of the original in the conveying direction is La mm and a distance between the second supply roller 9 and the scanner 204 (distance along the original convey paths (c)–(d)) is Lb mm, the scanner 204 is fixed at a position (for example, second image tip position R2 or third image tip position R3) where the following relation is satisfied:

$$La<Lb.$$

Figure 9A:
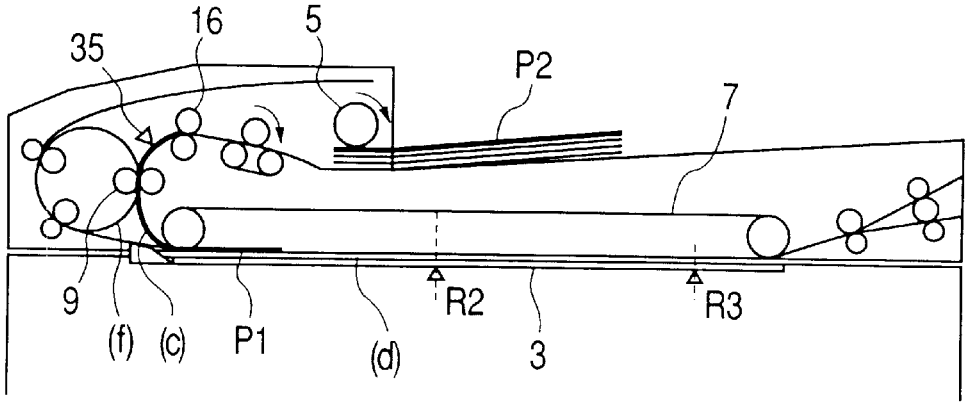
FIGS. 9A, 9B, 9C, 9D, 9E and 9F are schematic views each showing a flow of the original when the one-face original of half size is conveyed.
Figure 9B:
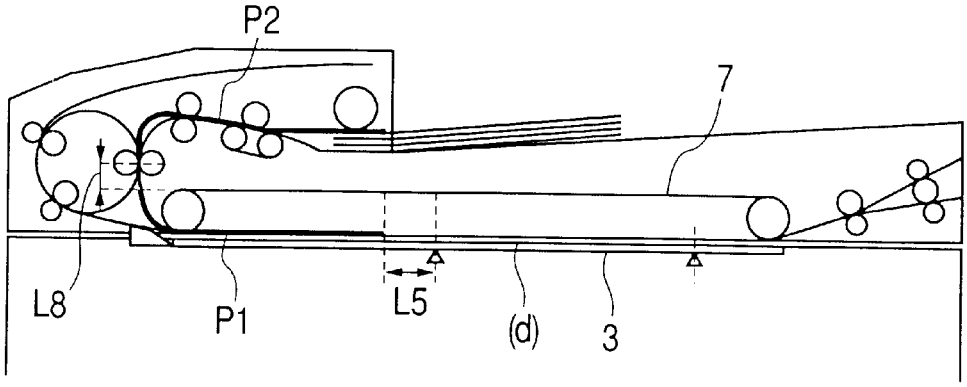
Figure 9C:
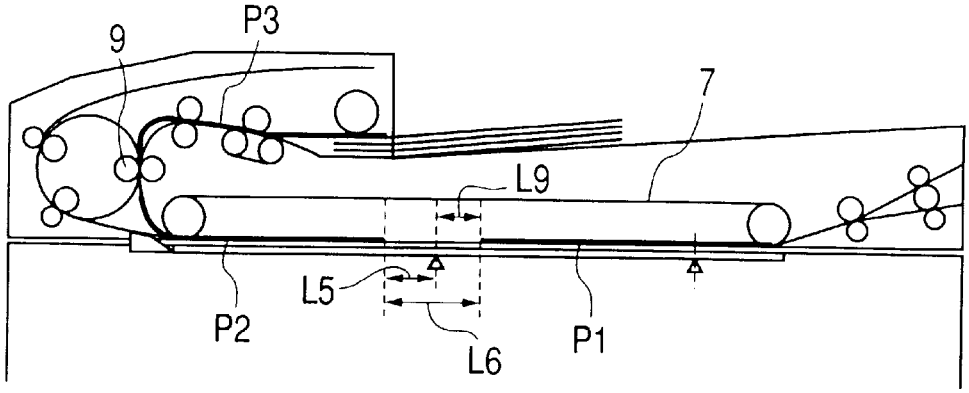
Figure 9D:
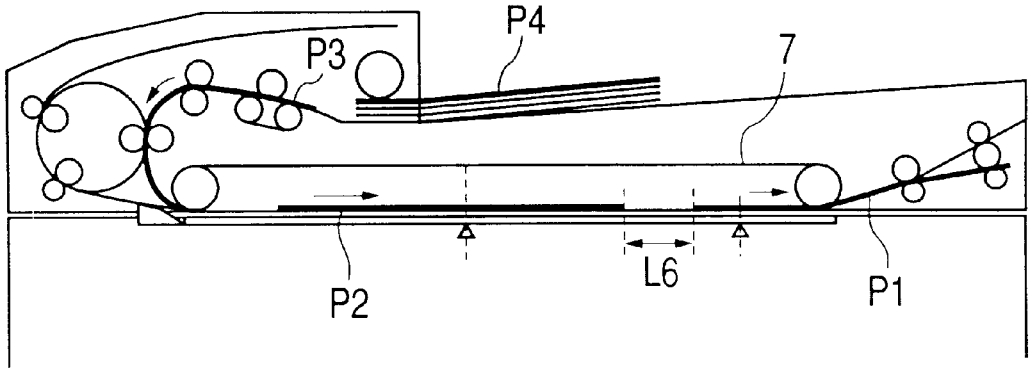
Figure 9E:
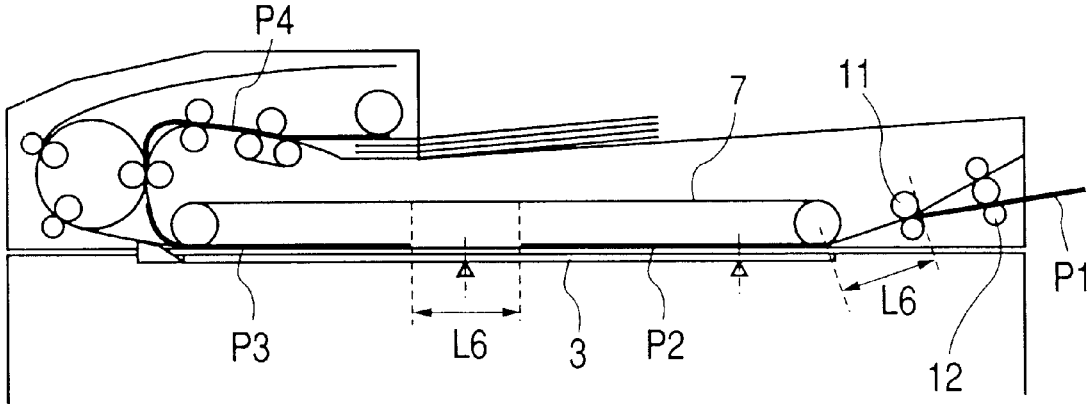
Figure 9F:
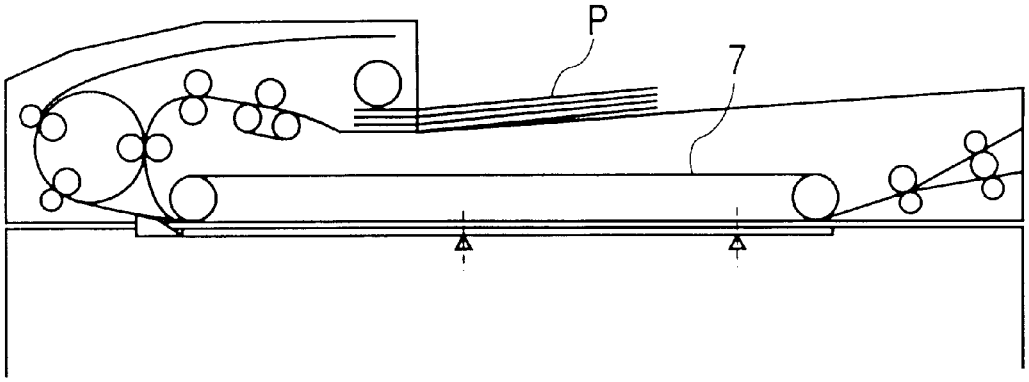
Figure 10A:
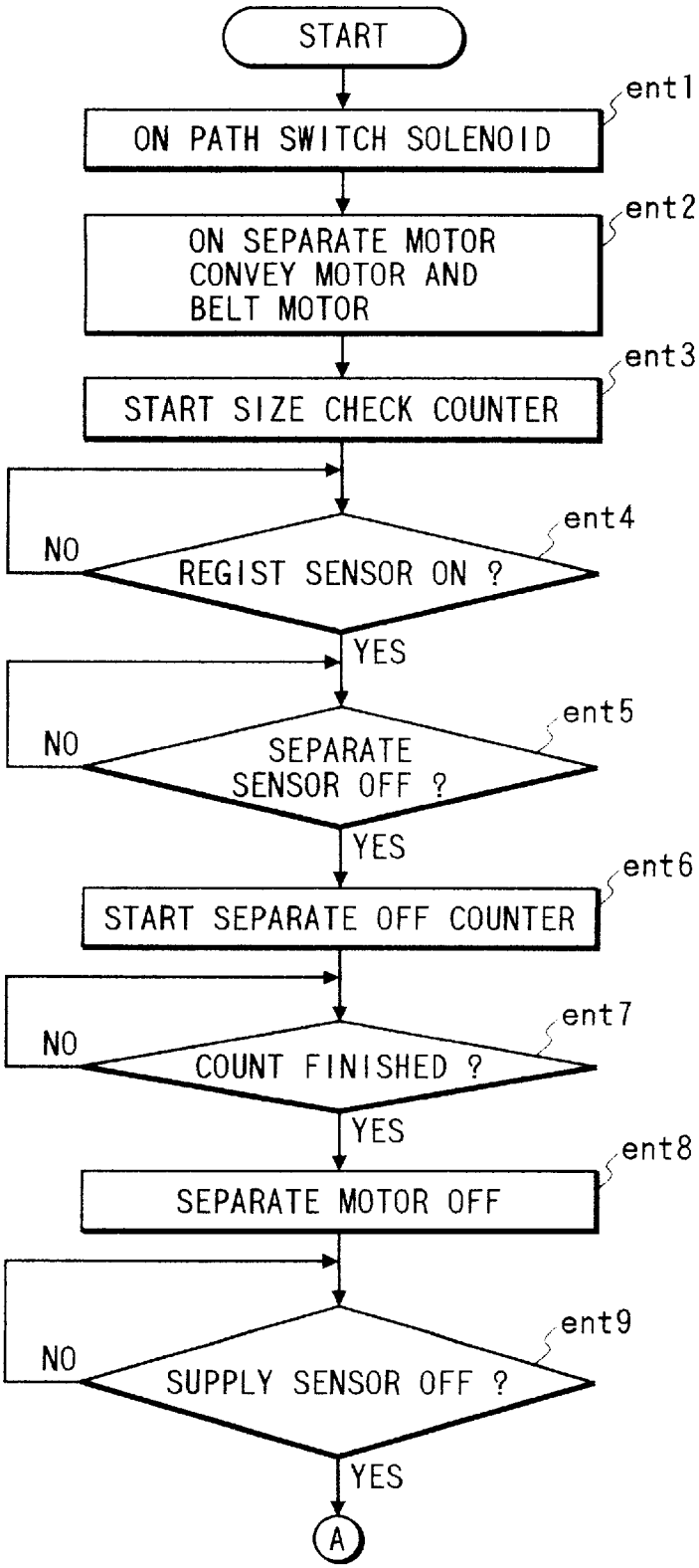
FIG. 10 comprised of FIGS. 10A and 10B is a flow chart showing the details of the operation for conveying the one-face original of half size.
Figure 10:
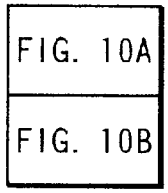
Figure 10B:
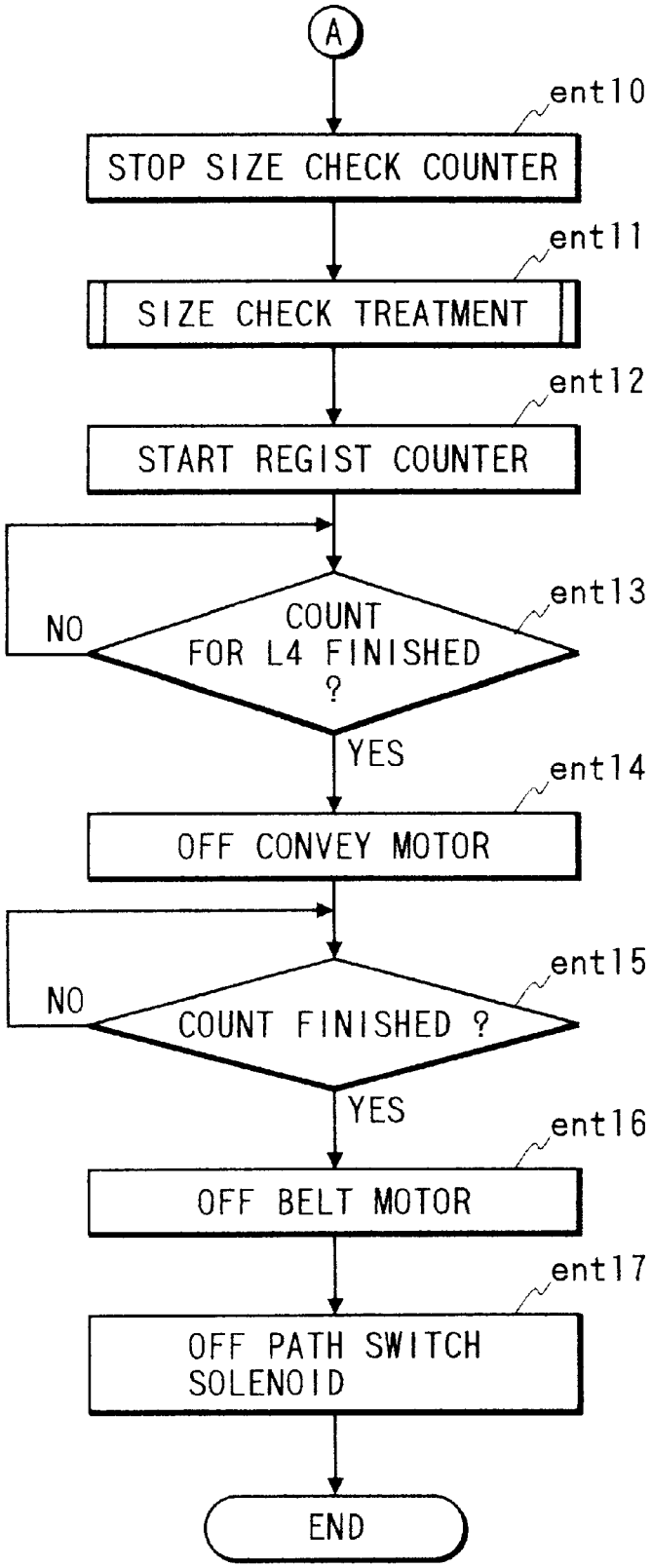

When the image reading is finished, the original P1 is stopped at a position where a distance between the trail end of the original and the second image tip position R2 becomes a predetermined distance L9 (refer to FIG. 9C). In this case, the succeeding original P2 is stopped at a position where a distance between the tip end of the original and the second image tip position R2 becomes a predetermined distance L5, and a further succeeding original P3 is waiting in a condition that a loop is formed in the original for correcting the skew-feed by the second supply roller 9 which is now stopped.

In this condition, when the convey start signal is inputted from the main body 1, the control circuit C drives the wide belt 7 (belt motor 102) to start the conveyance of the succeeding original P2 (refer to FIG. 9D), thereby reading the image on the original P2. Meanwhile, the discharge treatment (fully described later) for the preceding original P1 is effected, thereby discharging the original P1 onto the discharge tray 10.

Now, above-mentioned treatments will be fully explained.

<Pick-up DOWN Treatment>

Figure 12:
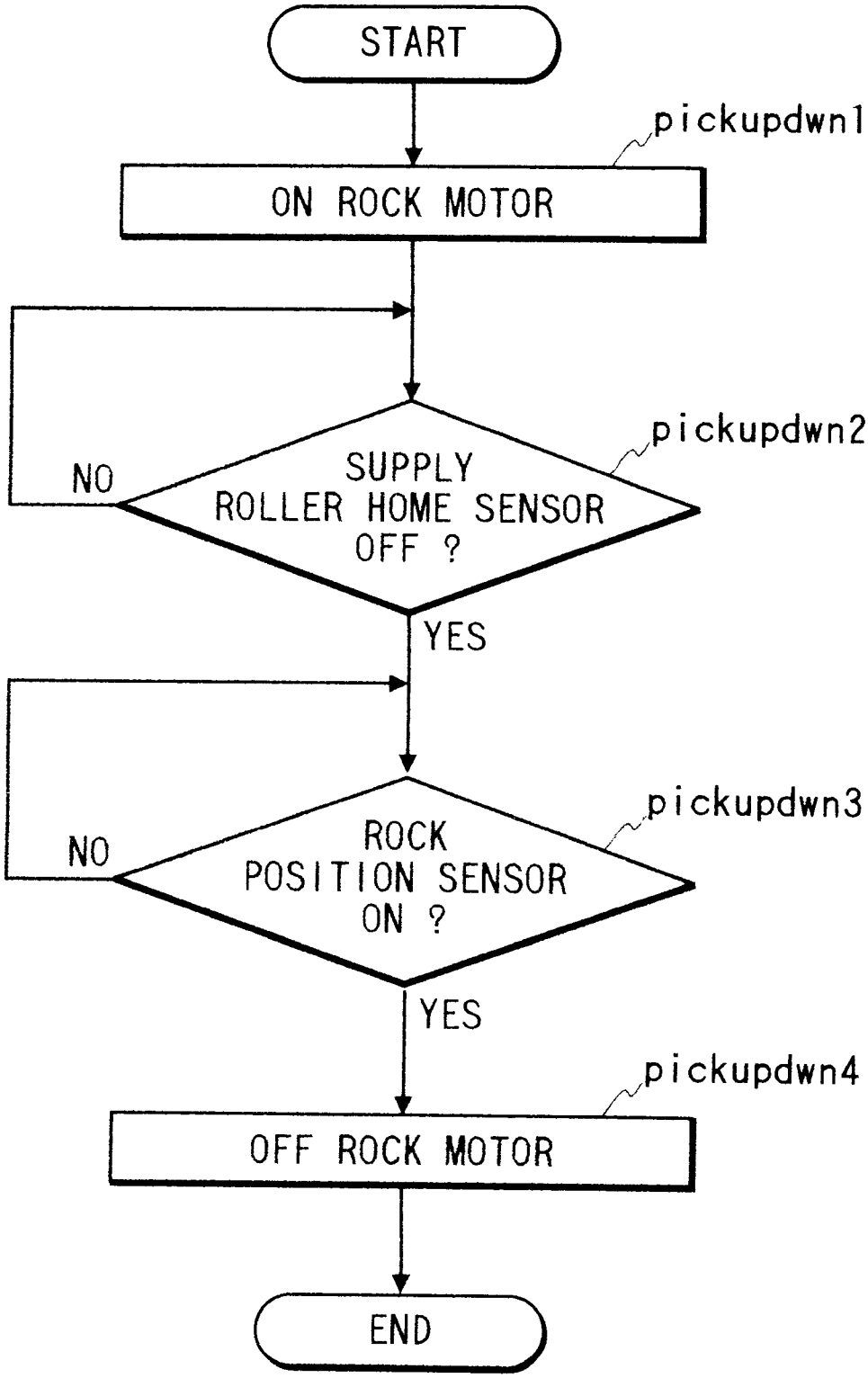
FIG. 12 is a flow chart for explaining pick-up DOWN treatment of the sheet supply roller.

The pick-up DOWN treatment will be described with reference to FIG. 12.

When the sheet supply roller 5 is situated at the home position (refer to FIG. 3A), the supply roller home sensor 45 is turned ON. In this condition, when the lift/lower arm 51 is lowered by driving the rock motor 103 (pickupdwn 1), the supply roller home sensor 45 is turned OFF (pickupdwn 2). When the lift/lower arm 51 is further lowered, the sheet supply roller 5 is contacted with the uppermost original P1, with the result that the rock position sensor 46 is blocked by the rock arm flag 54 to generate an ON signal (pickupdwn 3), and, on the basis of the ON signal, the driving of the rock motor 103 is stopped (pickupdwn 4). In this condition, the sheet supply roller 5 abuts against the original stack P1 by the weights of the sheet supply roller 5 itself and of the rock arm, thereby providing a stable supplying force for the original P1 (refer to FIG. 11B). In this condition, when the sheet supply roller 5 is rotated, the original P1 is supplied stably.

After the supply roller home sensor 45 is turned OFF (pickupdwn 2), when the lift/lower arm 51 is lowered, the engagement between the arm shaft 51*c* and the rock arm 53 is released, with the result that relative positional deviation between the rock arm 53 and the lift/lower arm 51 starts to be generated. However, the lift/lower arm 51 is stopped on the basis of the ON signal from the rock position sensor (contact detecting means) 46, an amount of deviation becomes constant regardless of the thickness of the original stack (refer to FIG. 11B).

<Separate Treatment and Skew-feed Correction>

Figure 13:
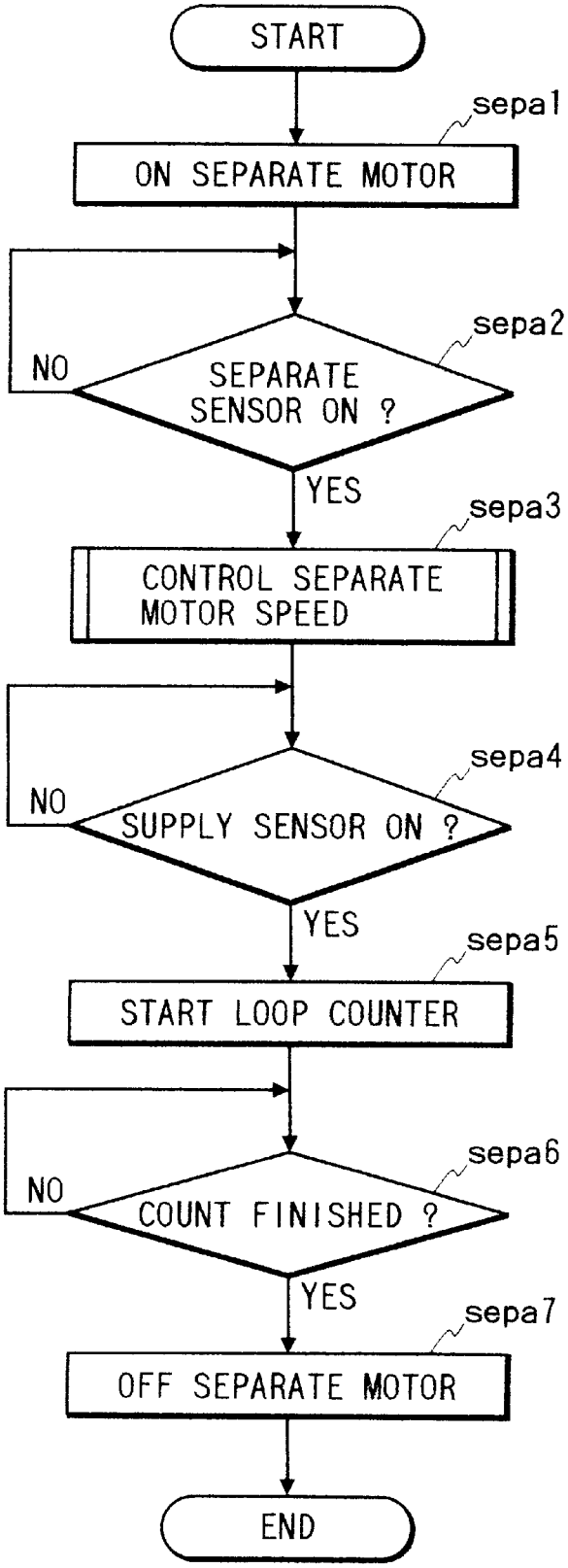
FIG. 13 is a flow chart for explaining separate treatment.

Now, the separate and the skew-feed correction will be described with reference to FIG. 13.

When the separate motor 100 is driven as mentioned above (sepa 1), the separation belt 6 and the separation convey roller 8 are rotated in directions shown by the arrows, with the result that the originals P sent from the original tray 4 are separated one by one, and the separated original is conveyed to the downstream original convey path (b). When the tip end of the original P1 reaches the predetermined position at the downstream side of the separation convey roller 8, the separate sensor 30 is turned ON (sepa 2), and, the speed of the separate motor 100 is controlled (sepa 3) on the basis of a remaining convey distance (to form a loop in the original after the tip end of the original abuts against the second supply roller 9) and a lapse time (until the separate sensor is turned ON) in such a manner that the separate treatment is finished within a predetermined time range.

When the tip end of the original P1 is detected by the supply sensor 35 disposed at the upstream side of and in the vicinity of the second supply roller 9 (sepa 4), a separate loop counter is driven to count clock signals from a separate clock (sepa 5), and, after the predetermined number of clock signals are counted, the driving of the separate motor 100 is stopped (sepa 6 and sepa 7). As a result, the tip end of the original P1 abuts against the nip of the second supply roller 9 which is now stopped, thereby forming a predetermined loop to correct the skew-feed in a conventional manner.

<Size Check Treatment>

Now, the size check treatment will be explained with reference to FIG. 14.

In the size check treatment, the distance between the nip of the second supply roller 9 and the supply sensor 35 is added to the data from the size check counter to determine the actual original size (length of the original in the conveying direction). In this case, the original is being conveyed by the second supply roller 9 and the wide belt 7, and, the convey amount of the original is surely equal to the count value of clock signals from the belt energizing clock. Thereafter, on the basis of the corrected size data, the size of the original (for example, A5, B5, A4, B5R, A4R, B4 or A3) is determined.

<Original Flow-reading Treatment>

Figure 15:
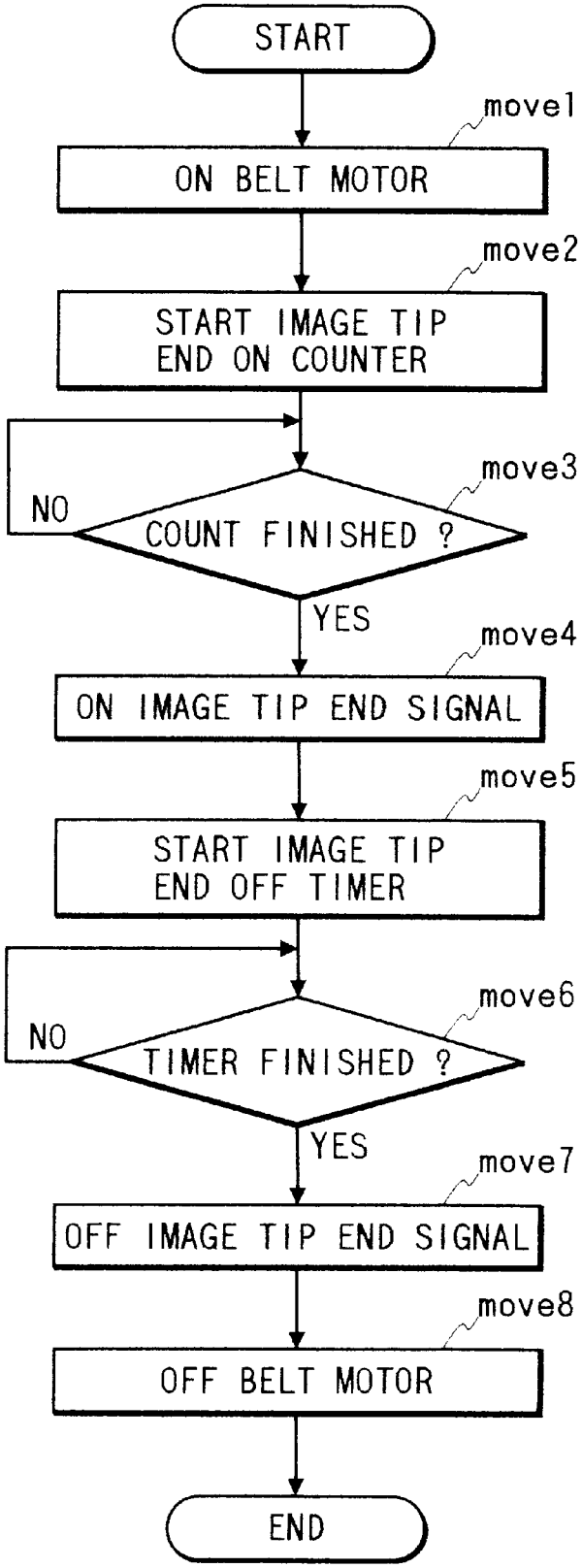
FIG. 15 is a flow chart for explaining original flow-reading treatment.

Now, the original flow-reading treatment will be described with reference to FIG. 15.

When the wide belt 7 is driven by driving the belt motor 102 (move 1), the original P1 is conveyed along the platen 3 as mentioned above. At the same time when the belt motor 102 is driven, an image tip ON counter is driven to count the clock signals from the belt energizing clock (move 2). The speed of the belt motor in this case is controlled with constant speed by outputting energizing clock signals on the basis of flow-reading speed data (V) received from the main body 1. At the time when the counting operation of the image tip ON counter is finished (move 3), the image tip signal is sent to the main body 1 (move 4).

After the image tip signal is received, the main body 1 calculates a time when the tip end of the original reaches the position where the optical system is fixed in the flow-reading mode, thereby effecting the actual image reading. More specifically, the scanner 204 is driven to read the image on the original by the scanner 204.

After a predetermined time is elapsed, the image tip signal is OFF (move 5, move 6 and move 7), thereby finishing the original image reading. When the trail end of the original passes through the reading position, the belt motor 102 is turned OFF (move 8).

The flow-reading speed data (V) may be equal to or different from a reading speed (V1) when the optical system is being shifted. In particular, when it is set to V>V1, since the original image reading is finished within a time shorter than the normal image reading effected while the optical system is being shifted, the copying speed is improved.

<Pick-up UP Treatment>

Figure 16:
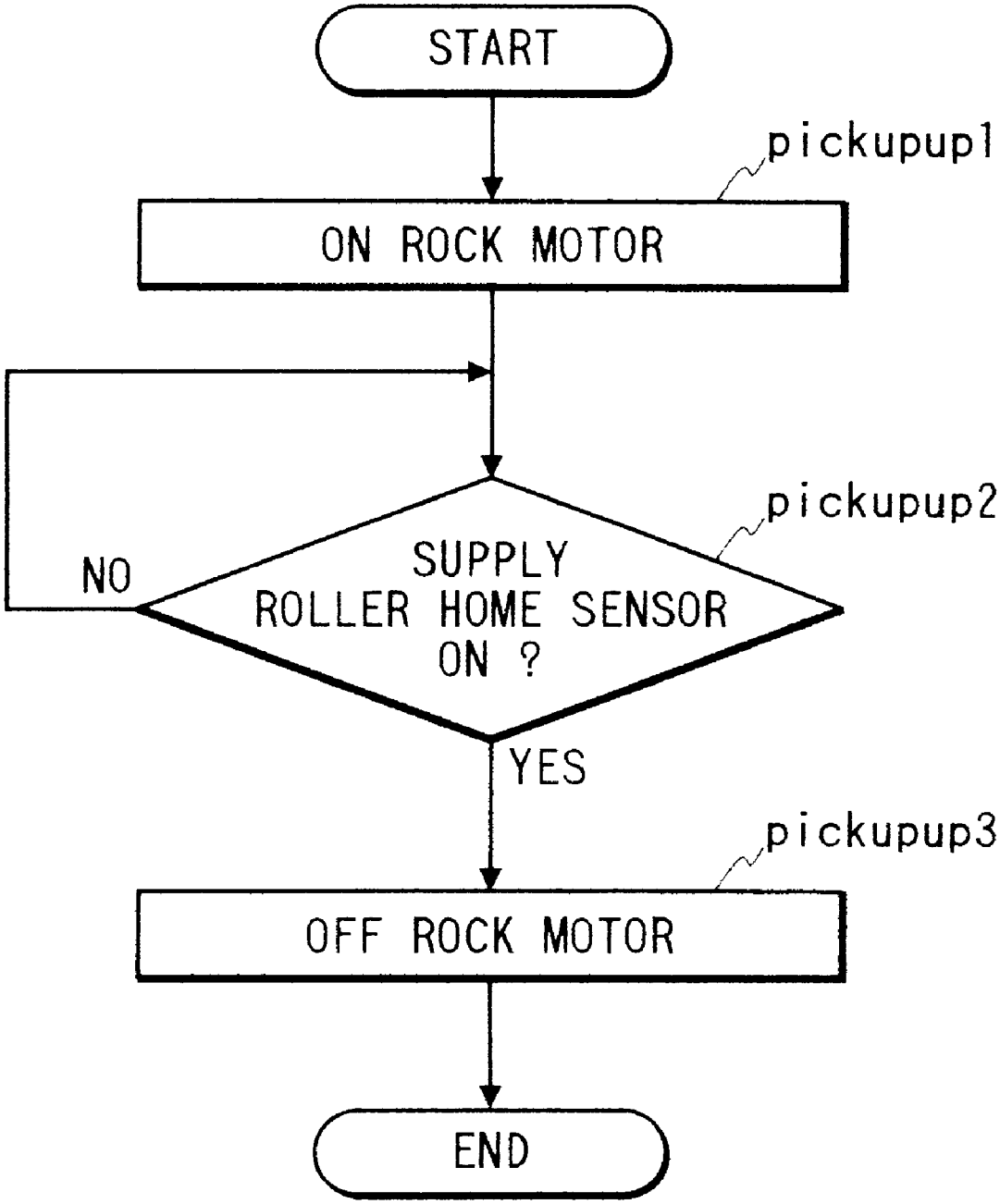
FIG. 16 is a flow chart for explaining pick-up UP treatment of the sheet supply roller.

Now, the pick-up UP treatment will be described with reference to FIG. 16.

When the rock motor 103 is rotated in a direction opposite to the direction regarding the pick-up DOWN treatment pickupup 1), the sheet supply roller 5 is lifted through the lift/lower arm 51 and the rock arm 53. When the supply roller home sensor 45 is turned ON, the rock motor 103 is stopped (pickupup 2 and pickupup 3), thereby maintaining the sheet supply roller 5 in the upper limit position.

<Discharge Treatment>

Figure 17:
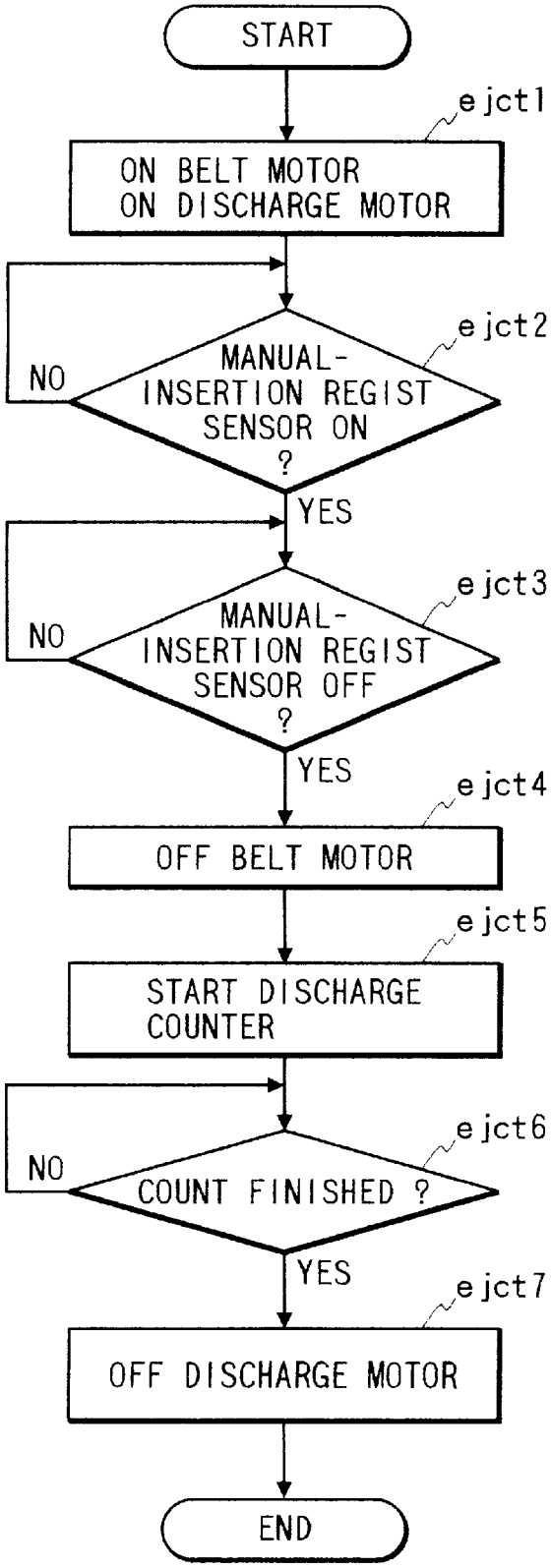
FIG. 17 is a flow chart for explaining sheet discharge treatment.

Now, the discharge treatment will be described with reference to FIG. 17.

When the belt motor 102 is driven as mentioned above, the wide belt 7 and the manual-insertion regist rollers 11 are rotatingly driven. In this case, the conveying speed of the manual-insertion regist rollers 11 is selected to be the same as the conveying speed of the wide belt 7. At the same time when the belt motor 102 is driven, the discharge motor 104 is driven (ejct 1) to rotate the discharge roller 12 and the manual-insertion discharge roller 13. In this case, the conveying speed of the discharge roller 12 is selected to be the same as or slightly greater than the conveying speed of the wide belt 7.

On the other hand, the discharge flapper solenoid 109 is in an OFF condition so that the free end of the discharge flapper 26 is positioned (as shown by the two dot and chain line in FIG. 2) is situated below the platen 3. Accordingly, the original P1 on the platen 3 is conveyed through the original convey path (d)–the original discharge path (j) by the wide belt 7, manual-insertion regist rollers 11 and discharge roller 12, thereby discharging the original onto the discharge tray 10.

When it is ascertained that the original P1 is being conveyed through the original discharge path (j) (ejct 2) by detecting the tip end of the discharged original P1 by means of the manual-insertion regist sensor 34, and when it is ascertained that the fact that the trail end of the preceding original P1 has left the nip of the manual-insertion regist rollers 11 by detecting the trail end of the original P1 by means of the sensor 34 (ejct 3), the belt motor 102 is stopped (ejct 4). As a result, the wide belt 7 and the manual-insertion regist rollers 11 are stopped, and the original P1 is conveyed only by the discharge roller 12. Incidentally, at this point, the image on the succeeding original P2 has already been read, and the original P2 is stopped on the platen 3 together with the further succeeding original P3 (refer to FIG. 9E).

At the same time when the belt motor 102 is stopped, a discharge counter is driven to count clock signals from a discharge clock (ejct 5). After a predetermined number of clock signals are counted (ejct 6), the discharge motor 104 is stopped (ejct 7). As a result, the discharge roller 12 and manual-insertion regist rollers 11 are stopped, and, at this point, the original P1 has already been discharged on the discharge tray 10 through the discharge roller 12 in the original discharge path (j).

[2-2] Large Size One-face Original convey Mode

Now, the conveyance of the originals in the large size one-face original convey mode will be explained briefly with reference to FIG. 18.

Figure 18:
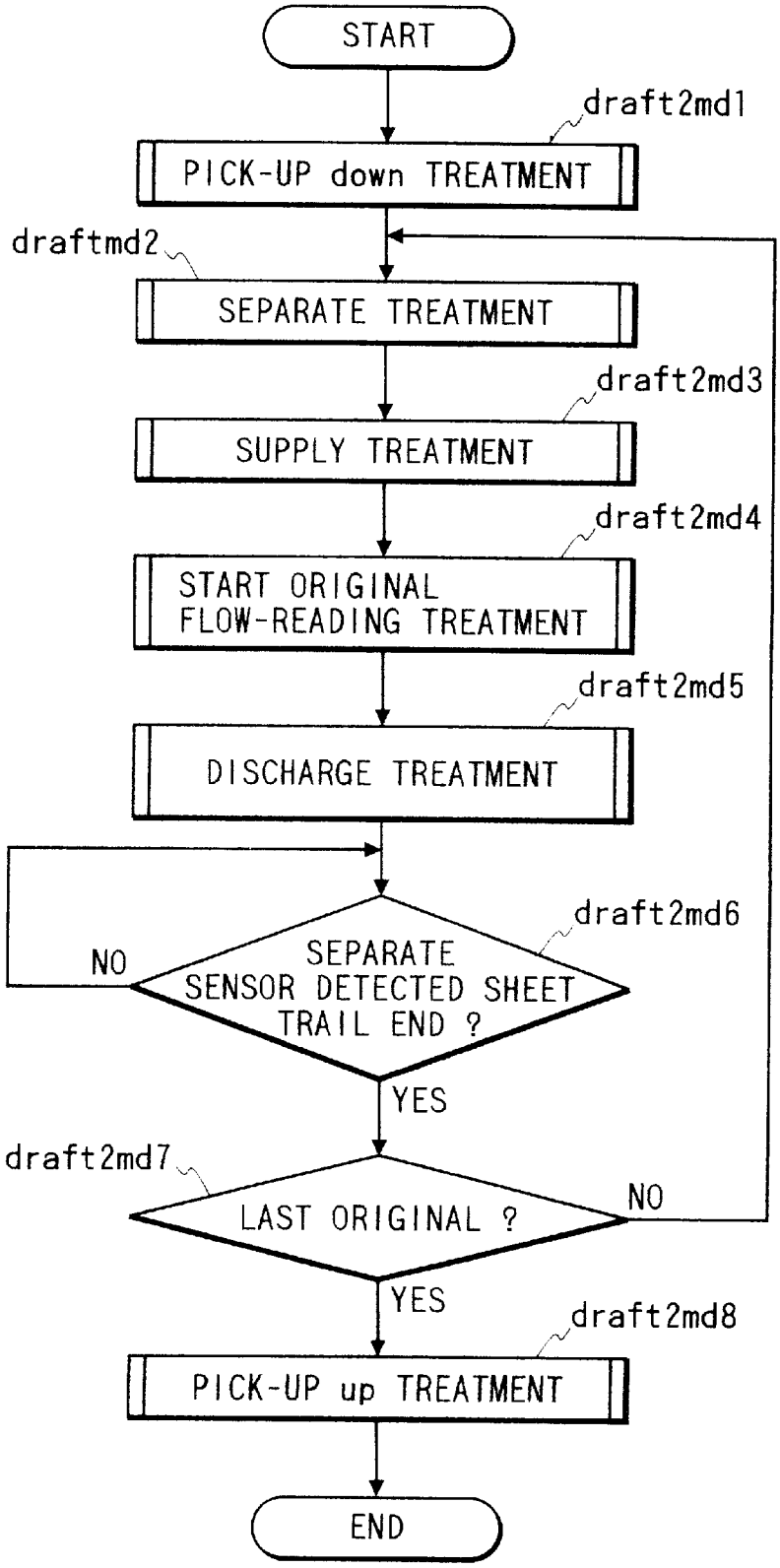
FIG. 18 is a flow chart briefly showing an operation for conveying a one-face original of large size.

FIG. 18 is a flow chart schematically showing the large size on-face original convey mode.

When the one-face originals of large sizes are conveyed, the pick-up DOWN treatment is firstly effected to lower the sheet supply roller 5, thereby contacting the sheet supply roller with the original stack P1 (draft2md 1). Thereafter, the separate treatment is effected (draft2md 2) to separate only the uppermost original P1 from the original stack, and then the supply treatment is effected (draft2md 3). The operations up to this point are the same as those in the half size one-face original convey mode.

When the original P1 is conveyed to the predetermined position on the platen 3, the original flow-reading treatment (second flow-reading mode) is carried out, so that the image on the original is read while fixing the scanner 204 of the main body 1 at the predetermined position (draft2md 4). In this mode, since the scanner 204 is fixed at the third image tip position R3 near the discharge tray 10, the original flow-reading treatment and the discharge treatment are effected continuously (draft2md 5), thereby discharging the original P1 (the image on which was read) onto the discharge tray 10.

Thereafter, when the trail end of the original is detected by the separate sensor 30 (draft2md 6), it is judged, by the original set detect sensor 40, whether the original being conveyed is the last original or not (draft2md 7). If not the last original, the above-mentioned operations are repeated (draft2md 2 to draft2md 7). On the other hand, if the last original, the pick-up UP treatment is effected (draft2md 8) to return the sheet supply roller 5 to the upper limit position, and the large size one-face original convey mode is ended.

Next, the conveyance of the originals in the large size one-face original convey mode will be fully explained with reference to FIGS. 19A to 19D, each schematically shows a flow of the originals when the originals of large size are conveyed.

The operations between the pick-up DOWN treatment and the supply treatment (draft2md 1 to draft2md 2) are the same as those in the half size one-face original convey mode.

That is to say, also in this mode, the path switch solenoid 107 is ON-controlled in the same manner as the half size one-face original convey mode, thereby closing the reverse supply path (f) and opening the original convey path (c). The wide belt 7 is driven when the preceding original P1 is conveyed, and the conveying speed of the wide belt becomes the same as that of the second supply roller 9 before the preceding original P1 enters onto the platen 3. Accordingly, the preceding original P1 is conveyed to the platen 3 through the original convey path (c) by the supply rollers 16, 9 and the wide belt 7 (refer to FIG. 19A).

Incidentally, the rotation of the second supply roller 9 is stopped when the trail end of the preceding original P1 leaves the second supply roller 9.

Although the sheet supply roller 5 is retarded to the waiting position after the preceding original P1 was supplied, when the trail end of the preceding original P1 passes through the nip of the sheet supply roller 5, the sheet supply roller is lowered again, thereby preparing for the supplying operation for the next original P2. When the trail end of the preceding original P1 leaves the nip of the first supply roller 16, the separate clutch 106 is turned ON, and the sheet supply roller 5 starts to supply the succeeding original P2 (refer to 19A).

As mentioned above, although the rotation of the second supply roller 9 is stopped when the trail end of the preceding original P1 leaves the nip of the second supply roller 9, since the supplying operation of the succeeding original P2 is effected at the high speed, at the time when the rotation of the second supply roller 9 is stopped, the succeeding original P2 has been conveyed to a position where the tip end thereof reaches an upstream vicinity of the second supply roller 9 (i.e., position where the supply sensor 35 is positioned). When the tip end of the succeeding original P2 is detected by the supply sensor 35, the control for correcting the skew-feed is performed, as is in the preceding original P1.

Figure 19A:
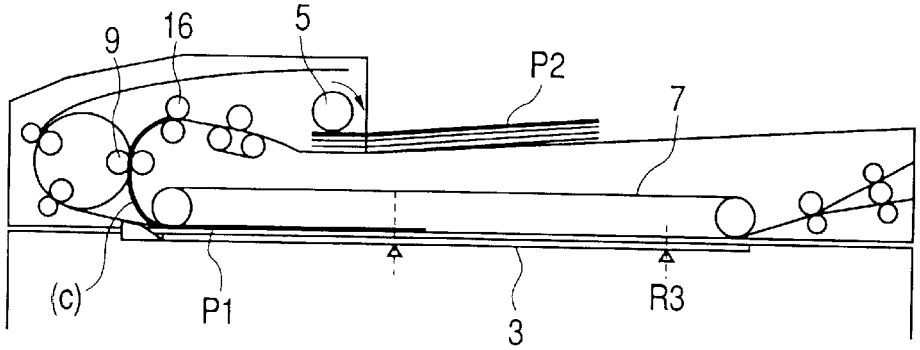
FIGS. 19A, 19B, 19C and 19D are schematic views each showing a flow of the original when the one-face original of large size is conveyed.
Figure 19B:
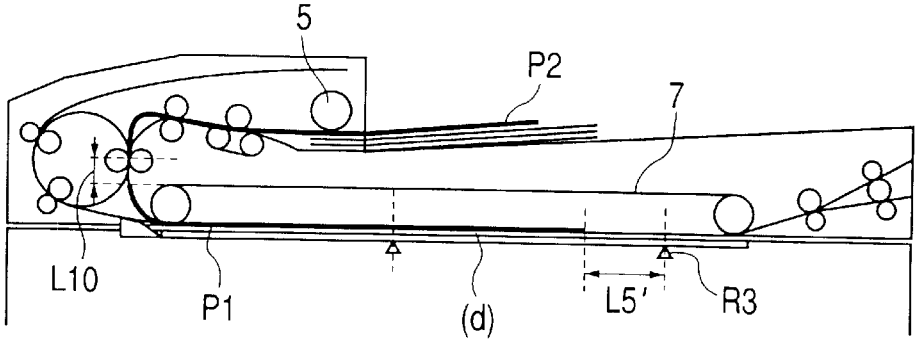
Figure 19C:
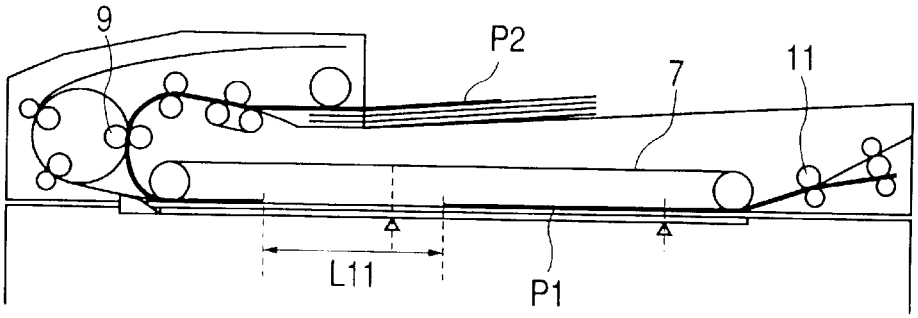

On the other hand, since the preceding original P1 has already been entered into the original convey path (d), the preceding original P1 is conveyed only by the wide belt 7, and, when the trail of the preceding original P1 advances from the nip of the second supply roller 9 by a predetermined distance, the preceding original is stopped temporarily (refer to FIG. 19B). That is to say, a distance L10 (FIG. 19B) between the trail end of the preceding original P1 and the nip of the second supply roller 9 is represented by the following equation:

$$L10=L3-L5'-(\text{size of original})$$

where, L3 is a distance from the third image tip position R3 to the nip of the second supply roller 9 and L5' is a distance from the third image tip position R3 to the tip end of the preceding original P1.

However, in the condition that the preceding original P1 is temporarily stopped as mentioned above, since the trail end of the preceding original P1 leaves the nip of the second supply roller 9, a value of L10 becomes positive (plus).

When the original P1 is temporarily stopped in this way, the control circuit C outputs a convey completion signal to the main body 1, and, a convey start signal from the main body 1 is waited.

When the control for correcting the skew-feed of the succeeding original P2 is finished and the control circuit C receives the convey start signal from the main body 1, the control circuit C drives the wide belt 7 to convey the preceding original P1 at an image forming speed.

Meanwhile, the second supply roller 9 is maintained in the stopped condition and the succeeding original P2 is waiting. However, when a distance (referred to as "sheet interval" hereinafter) between the trail end of the preceding original P1 and the tip end of the succeeding original P2 becomes a predetermined value, the second supply roller 9 is driven to convey the succeeding original P2 at the same image forming speed as the preceding original P1. The driving and the conveying speed of the second supply roller 9 are controlled so that, when the sheet-to-sheet distance becomes L11, the conveying speed of the wide belt 7 becomes equal to the conveying speed of the second supply roller 9 (refer to FIG. 19C).

When the preceding original P1 reaches the third image tip position R3, the control circuit C outputs an image tip reach signal to the main body 1, with the result that the reading of the image on the preceding original P1 is started.

Figure 19D:
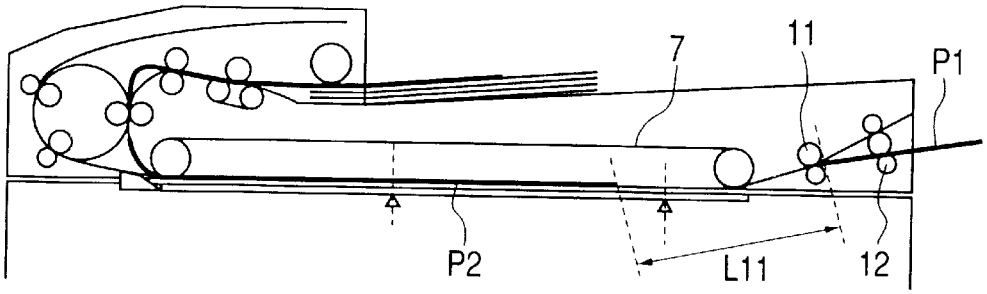

When the reading of the image on the preceding original P1 is finished, the wide belt 7 is driven for a predetermined time and then is stopped, and the succeeding original P2 is conveyed to a position shown in FIG. 19D and then is stopped there. Since the sheet interval is selected to be greater than a distance between the tip end of the succeeding original P2 and the nip of the manual-insertion regist rollers 11, at the time when the succeeding original P2 is stopped, the trail end of the preceding original P1 has left the nip of the manual-insertion regist rollers 11, and the original P1 is conveyed only by the discharge roller 12 to be discharged onto the discharge tray.

[3] Both-face Original Convey Mode

Next, regarding a both-face original convey mode, a half size both-face original convey mode and a large size both-face original convey mode will be described, respectively.

[3-1] Half Size Both-face Original Convey Mode

Figure 20:
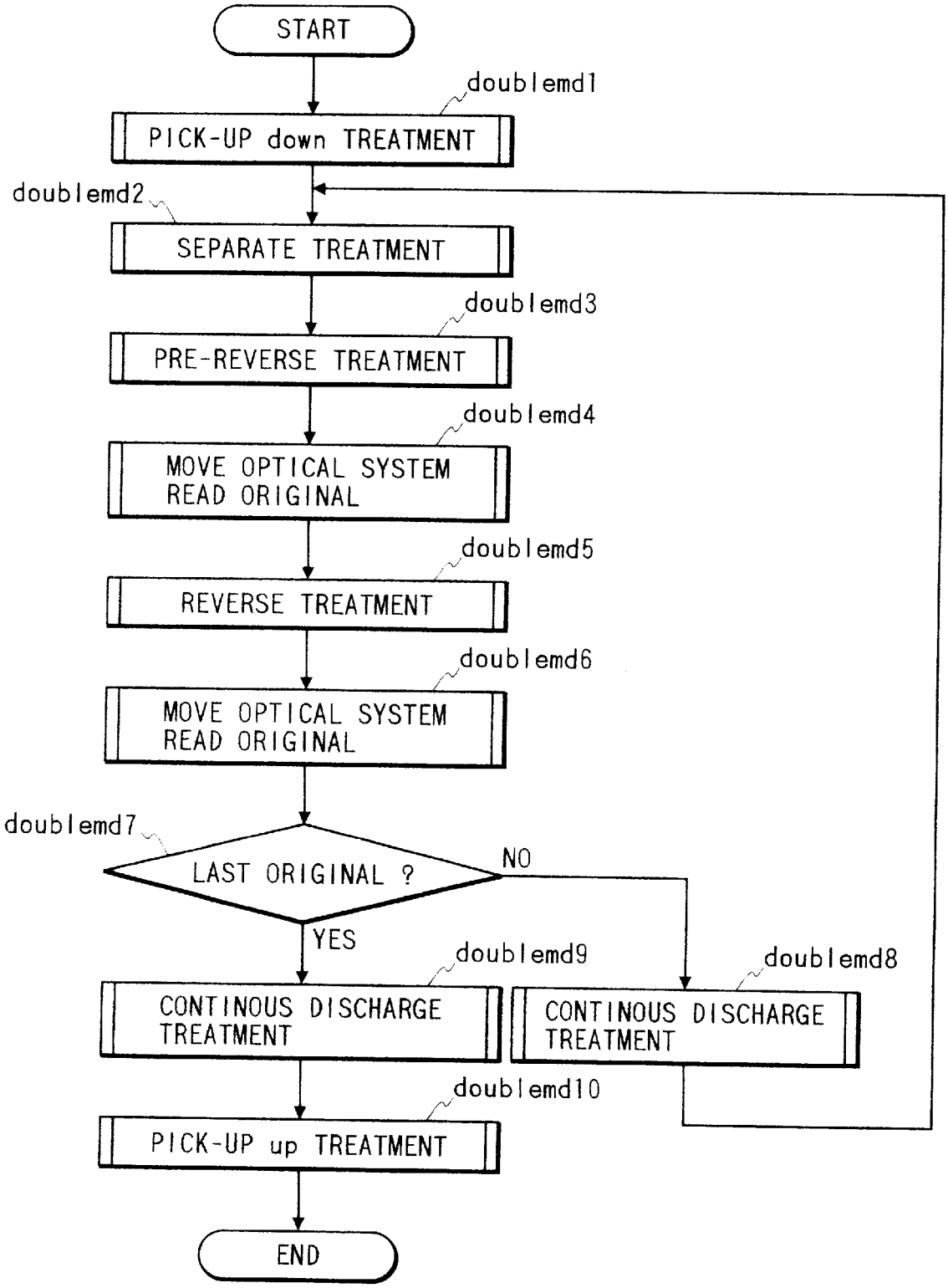
FIG. 20 is a flow chart briefly showing an operation for conveying a both-face original of half size.

First of all, the operation of the half size both-face original convey mode will be briefly explained with reference to FIG. 20.

When the both-face original of half size is conveyed, the pick-up DOWN treatment is effected, so that the sheet supply roller 5 is lowered to contact with the original stack P1 (doublemd 1). Thereafter, the separate treatment is effected, so that only the uppermost original P1 is separated from the original stack (doublemd 2). The operation up to this point is the same as the one-face original convey mode.

Then, pre-reverse treatment is effected to reverse the surface of the original P1 (doublemd 3), and the reversed original P1 is rested on the platen 3 with a second surface thereof facing downwardly. The optical system shifting image reading is carried out (doublemd 4), thereby reading the image on the second surface while shifting the optical system. When the image reading is finished, reverse treatment is effected by utilizing the reverse supply/discharge path (e), reverse supply path (g) and original convey path (c) (doublemd 5), and, thereafter, the image on the first surface is read (doublemd 6).

While such image reading is being effected, the original set detect sensor 40 judges whether the original is a last original or not (doublemd 7). If not the last original, the discharge treatment for discharging the original P1 onto the discharge tray 10 is effected (doublemd 8). And, the above-mentioned treatments (doublemd 2 to doublemd 7) are repeated. On the other hand, if the original is the last original, the discharge treatment is effected (doublemd 9), and the pick-up UP treatment is effected so that the sheet supply roller 5 is returned to the upper limit position (doublemd 10), and the series of treatments are finished.

Next, the conveyance of the both-face original of half size will be fully explained with reference to FIGS. 21A to 21H and FIGS. 22A and 22B.

Figure 21A:
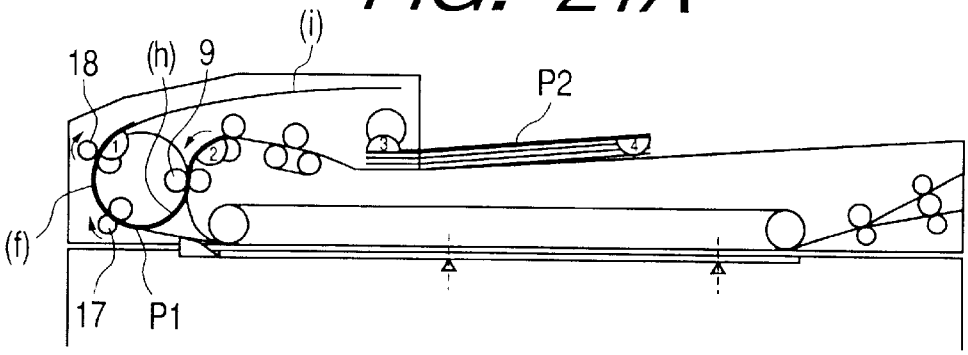
FIGS. 21A, 21B, 21C, 21D, 21E, 21F, 21G and 21H are schematic views each showing a flow of the original when the both-face original of half size is conveyed.
Figure 21B:
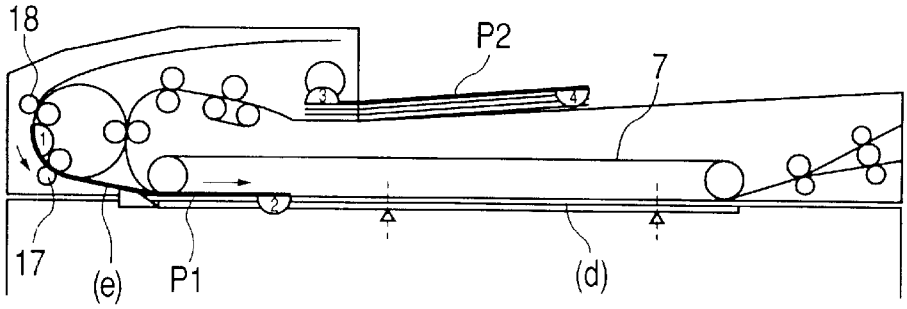
Figure 21C:
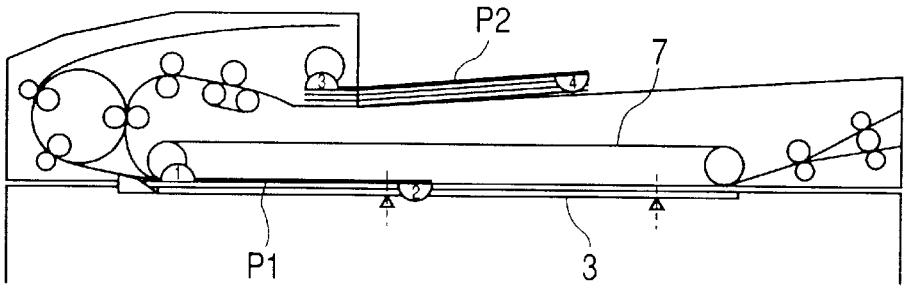
Figure 21D:
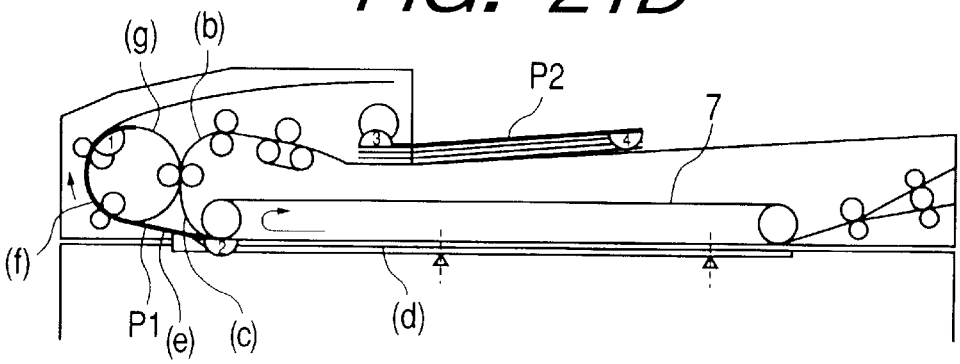
Figure 21E:
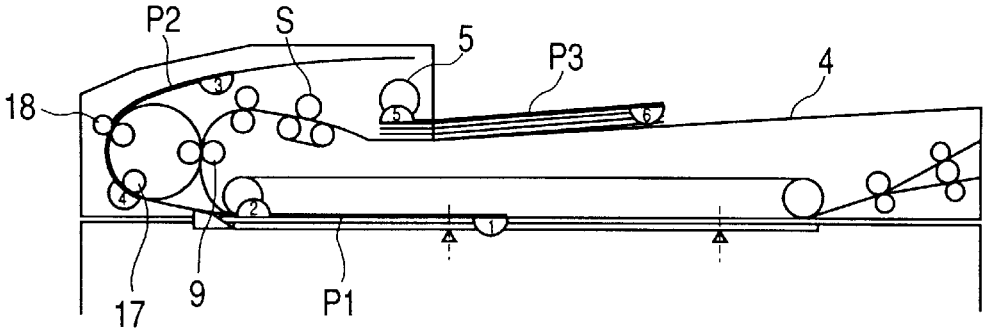
Figure 21F:
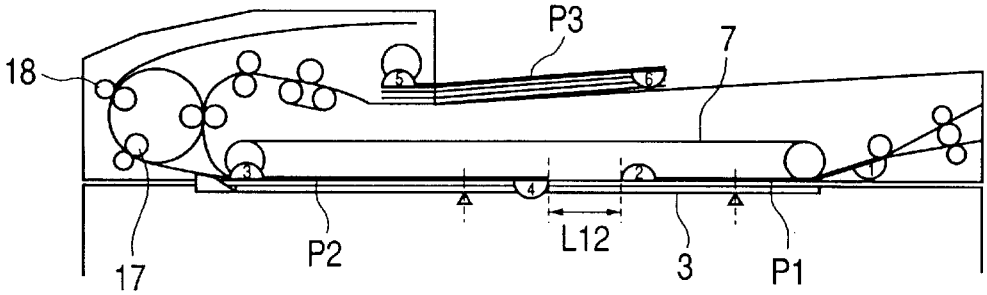
Figure 21G:
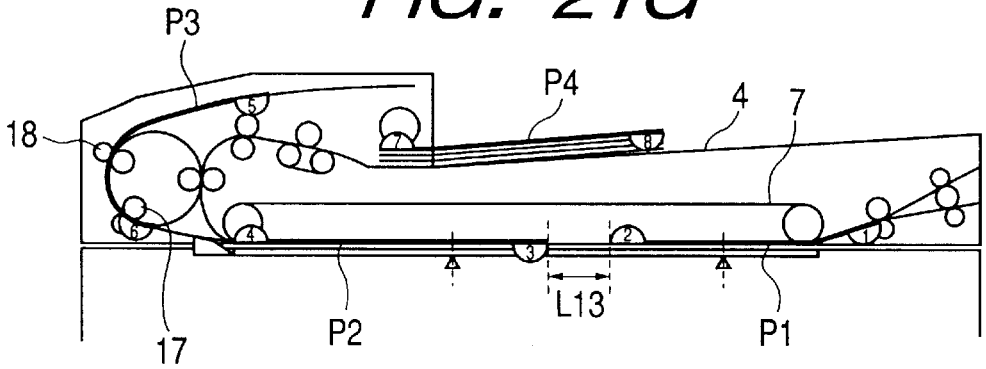
Figure 21H:
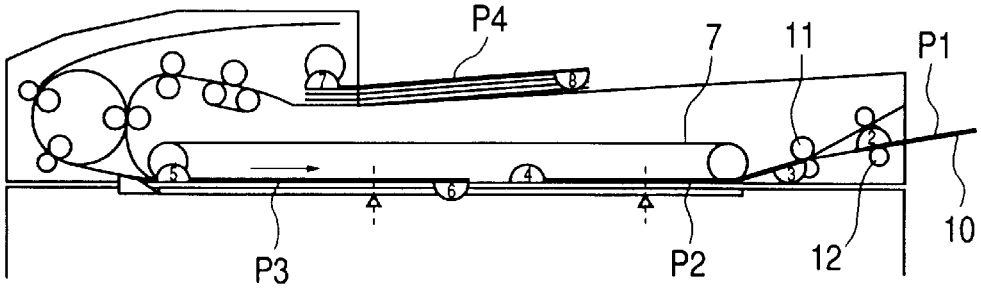
Figure 22A:
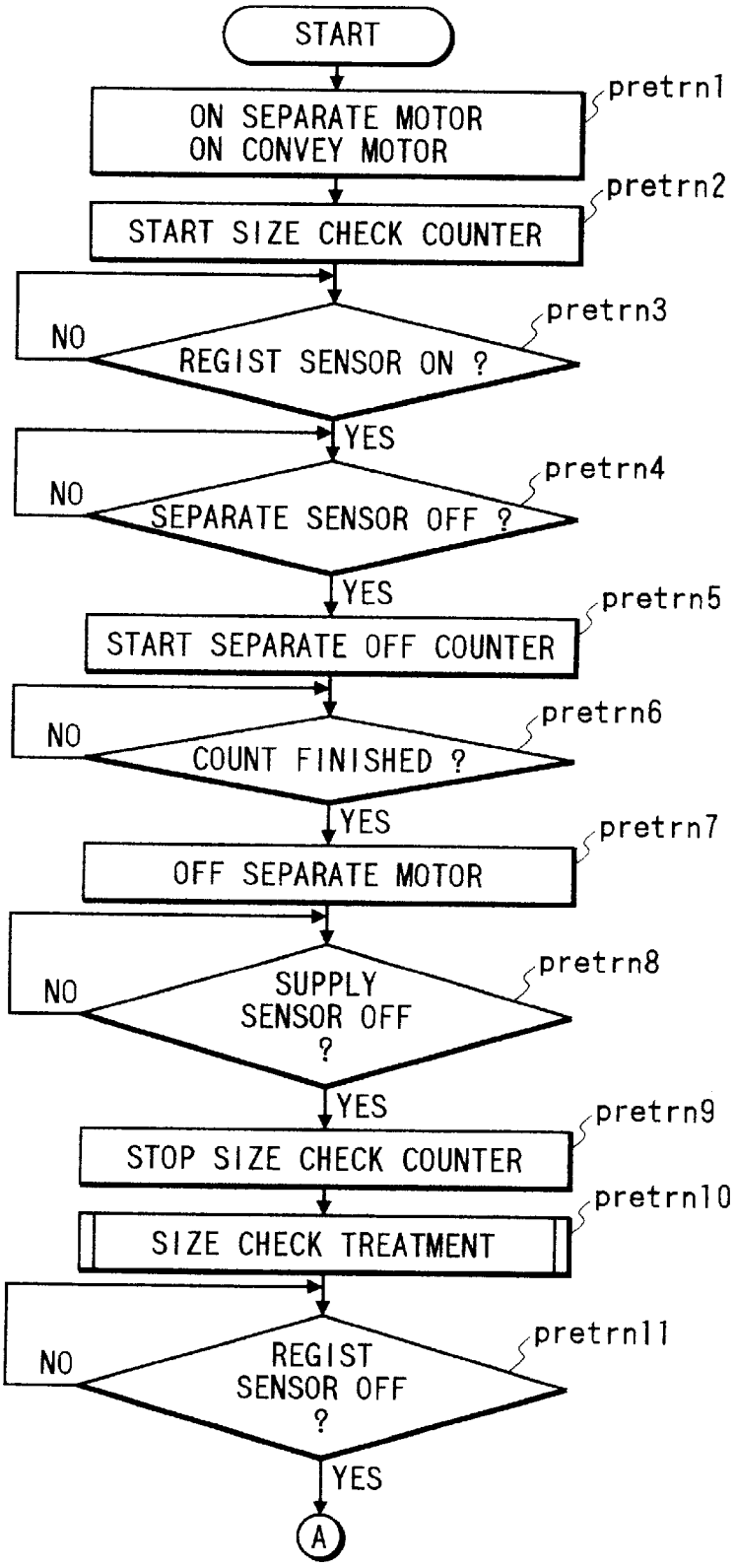
FIG. 22 comprised of FIGS. 22A and 22B is a flow chart showing the details of the operation for conveying the both-face original of half size.
Figure 22:
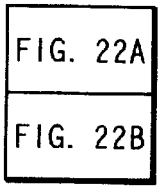
Figure 22B:
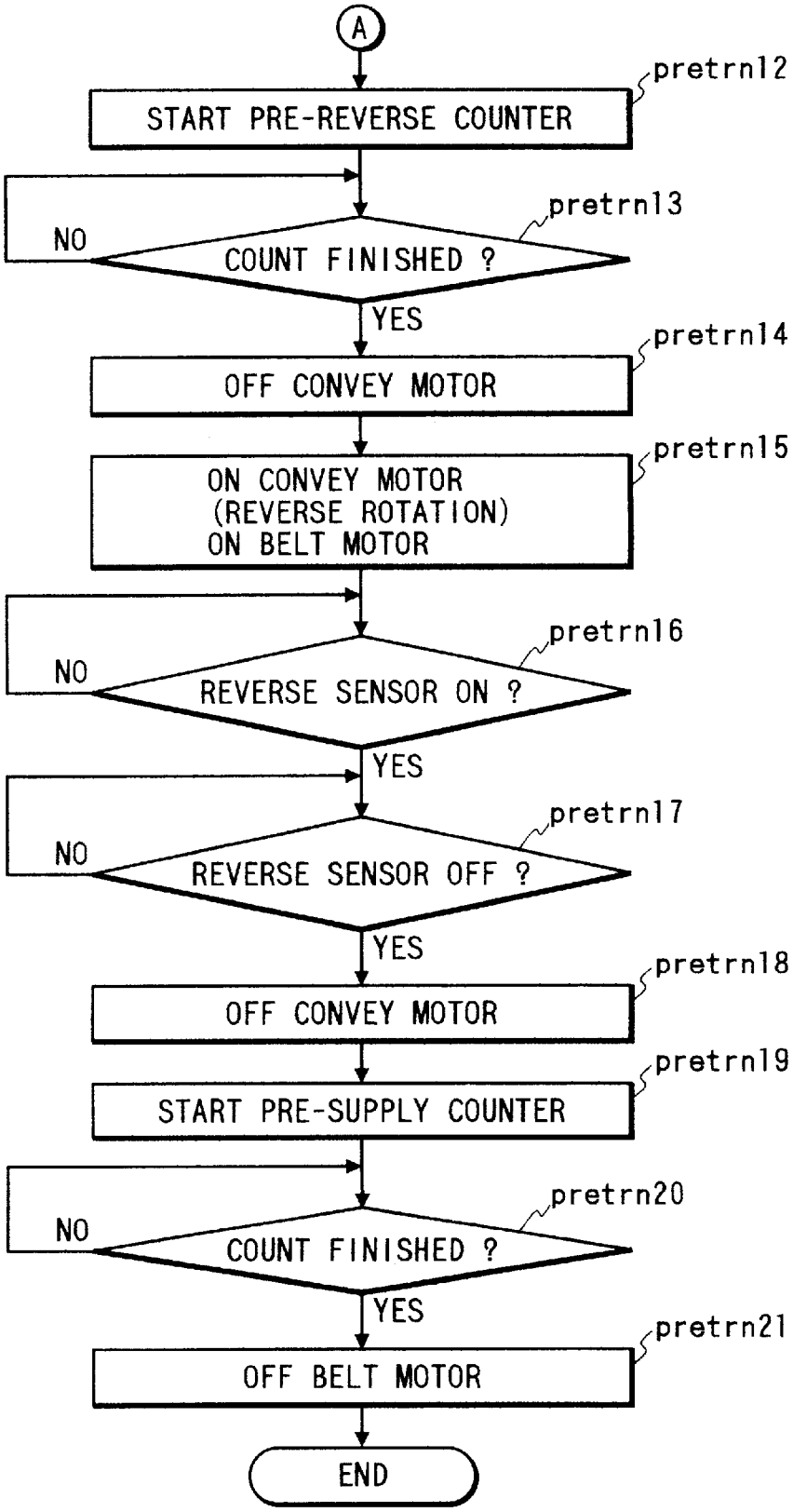
Figure 23:
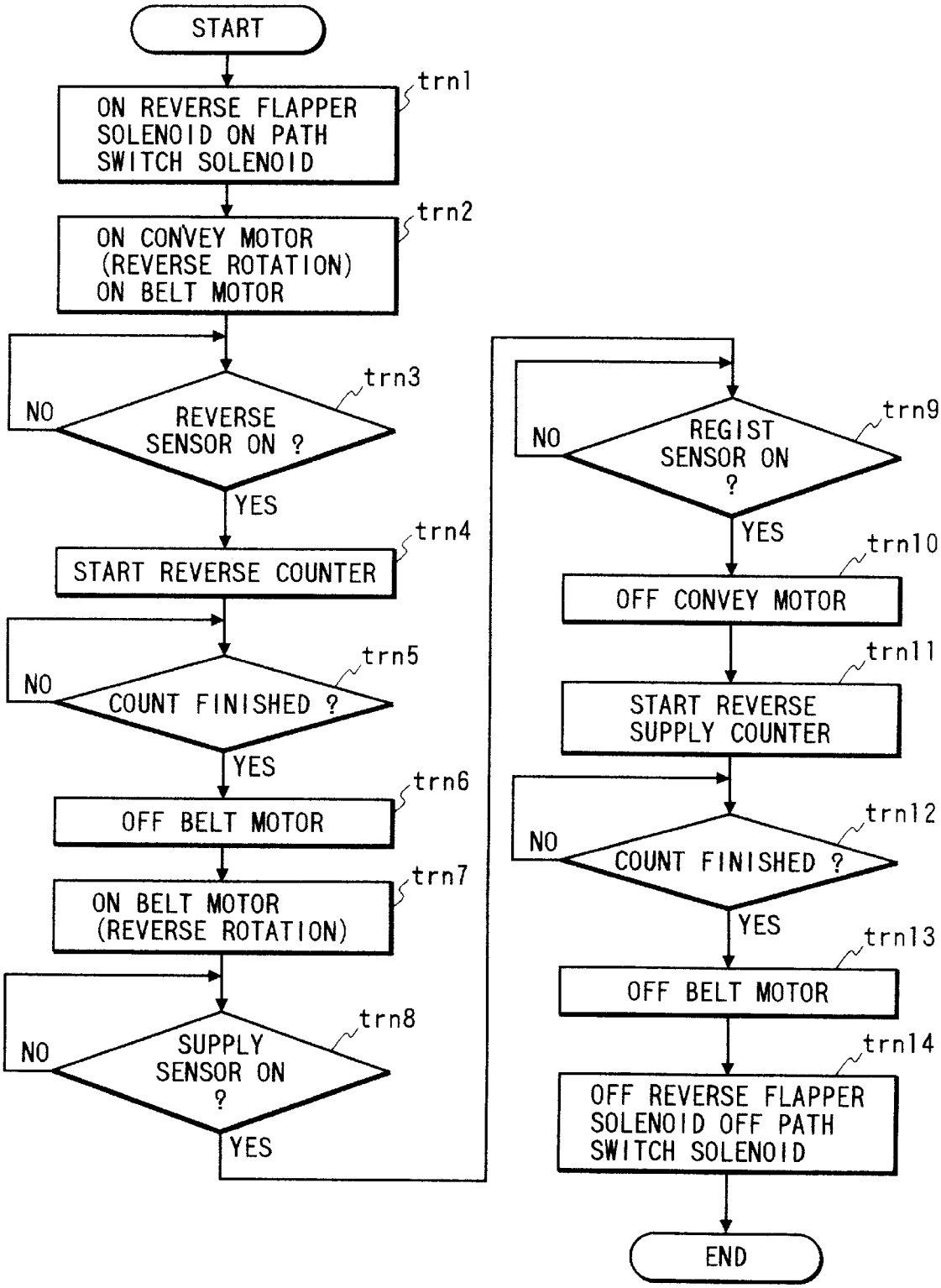
FIG. 23 is a flow chart for explaining reverse treatment in a both-face original convey mode.

FIGS. 21A to 21H each schematically shows a flow of the originals when the both-face originals of half size are conveyed, and FIGS. 22A and 22B are flow charts showing the conveyance of the both-original of half size.

When the operator inputs the copying condition to the operation portion of the main body 1 and depresses the start key (copy key), the separate motor 100 and the convey motor 101 are driven (pretrn 1). As a result, the first supply roller 16, second supply roller 9, first reverse roller 17 and second reverse roller 18 are rotated to effect the separate treatment and the skew-feed correction.

At the same time when the separate motor 100 is driven, the size check counter is driven to count the clock signals from the reverse clock (pretrn 2).

On the other hand, in this mode, in the condition that the path switch solenoid 107 is in the OFF condition, the reverse supply flapper 22 is maintained in the position shown by the solid line in FIG. 2, thereby closing the original convey path (c) and opening the reverse supply path (h). Further, in the condition that the reverse flapper solenoid 108 is in the OFF condition, the reverse flapper 23 is maintained in the position shown by the solid line in FIG. 2, thereby closing the reverse supply path (g) and opening the reverse supply path (i). Accordingly, when the second supply roller 9 is rotated, the original P1 (the tip end of which has abut against the second supply roller 9) is directed toward the reverse supply paths (h), (f) and (i), thereby effecting the pre-reverse treatment (refer to FIG. 21A). Incidentally, it is ascertained whether the original P1 was conveyed to the reverse supply path (h) or not by detecting the tip end of the original by means of the regist sensor 39 (pretrn 3).

On the other hand, when the trail end of the original is detected by the separate sensor 30, the separate OFF counter is driven to count the clock signals from the separate clock (pretrn 5). When the clock signals corresponding to the distance L3 between the first supply roller 16 and the separate sensor 30 are counted (pretrn 6), since the trail end of the original has left the first supply roller 16, the separate motor 100 is turned OFF, thereby stopping the first supply roller 16 (pretrn 7).

When the trail end of the original is detected by the supply sensor 35 (pretrn 8), the size check counter is stopped (pretrn 9), and the size check treatment is effected on the basis of the data from the size check counter (pretrn 10). When the trail end of the original is detected by the regist sensor 39 (pretrn 11), a pre-reverse counter is started to count clock signals from a reverse energizing clock (pretrn 12). At the time when the predetermined clock signals are counted by the pre-reverse counter (pretrn 13), the convey motor 101 is turned OFF (pretrn 14). As a result, the original P1 is stopped at a predetermined position where the trail end thereof leaves the reverse supply path (h).

When a predetermined time period is elapsed after the convey motor 101 is turned OFF, the convey motor 101 is rotated in a reverse direction to rotate the first reverse roller 17 and the second reverse roller 18 reversely, and, the belt motor 102 is driven to rotate the wide belt 7 in the normal direction (pretrn 15). As a result, the original P1 is directed to the original convey path (d) on the platen 3 through the reverse supply/discharge path (e) (refer to FIG. 21B).

Incidentally, in the case where the original P1 is conveyed from the original convey path (b) toward the reverse supply paths (h), (f) and (i), when the trail end of the original P1 passes through the one-way flapper 24, the supply/discharge flapper 25 has been shifted to the position shown by the solid line in FIG. 2. Accordingly, when the pre-reversed original P1 is conveyed to the original convey path (d) through the reverse supply/discharge path (e), the tip end of the original P1 is prevented from striking against the end of the platen 3. The conveying speeds of the first reverse roller 17 and of the wide belt 7 are controlled to be the same as each other, except for a special case.

On the other hand, it is ascertained that the fact that the original P1 has been conveyed to the reverse supply/discharge path (e) by detecting the tip end of the original by means of the reverse sensor 38 (pretrn 16), and, when the trail end of the original is detected by the reverse sensor 38 (pretrn 17), the driving of the convey motor 101 is stopped (pretrn 18).

Further, on the basis of a detection signal (detecting the trail end of the original) from the reverse sensor 38, a pre-supply counter is started to count the clock signals from the belt energizing clock (pretrn 19). When the predetermined clock signals are counted by the pre-supply counter (pretrn 20), the driving of the belt motor 102 stopped (pretrn 21). As a result, the wide belt 7 is stopped and the original P1 is stopped at the predetermined position on the platen 3 with the second surface thereof facing downwardly (refer to FIG. 21C).

In this condition, the image on the second surface of the original P1 is read by scanning the scanner 204.

After the image on the second surface of the original P1 is read, the reverse treatment is effected. Now, the reverse treatment will be described with reference to FIG. 23.

As mentioned above, the reverse flapper 23 is maintained in the position shown by the solid line in FIG. 2 to close the reverse supply path (g) and open the reverse supply path (i). When the reverse treatment is effected, the reverse flapper solenoid 108 is turned ON (trn 1) to shift the reverse flapper 23 to the position shown by the two dot and chain line in FIG. 2, thereby opening the reverse supply path (g) and closing the reverse supply path (i). The path switch solenoid 107 is turned ON (trn 1) to maintain the reverse supply flapper in the position shown by the two dot and chain line in FIG. 2, thereby opening the original convey path (c) and closing the reverse supply path (h), and the supply/discharge flapper 25 is held at the position shown by the two dot and chain line in FIG. 2.

Then, belt motor 102 and the convey motor 101 are turned ON (trn 2) to rotate the wide belt 7, second supply roller 9, first reverse roller 17 and second reverse roller 18 reversely. As a result, the original P1 is conveyed through the reverse supply/discharge path (e), reverse supply paths (f), (g) and the original convey path (c) (refer to FIG. 21D).

When the original P1 on the platen 3 is discharged into the reverse supply/discharge path (e), the tip end of the original is detected by the reverse sensor 38 (trn 3). Upon such detection, the reverse counter is started by the belt energizing clock (trn 4). When the counting of the reverse counter is finished, the belt motor 102 is turned OFF (trn 5 and trn 6), and, after a predetermined time period is elapsed, the belt motor is rotated in the normal direction (trn 7). Accordingly, the original P1 conveyed in the original convey path (c) is directed into the original convey path (d) by the wide belt 7. The conveying speed of the wide belt 7 is controlled becomes the same as the conveying speed of the second supply roller 9 until the tip end of the original P1 enters into the original convey path (d).

When it is ascertained that the original P1 has been conveyed in the reverse supply path (g) by detecting the tip end of the original by means of the supply sensor 35 (trn 8) and the trail end of the original is detected by the regist sensor 39 (trn 9), the convey motor 101 is turned OFF (trn 10). As a result, the rotation of the second supply roller 9 is stopped in such a condition that the trail end of the preceding original P1 leaves the nip of the second supply roller 9. Accordingly, the preceding original P1 entered into the original convey path (d) is conveyed only by the wide belt 7.

At the same time when the trail end of the original is detected by the supply sensor 35, the reverse supply counter is started to count the clock signals from the belt energizing clock (trn 11). When the predetermined number of clock signals are counted by the reverse supply counter (trn 12), the belt motor 102 is turned OFF (trn 13). As a result, the wide belt 7 is stopped, thereby stopping the original P1 at the predetermined position on the platen 3. In this position, the image on the first surface of the original P1 is read by scanning the scanner 204 of the main body 1.

Thereafter, the reverse flapper solenoid 108 is turned OFF to shift the reverse flapper to the position shown by the solid line in FIG. 2, and the path switch solenoid 107 is turned OFF to shift the reverse supply flapper 22 and the supply/discharge flapper 25 to the positions shown by the solid lines in FIG. 2 (trn 14).

In the reverse treatment, since the wide belt 7 is rotated reversely in the normal direction (trn 7), the original P1 is pulled by the first reverse roller 17 and the wide belt 7 in opposite directions. However, since the nip force of the first reverse roller 17 is stronger than the conveying force of the wide belt 7, the original P1 is conveyed by the reverse roller 17. However, in case of the large size original (longer in the conveying direction), the conveying force of the wide belt 7 becomes greater than the nip force of the first reverse roller 17, thereby sometimes affect a bad influence upon the smooth conveyance of the original. Accordingly, in this case, a timing for rotating the wide belt 7 reversely is delayed.

Around the time when the trail end of the original P1 is detected by the supply sensor 35, the sheet supply roller 5 and the separation portion S are driven to separate and supply the succeeding original P2 from the original tray 4, and the skew-feed of the supplied original P2 is corrected by the second supply roller 9. Then, the second supply roller 9, first reverse roller 17 and second reverse roller 18 are driven to effect the pre-reverse treatment for the succeeding original P2 (refer to FIG. 21E). While the image reading of the preceding original P1 is being performed, the pre-reverse treatment of the succeeding original P2 is completed, and the succeeding original P2 is stopped while the tip end thereof is being pinched by the nip of the first reverse roller 17.

When the image reading of the preceding original P1 is completed, the reverse rotations of the first reverse roller 17 and the second reverse roller 18 and the normal rotation of the wide belt 7 are started, so that the preceding original P1 and the succeeding original P2 are rested on the platen 3 in a spaced relation by a predetermined distance L12 (refer to FIG. 21F).

In this condition, the image on the second surface of the succeeding original P2 is read by scanning the scanner 204 of the main body 1.

When the image reading is finished, as is in the preceding original P1, the reverse treatment of the succeeding original P2 is started, so that the succeeding original P2 is discharged into the reverse supply/discharge path (e). Incidentally, in this reverse treatment, although the preceding original P1 is conveyed toward the reverse supply/discharge path (e), since the sheet interval L12 is selected to an optimum value, the preceding original P1 remains on the platen 3 without discharging into the reverse supply/discharge path (e).

Thereafter, the wide belt is driven reversely, with the result that the succeeding original P2 is directed to the original convey path (d) through the reverse supply/discharge path (e), reverse supply path (f), reverse supply path (g) and original convey path (c).

The side belt 7 is stopped in a condition shown in FIG. 21G, and, in this condition, the image on the first surface of the succeeding original P2 is read. In this case, a sheet interval between the originals P1 and P2 becomes L13. A further succeeding original P3 is supplied from the original tray 4 and is waiting while being pinched by the nip of the first reverse roller 17.

When the image reading of the first surface of the succeeding original P2 is finished, the reverse rotations of the first reverse roller 17 and second reverse roller 18, the normal rotation of the wide belt 7 and the rotation of the discharge roller are started, with the result that the further succeeding original P3, succeeding original P2 and preceding original P1 are simultaneously conveyed toward the discharge tray 10. At the time when the further succeeding original P3 is rested on the platen 3, the wide belt 7 is stopped, and the image reading of the further succeeding original P3 is effected (refer to FIG. 21H). At this point, since the trail end of the preceding original P1 leaves the nip between the manual-insertion regist rollers 11, the preceding original P1 is conveyed only by the discharge roller 12 to be discharged onto the discharge tray 10.

Incidentally, when a plurality of originals are read, although the above-mentioned operations are repeated, at the time when the last image reading (image reading of a first surface of a last original $P_n$) is finished, two original (last original $P_n$ and last but one original $P_{n-1}$ are rested on the platen 3. These originals $P_n$, $P_{n-1}$ are successively discharged onto the discharge tray 10 by the wide belt 7.

[3-2] Large Size Both-face Original Convey Mode

Next, the operation in the large size both-face original convey mode will be explained with reference to FIGS. 24A to 24H.

FIGS. 24A to 24H each schematically shows a flow of originals when the both-face originals of large size are conveyed.

Also in this mode, as is in the half size original, the reverse supply flapper 22 is maintained in the position shown by the solid line in FIG. 2 to close the original convey path (c) and open the reverse supply path (h), and the reverse flapper 23 is maintained in the position shown by the solid line in FIG. 2 to close the reverse supply path (g) and open the reverse supply path (i).

When the operator inputs the copying condition and depresses the start key (copy key), as is in the half size original, the separate motor 100 and the convey motor 101 are driven to effect the separate treatment and the skew-feed correction. The original is directed toward the reverse supply paths (h), (f) and (i) to effect the pre-reverse treatment (refer to FIG. 24A), and, when the convey motor 101 is stopped, the original is stopped at the position where the trail end thereof leaves the reverse supply path (h).

Then, when a predetermined time period is elapsed after the convey motor 101 is stopped, the convey motor 101 is driven reversely to rotate the first and second reverse rollers 17, 18 reversely, and the belt motor 102 is driven to rotate the wide belt 7 in the normal direction. As a result, the original P1 is directed to the original convey path (d) on the platen 3 through the reverse supply/discharge path (e) (refer to FIG. 24B). In this case, since the supply flapper 25 has been shifted to the position shown by the solid line in FIG. 2, the tip end of the original P1 is prevented from striking against the end of the platen 3. The conveying speeds of the first reverse roller 17 and of the wide belt 7 are controlled to be equal to each other, except for the special case.

Figure 24A:
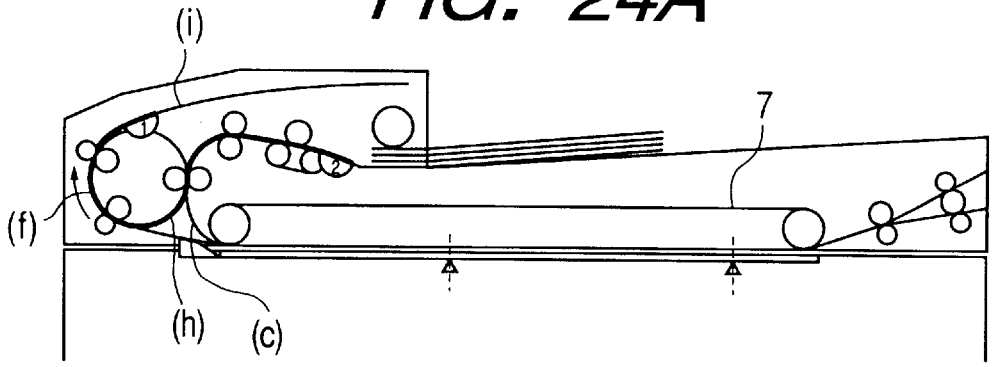
FIGS. 24A, 24B, 24C, 24D, 24E, 24F, 24G and 24H are schematic views each showing a flow of the original when the both-face original of large size is conveyed.
Figure 24B:
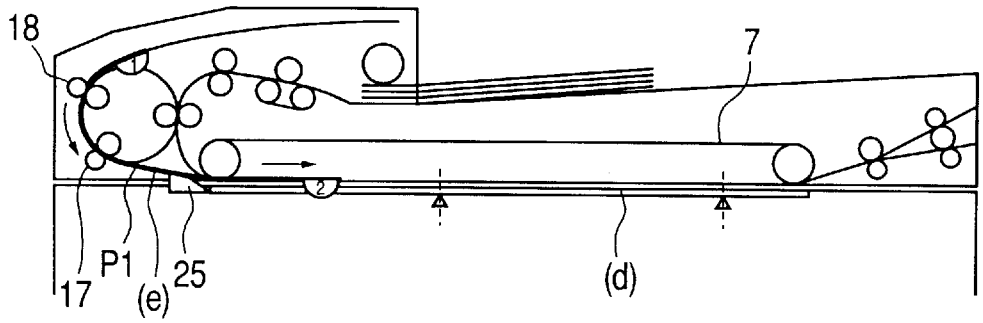
Figure 24C:
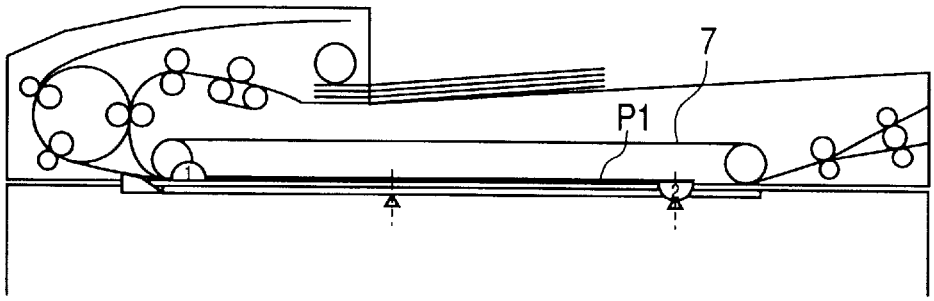
Figure 24D:
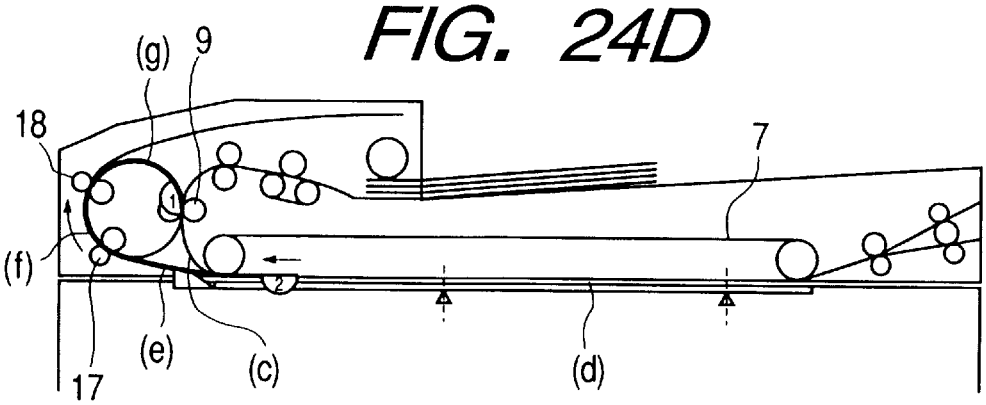
Figure 24E:
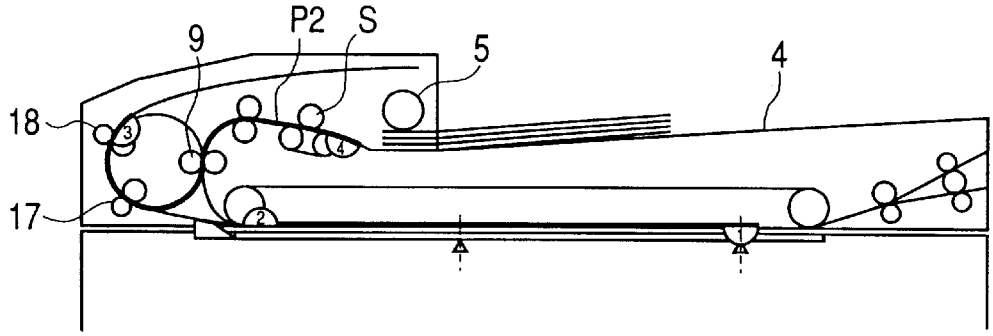
Figure 24F:
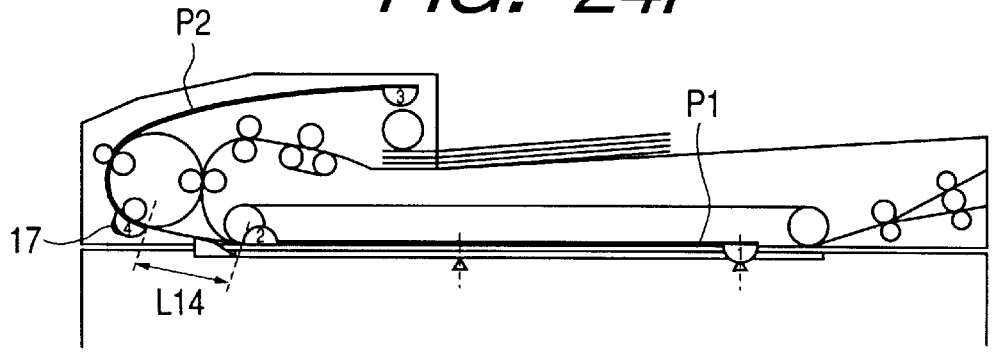

When the trail end of the original P1 is detected by the reverse sensor 38, after a predetermined time period is elapsed, the driving of the wide belt 7 is stopped, with the result that the original P1 is stopped at the image tip position for a fixed reading mode (refer to FIG. 24C). In this condition, the image reading of the second surface of the original P1 is effected by scanning the scanner 204 of the main body 1.

When the image reading of the second surface of the original P1 is finished, the reverse treatment of the original is performed.

That is to say, the reverse flapper 23 is switched to the position shown by the two dot and chain line in FIG. 2 to open the reverse supply path (g) and close the reverse supply path (i), and the reverse supply flapper is maintained in the position shown by the two dot and chain line in FIG. 2 to open the original convey path (c) and close the reverse supply path (h), and the supply/discharge flapper is maintained in the position shown by the two dot and chain line in FIG. 2.

On the other hand, when the above-mentioned image reading is finished, the belt motor 102 and the convey motor 101 are driven to rotate the wide belt 7, first reverse roller 17 and second reverse roller 18 reversely. As a result, the original P1 is conveyed through the reverse supply/discharge path (e), reverse supply paths (f), (g) and original convey path (c) (refer to FIG. 24D). Thereafter, the original P1 is directed to the original convey path (d) through the original convey path (c).

When the original P1 on the platen 3 is discharged into the reverse supply/discharge path (e), although the tip end of the original is detected by the reverse sensor 38, after a predetermined time period is elapsed (after the detection timing), the driving of the wide belt 7 is stopped, and, thereafter, the wide belt is rotated in the normal direction. Accordingly, the original P1 conveyed into the original convey path (c) is directed to the original convey path (d) by the wide belt 7. The conveying speed of the wide belt 7 is controlled becomes the same as the conveying speed of the second supply roller 9 until the tip end of the original P1 enters into the original convey path (d).

The rotation of the second supply roller 9 is stopped in such a condition that the trail end of the preceding original P1 leaves the nip of the second supply roller 9.

The preceding original P1 entered into the original convey path (d) is conveyed only by the wide belt 7. When the original P1 is conveyed by a predetermined distance after the trail end thereof is detected by the supply sensor 35, the driving of the wide belt 7 is stopped. As a result, the preceding original P1 is stopped at the predetermined position (image tip position for the fixed reading mode) on the platen 3 with the first surface facing downwardly. In this position, the image on the first surface of the original P1 is read by scanning the scanner 204 of the main body 1.

Around the time when the trail end of the original P1 is detected by the supply sensor 35, the sheet supply roller 5 and the separation portion S are driven to separate and supply the succeeding original P2 from the original tray 4, and the skew-feed of the supplied original P2 is corrected by the second supply roller 9. Then, the second supply roller 9, first reverse roller 17 and second reverse roller 18 are driven to effect the pre-reverse treatment for the succeeding original P2 (refer to FIG. 24E). While the image reading of the preceding original P1 is being performed, the pre-reverse treatment of the succeeding original P2 is completed, and the succeeding original P2 is stopped while the tip end thereof is being pinched by the nip of the first reverse roller 17 (refer to FIG. 24F). The sheet interval between the preceding original P1 and the waiting succeeding original P2 in this case is controlled to become L14.

Figure 24G:
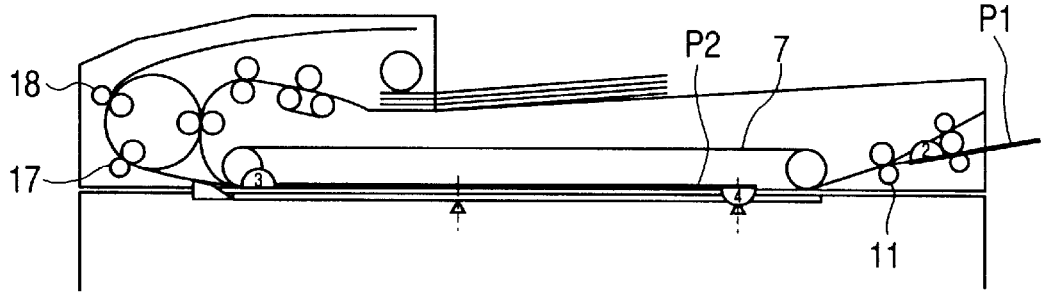
Figure 24H:
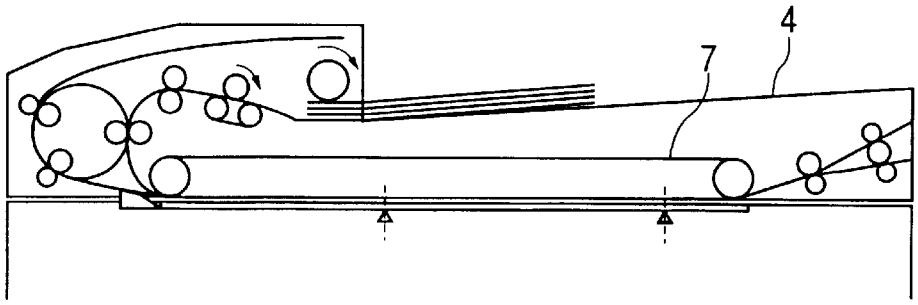

When the image reading of the preceding original P1 is completed, the reverse rotations of the first reverse roller 17 and second reverse roller 18 and the normal rotation of the wide belt 7 are started, so that the succeeding original P2 is conveyed onto the platen 3 and is stopped at that position (refer to FIG. 24G). In this case, the trail end of the preceding original P1 has left the nip between the manual-insertion regist rollers 11. In this condition, the image on the second surface of the succeeding original P2 is read by scanning the scanner 204*c* of the main body 1.

Thereafter, the similar operations are repeated up to the last original $P_n$.

[4] Manual-insertion Mode

Next, the manual-insertion mode will be explained with reference to FIGS. 25, 26A to 26D and 27.

Figure 25:
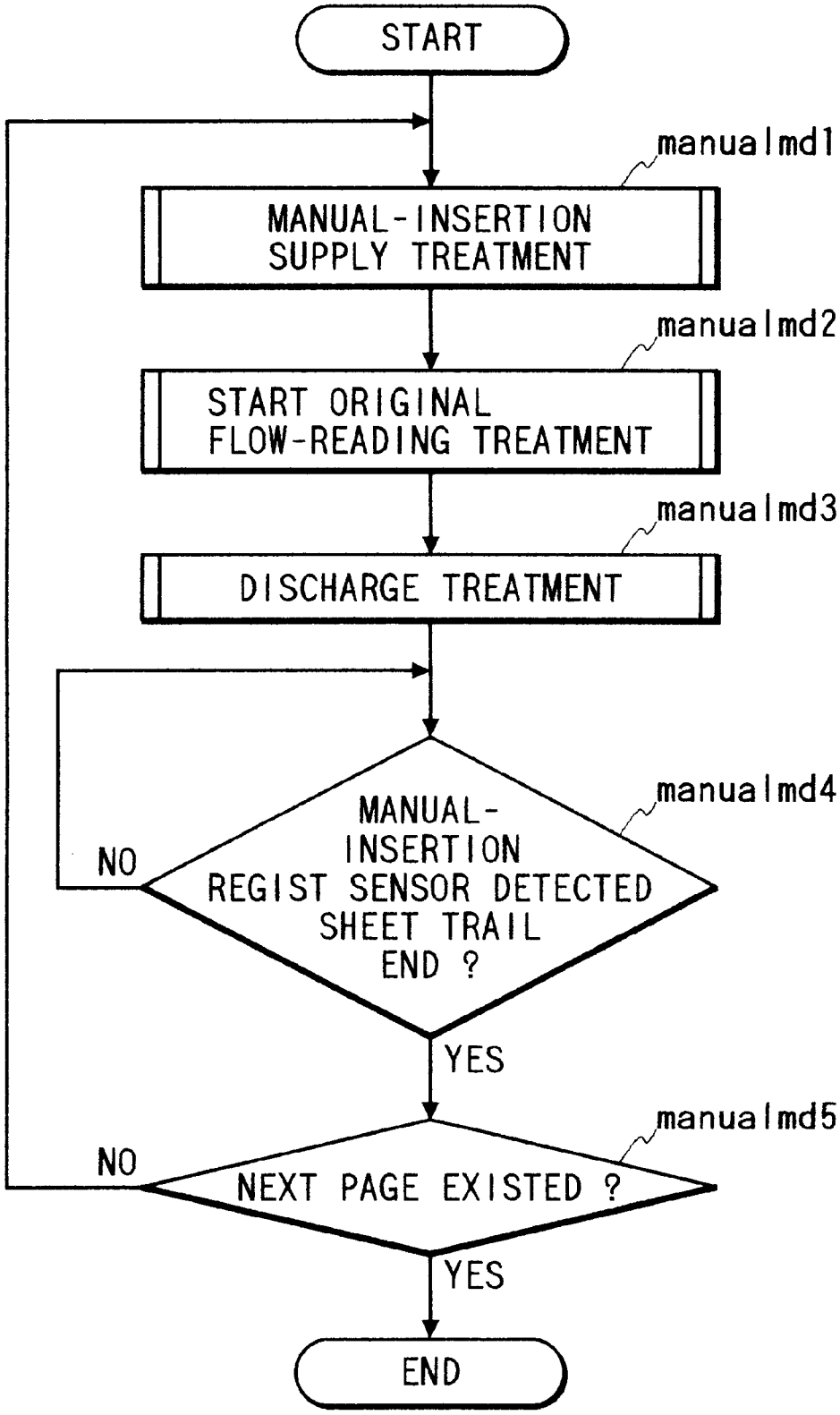
FIG. 25 is a flow chart briefly showing an operation in a manual-insertion mode.

First of all, the operation will be briefly described with reference to FIG. 25 and FIGS. 26A to 26D. FIG. 25 is a flow chart briefly showing the operation in the manual-insertion mode, and FIGS. 26A to 26D each schematically shows a flow of the originals in the manual-insertion mode.

Figure 26A:
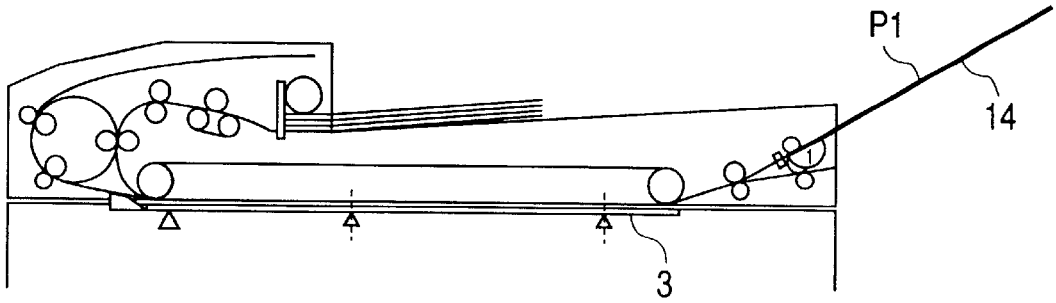
FIGS. 26A, 26B, 26C and 26D are schematic views each showing a flow of a manually inserted original when the original is conveyed.
Figure 26B:
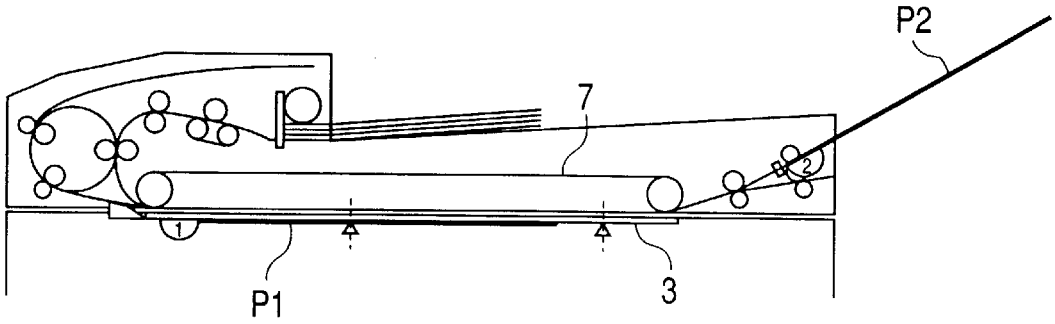
Figure 26C:
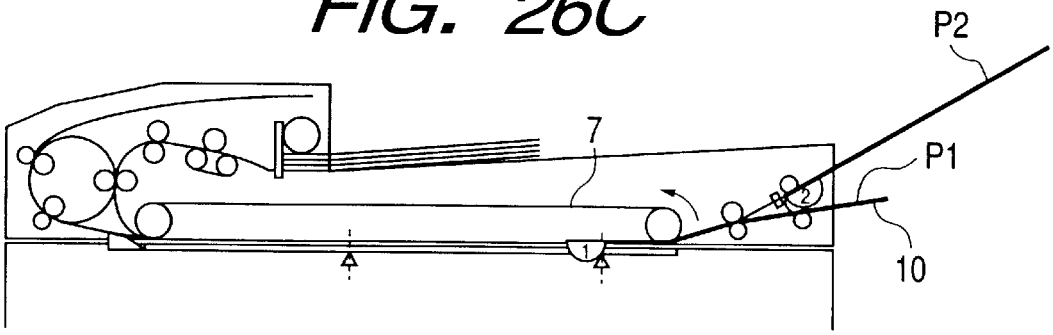
Figure 26D:
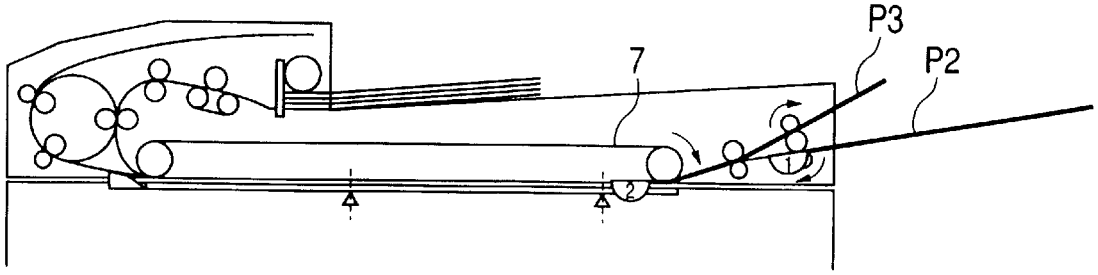

When the original is set on the manual-insertion original tray 14 (refer to FIG. 26A), manual-insertion supply treatment (fully described later) is effected (manualmd 1), with the result that the original is conveyed to a predetermined position on the platen 3 (refer to FIG. 26B).

Thereafter, the scanner 204 is scanned to effect original image reading treatment (manualmd 2). When the treatment is finished, discharge treatment (fully described later) is effected to discharge the original onto the discharge tray 10 (manualmd 3, FIG. 26C).

Thereafter, when the trail end of the original is detected by the manual-insertion regist sensor 34 (manualmd 4), presence/absence of a next original is checked by the manual-insertion original detect sensor 37 (manualmd 5). If there is the next original, the above operations are repeated (manualmd 1 to manualmd 5, FIG. 26D). If there is no next original, the treatment is ended.

Figure 27:
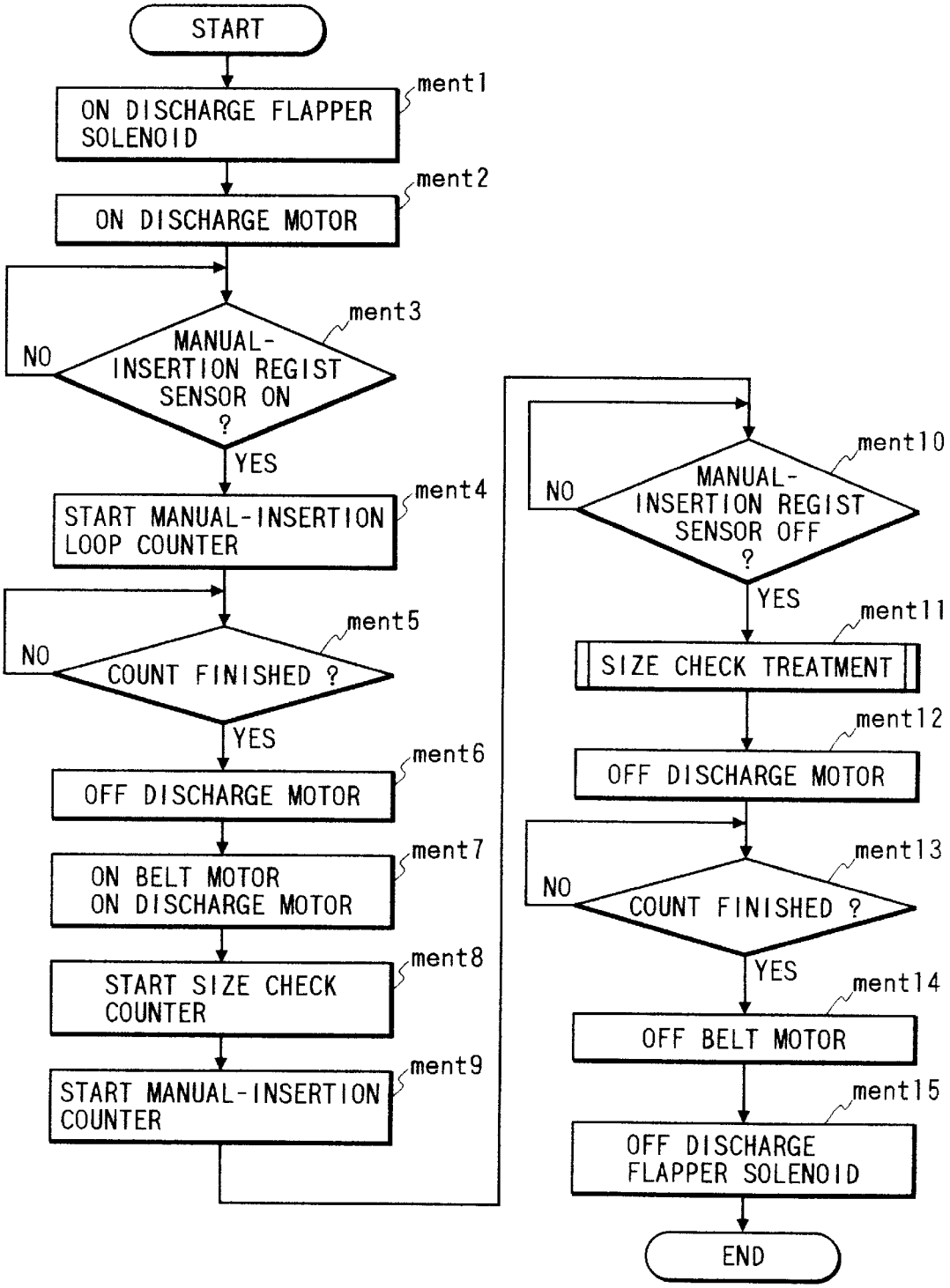
FIG. 27 is a flow chart showing the details of the operation in the manual-insertion mode.

Next, the manual-insertion mode will be fully explained with reference to FIG. 27. FIG. 27 is a flow chart showing the manual-insertion mode in detail.

Normally, the discharge flapper solenoid 109 is turned OFF, and the discharge flapper 26 and the manual-insertion shutter 28 are held at positions shown by the solid lines in FIG. 2. More specifically, the discharge flapper 26 is held in such a condition that a free end thereof is positioned below the platen 3, and the manual-insertion shutter 28 is held to protrude from the manual-insertion original tray 14. Accordingly, when the original is set on the manual-insertion original tray 14 by the operator, a tip end of the original abuts against the manual-insertion shutter 28.

When the fact that the original is set on the manual-insertion original tray 14 is detected by the manual-insertion original detect sensor 370, the discharge flapper solenoid 109 is turned ON (ment 1) to shift the discharge flapper 26 and the manual-insertion shutter 28 to positions shown by the two and dot chain lines in FIG. 2. The discharge motor 104 is driven to rotate the manual-insertion supply roller 13 (ment 2), thereby conveying the original P1 into the manual-insertion convey path (k). Meanwhile, the manual-insertion regist rollers 11 are stopped.

Thereafter, when the manual-insertion regist sensor 34 is turned ON to detect the tip end of the original (ment 3), a manual-insertion loop counter is started (ment 4) to count clock signals from a discharge clock. At the time when the predetermined number of clock signals are counted, the driving of the discharge motor 104 is stopped (ment 5 and ment 6). As a result, the tip end of the original P1 conveyed by the manual-insertion supply roller 13 abuts against the nip of the manual-insertion regist rollers 11 which are now stopped, thereby forming a loop having a predetermined amount in the original to correct the skew-feed of the original P1.

Thereafter, the discharge motor 104 and the belt motor 102 are driven (ment 7) to rotate the manual-insertion supply roller 13, manual-insertion regist rollers 11 and wide belt 7. As a result, the original P1 is conveyed from the manual-insertion convey path (k) to the original convey path (d).

At the same time when the discharge motor 104 is driven, the size check counter is started (ment 8) to count the clock signals from the belt clock. When the manual-insertion regist sensor 34 is turned OFF to detect the trail end of the original (ment 10), the count of the counter is stopped. And, on the basis of the data from the counter, the size check treatment is effected (ment 11).

When the fact that the trail end of the original has passed through the manual-insertion supply roller 13 is ascertained by OFF of the manual-insertion regist sensor 45, the discharge motor 104 is turned OFF to stop the driving of the manual-insertion supply roller 13 (ment 12).

On the other hand, at the same time when the size check counter is started, a belt regist counter is started (ment 9) to count the clock signals from the belt energizing clock. When the count of the belt regist counter is finished (ment 13), the driving of the belt motor 102 (and accordingly, wide belt 7) is stopped (ment 14), with the result that the original P1 is stopped at the predetermined position (where the tip end of the original aligned with the first image tip position R1) on the platen 3. In this condition, the original reading treatment is effected by scanning the scanner 204.

Incidentally, the discharge flapper solenoid 109 is turned OFF, with the result that the discharge flapper 26 and the manual-insertion shutter 28 are held at the positions shown by the solid lines in FIG. 2, thereby preparing for the setting of a next original.

When the original reading treatment is finished, the wide belt 7 is rotated reversely and the discharge roller 12 is rotatingly driven, thereby discharging the original P1 onto the discharge tray 10. Incidentally, when the discharge roller 12 is rotated in this way, although the manual-insertion supply roller 13 is also rotated, since the second original P2 is blocked by the manual-insertion shutter 28, the supply of the next original is prevented.

When the trail end of the original P1 is detected by the manual-insertion regist sensor 34, the driving of the manual-insertion regist rollers 11 is stopped, and the manual-insertion flapper 27 and the manual-insertion shutter 28 are shifted to the positions shown by the solid lines in FIG. 2. When the manual-insertion roller 13 is driven, the original P2 is conveyed toward the manual-insertion regist rollers 11, where the skew-feed is corrected. Thereafter, the original P2 is rested on the platen 3.

Next, effects or advantages by the illustrated embodiment will be explained.

According to the illustrated embodiment, in the pick-up DOWN treatment, the lift/lower arm 51 is lowered, the engagement between the arm shaft 51*c* and the rock arm 53 is released, with the result that the sheet supply roller 5 is contacted with the original stack P by the weights of the sheet supply roller 5 itself and the rock arm 53. In this condition, when the sheet supply roller 5 is rotated, the sheet supply roller 5 can supply the original always stably, regardless of the height of the original stack.

Further, unlike to the conventional apparatuses, since a lifter mechanism and a height detection means are not required, the apparatus can be made cheaper. In addition, since a sensor lever flag is not used as the height detection means, even if the original to be conveyed is curled, poor original supply and skew-free can be prevented.

Furthermore, after the supplying operation of the sheet supply roller 5 is finished, although the sheet supply roller 5 is lifted, when the originals are supplied continuously, the sheet supply roller 5 is not lifted up to the home position shown in FIG. 3A but is lifted merely to the intermediate stop position (retard position shown in FIG. 11A) spaced apart from the uppermost original by the distance of 3 to 5 mm. With this arrangement, the shifting amount of the sheet supply roller 5 can be reduced. As a result, in the pick-up DOWN treatment for the next original, the vibration generated when the sheet supply roller 5 is contacted with the original stack can be reduced, and rest time of the sheet supply roller 5 can be reduced, thereby improving the original supplying speed. Since the shifting amount of the sheet supply roller 5 is reduced, operating noise and power consumption can be reduced.

When the retard amount of the sheet supply roller 5 in the pick-up UP treatment is regulated on the basis of the signal from the rock position sensor, such a retard amount can be reduced. As a result, the bounding of the sheet supply roller 5 during the pick-up DOWN treatment can be reduced, thereby permitting the stable original supply.

In the illustrated embodiment, while an example that the size of the original is checked by the original trail end detect sensor 41 only on the basis of the length of the original in the conveying direction was explained, the original size may be checked by using not only the original trail end detect sensor 41 but also the sheet width detect sensor 44.

In the illustrated embodiment, while an example that the stop position of the lift/lower arm 51 when the sheet supply roller 5 is contacted with the original stack is controlled by the rock arm flag 54 and the rock position sensor 46 of the lift/lower arm was explained, the present invention is not limited to such an example. For example, the stop position of the lift/lower arm 51 may be controlled in such a manner that an elongated slot is formed in the rock arm 53 and the sheet supply roller 5 is supported by the rock arm so that a roller shaft of the sheet supply roller 5 can be shifted along the elongated slot and there is provided a sensor for detecting a position of the sheet supply roller 5 relative to the rock arm 53 so that the sensor can detect the fact that the sheet supply roller 5 is contacted with the original stack.

Next, the independent suspension mechanism for the sheet supply roller 5 will be fully explained.

Figure 28:
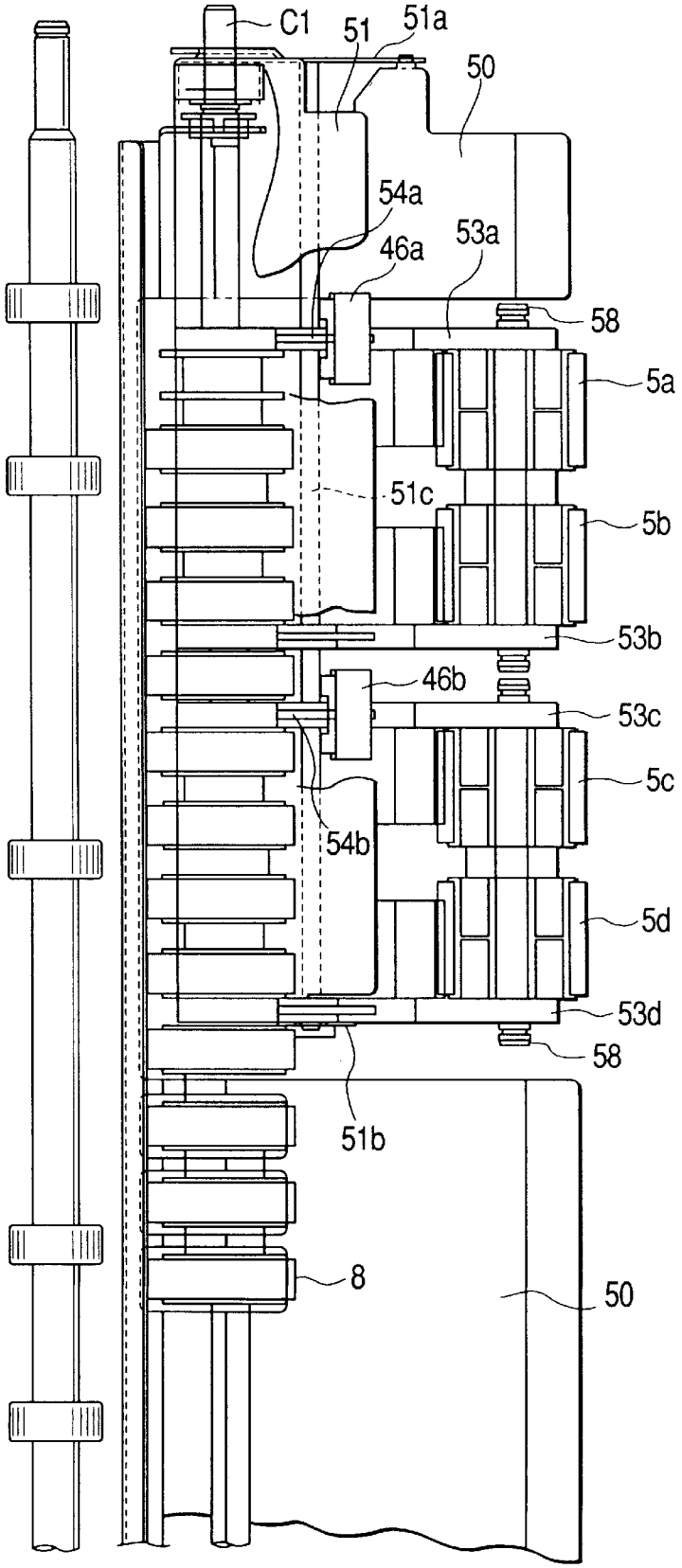
FIG. 28 is a plan view for fully explaining an independent suspension mechanism for the roller shown in FIG. 4.

As shown in FIG. 28, the sheet supply roller 5 includes a plurality of roller portions 5*a* to 5*d* disposed size by side in the width-wise direction of the original. Since the roller portions are independently suspended to easily equalize to the original stack P, the supplying ability can be improved.

In the illustrated embodiment, four roller portions 5*a* to 5*d* are arranged side by side in the width-wise direction of the original, and two roller portions 5*a*, 5*b* are supported by a pair of rock arms 53*a*, 53*d* through a roller shaft 58 in a suspended fashion, and two roller portions 5*c*, 5*d* are supported by a pair of rock arms 53*c*, 53*d* through a roller shaft 58 in a suspended fashion.

In this arrangement, the rock arms 53*a*, 53*b*, 53*c* and 53*d* have slight clearance in an axial direction to provide small play on the supply roller shafts 58 in a thrust direction. Thus, for example, between the pair of rock arms 53*a* and 53*b*, slight relative angular deviation (play) between the rock arms 53*a* and 53*b* is permitted, with the result that it is ensured that the two supply roller portions 5*a*, 5*b* are contacted with the original stack P with uniform contact pressure. This is also true regarding the supply rollers 5*c*, 5*d* supported by the pair of rock arms 53*c*, 53*d* in the suspended fashion.

Further, since the pair of rock arms 53*a*, 53*b* and the pair of rock arms 53*c*, 53*d* are supported on a central shaft 15, the four supply roller portions 5*a*, 5*b*, 5*c* and 5*d* can be contacted with the upper surface of the original stack P independently. With this arrangement, as shown in FIG. 29B, the supply roller portions 5*a* to 5*d* can easily be equalized to the upper surface of the original stack P.

Since the detection means for detecting positions of the rock arms 53*a*, 53*c* is constituted by rock arm flags 54*a*, 54*b* provided on the rock arms 53*a*, 53*c* and rock position sensors 46*a*, 46*b* attached to the lift/lower arm 51 in a confronting relation to the rock arm flags 54*a*, 54*b*, the positional detection can be performed at two points regarding the original stack P rested on the original tray 4.

Figure 29A:
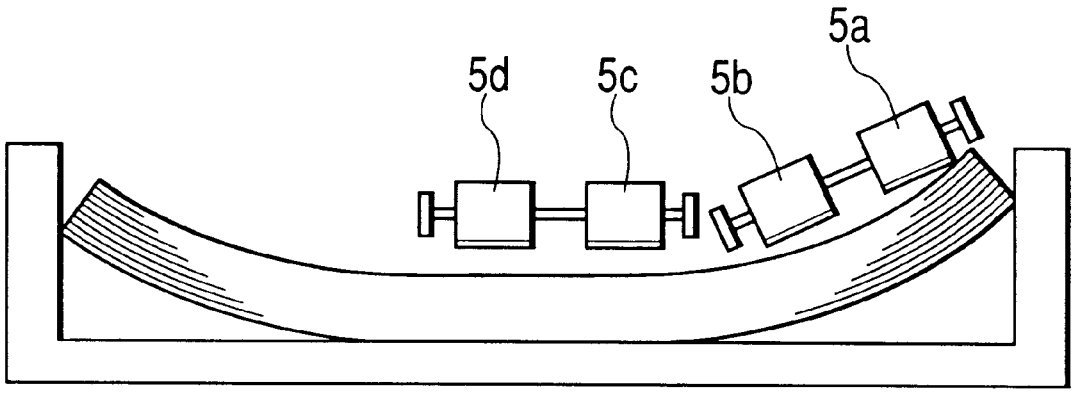
FIG. 29A is a view showing a condition that the sheet supply roller is contacted with the sheet stack at a high level position.
Figure 29B:
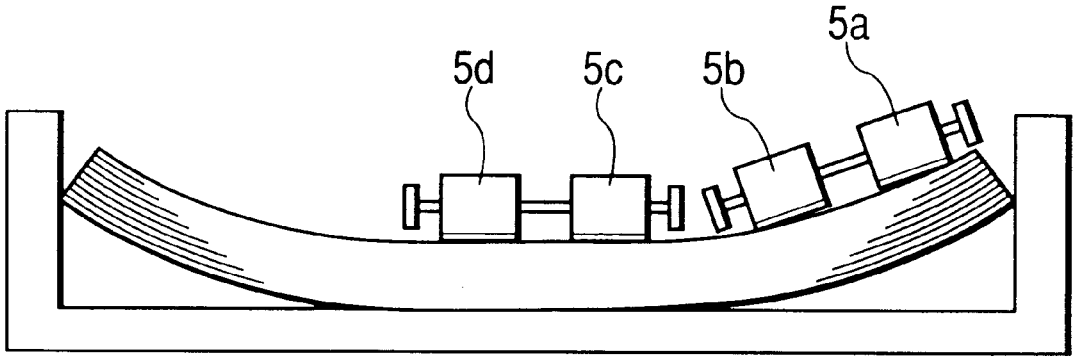
FIG. 29B is a view showing a condition that the sheet supply roller is contacted with the sheet stack at a low level position.

For example, as shown in FIGS. 29A and 29B, if edge portions of the original stack P are curled, a height level of the original stack P corresponding to the supply roller portion 5*a* near the curled edge portion becomes greater than a height level of the original stack P corresponding to the supply roller portion 5*c* near the center of the original stack. In such a case, in the conventional apparatus, as shown in FIG. 29A, only the supply roller portion 5*a* is contacted with the original stack P and other supply roller portions 5*b* to 5*d* cannot be contacted with the original stack P, with the result that, since the supply roller portions 5*a* to 5*d* are not contacted with the original stack P uniformly, poor original supply and/or skew-feed occurred.

To the contrary, according to the illustrated embodiment, as shown in FIG. 29B, the lift/lower arm 51 is lowered so that the four rock arms 53*a* to 53*d* are spaced apart from the arm shaft 51*c* to lower the supply roller 5*a* to 5*d* to the respective height levels of the original stack P thereby to contact all of the supply roller portions 5*a* to 5*d* with the upper surface of the original stack P with uniform contact pressure. That is to say, since all of the rock arms 53*a* to 53*d* are spaced apart from the arm shaft 51*c*, all of the supply roller portions 5*a* to 5*d* are contacted with the original stack P by their own weights, thereby providing stable contact pressure.

For example, in the above case, the information regarding such proper contact can be obtained by detecting the fact that the sensor path of the rock position sensor 46*b* is blocked by the rock arm flag 54*b* of the rock arms 53*c*, 53*d* supporting the supply roller portions 5*c*, 5*d* near the center of the original stack.

In this case, of course, the rock position sensor 46*a* has already been blocked. In the actual control, the lift/lower arm 51 is stopped by the detection information from the rock position sensor 46*b* which is operated later.

In the retarding operation, in a condition that the blocking of the rock position sensor 46*a* (regarding the higher level of the original stack P) is released, the final retard position is determined so that the supply roller portion 5*a* (corresponding to the highest level of the original stack P) can surely be separated from the original stack P, and, after the uppermost original is supplied, when the supply roller portions 5*a* to 5*d* are contacted with the original stack again, load resistance is completely eliminated, thereby improving the reliability of the original supply.

At the downstream side of the stopper 21, there is provided the separation portion comprised of the separation convey roller 8 (constituting the separation supply means) and the separation belt 8 opposed to the separation convey roller 8, so that the originals P supplied by the supply roller portions 5*a* to 5*d* rotated in a direction shown by the arrow a in FIG. 3A are separated by the separation convey roller rotated in a direction shown by the arrow b in FIG. 3A and the separation belt 8 rotated in a direction shown by the arrow c in FIG. 3A.

In the illustrated embodiment, while an example that the positional control in the supply roller contacting and retarding operations is performed on the basis of detection information data from the two sensors was explained, the present invention is not limited to such an example. As another arrangement, for example, the positional control of the supply roller portions 5*a* to 5*d* may be performed on the basis of detection information data from the two sensors in the supply roller contacting operation, and the supply roller portions 5*a* to 5*d* may be returned to the home position in the supply roller retarding operation.

Conversely, the lift/lower arm 51 may be rocked at the maximum until it is contacted with the position of the original tray 4 so that the supply roller portions 5*a* to 5*d* can be lowered at the maximum in the supply roller contacting operation, and the positional control of the supply roller portions 5*a* to 5*d* may be performed on the basis of detection information data from the two sensors only in the supply roller retarding operation.

In the illustrated embodiment, while an example that two contact position detecting means are provided for four supply roller portions 5*a* to 5*d* was explained, when four contact position detecting means are provided, higher accurate positional control of the supply roller portions 5*a* to 5*d* can be performed in accordance with various conditions of the original stack P.

In the present invention, since the above-mentioned arrangement is used, even when the sheets are curled, the sheet supply means (capable of engaging with and disengaging from the sheet stack independently) can stably be contacted with the sheet stack, thereby preventing offset contact of the sheet supply means. As a result, skew-feed and/or poor sheet supply (such as sheet slip) can be prevented, thereby improving the reliability of the sheet supplying operation.

Further, when the curled sheets are separated and supplied, by setting the retard amounts of the supply rotary members (supply roller portions) on the basis of the positional information of the supply rotary member associated with the highest level of the sheet stack, double-feed of the sheets can be prevented.

Further, by increasing the number of the supply rotary members so that the original stack is contacted with the supply means through a wide area and contact pressure per unit area is reduced as less as possible, since the surface pressure of the sheet is reduced, the curl pressing effect of the supply rotary members can be improved, and a service life of each supply rotary member can be increased, and contamination of the surface of the sheet can be reduced.

What is claimed is:

1. A stack sheet supplying apparatus comprising:

sheet stacking means;

supply means being liftable and lowerable, said supply means being lowered to reach a supply position in which said supply means comes into contact with an upper surface of a sheet resting on said sheet stacking means;

lift/lower means for lifting and lowering said supply means;

drive means for driving said lift/lower means;

detection means for detecting a fact that said supply means reaches the supply position; and control means for turning OFF said drive means based on a detected result of said detection means.

2. A stack sheet supplying apparatus according to claim 1, wherein, after said supply means supplies the sheet, said drive means is turned ON to lift said supply means to a lift position, and when the fact that said supply means is separated from said supply position is detected, said drive means is turned OFF, and wherein said lift position is a retracted position situated between a home position and said supply position.

3. A stack sheet supplying apparatus according to claim 1, wherein said detection means detects a relative positional deviation between said supply means and said lift/lower means to thereby detect the fact that said supply means reaches said supply position.

4. A stack sheet supplying apparatus according to claim 3, wherein output of said detection means generated when said supply means and said lift/lower means are integrally lowered differs from output of said detection means generated when said supply means is stopped and said lift/lower means lowered.

5. A stack sheet supplying apparatus according to claim 4, wherein the relative positional deviation between said supply means and said lift/lower means after lowering is constant regardless of a height of the sheet stack, and upon the lifting, when the relative positional deviation is restored said lift/lower means is stopped.

6. A stack sheet supplying apparatus according to claim 1, wherein said supply means includes rock means being freely rockable and for supporting a supply rotary member, said rock means being lifted and lowered by said lift/lower means, said detection means detects relative positional deviation between said rock means and said lift/lower means, and said control means turns OFF said drive means when the relative positional deviation between said rock means and said lift/lower means is detected.

7. A stack sheet supplying apparatus according to claim 6, wherein said lift/lower means includes an engagement means for engaging with said rock means upon lifting thereof and for disengaging from said rock means upon lowering thereof.

8. A stack sheet supplying apparatus according to claim 7, wherein said drive means is turned ON to lower said rock means, and said detection means outputs a signal for turning OFF said drive means when the lowering of said rock means is suppressed upon lowering so that the relative position is slightly deviated.

9. A stack sheet supplying apparatus according to claim 8, wherein said rock means is a rock lever which supports a roller as said supply rotary member at its tip end and in which a hole is formed, and said lift/lower means is a lift/lower arm having said engagement means for engaging with said hole and a sensor ON/OFF-controlled by passage of a part of said rock lever.

10. A stack sheet supplying apparatus according to claim 8, further comprising a sheet separation supply means disposed at a downstream side of said roller.

11. A stack sheet supplying apparatus according to claim 10, wherein, when a tip end of the sheet passes through said separation supply means, said lift/lower means is lifted.

12. A stack sheet supplying apparatus according to claim 8, wherein the relative positional deviation is substantially constant regardless of the height of the sheet stack, and upon lifting, the fact that the relative positional deviation is restored is detected by said detection means to thereby stop the lifting of said lift/lower means.

13. A stack sheet supplying apparatus according to claim 8, wherein said drive means is a reversible pulse motor.

14. A stack sheet supplying apparatus according to claim 13, wherein, said lift/lower means is lifted by an amount corresponding to the deviation by rotating said pulse motor reversely, said fact is detected by said detection means and said engagement means is engaged by said rock means to integrally lift said rock means, said control means is controlled to turn OFF said pulse motor immediately after the detection to thereby stop the lifting of said rock means, whereby said supply means is stopped at a position slightly spaced apart from said supply position, thereafter, when said pulse motor is rotated in a normal direction in response to supply command, said supply means is lowered to said supply position, and the above operations are repeated.

15. A stack sheet supplying apparatus comprising:

sheet stacking means;

supply means for supplying a sheet by contacting with an upper surface of the sheet rested on said sheet stacking means;

lift/lower means for lifting and lowering said supply means;

drive means for driving said lift/lower means;

control means for controlling said drive means to move said supply means into a supply position in which said supply means is contacted with the upper surface of the sheet, a home position in which said supply means is spaced apart from the upper surface of the sheet and a retracted position situated between the supply position and the home position whereby said control means shifts and lowers said supply means between the supply position and the retracted position to supply the sheet.

16. A stack sheet supplying apparatus according to claim 15, wherein said supply means includes rock means being freely rockable and for supporting a supply rotary member, said rock means being lifted and lowered by said lift/lower means, and said lift/lower means includes detection means for detecting relative positional deviation between said rock means and said lift/lower means, and wherein said control means turns OFF said drive means when the relative positional deviation between said rock means and said lift/lower means is detected.

17. A stack sheet supplying apparatus according to claim 16, wherein said lift/lower means includes an engagement means for engaging with said rock means upon lifting and for disengaging from said rock means upon lowering.

18. A stack sheet supplying apparatus according to claim 17, wherein said detection means outputs a signal for suppressing the lowering of said rock means upon lowering and for turning OFF said drive means when the relative position is slightly deviated.

19. A stack sheet supplying apparatus according to claim 18, wherein said rock means is a rock lever which supports a roller as said supply rotary member at its tip end and in which a hole is formed, and said lift/lower means is a lift/lower arm having said engagement means for engaging with said hole and a sensor ON/OFF-controlled by passage of a part of said rock lever.

20. A stack sheet supplying apparatus according to claim 18, further comprising a sheet separation supply means disposed at a downstream side of said roller.

21. A stack sheet supplying apparatus according to claim 20, wherein, when a tip end of the sheet passes through said separation supply means, said lift/lower means is lifted.

22. A stack sheet supplying apparatus according to claim 15, wherein, when the sheet is a last sheet of sheets stacked on said sheet stacking means, said supply means is lifted to the home position.

23. A stack sheet supplying apparatus comprising:

sheet stacking means;

supply means for supplying a sheet by contacting with an upper surface of the sheet rested on said sheet stacking means;

lift/lower means for lifting and lowering said supply means to move said supply means into a home position, a supply position and a retracted position situated between said home position and said supply position;

detection means for detecting a fact that said supply means reaches said supply portion;

drive means for driving said lift/lower means; and separation supply means disposed at a downstream side of said supply means and adapted to separate sheets;

wherein when the detection of said detection means is effected, said drive means is turned OFF to stop said lift/lower means, and, after supply, when a leading end of the sheet passes through said separation supply means, said drive means is turned ON to lift said lift/lower means to thereby lift said supply means to said retracted position spaced apart from the upper surface of the sheet, and, thereafter, said drive means is turned ON again in response to supply command to lower said lift/lower means to thereby lower said supply means to said supply position on the upper surface of the sheet.

24. A stack sheet supplying apparatus according to claim 2, 15 or 23, further comprising a detect means for detecting the fact that said lift/lower means is in the home position.

25. A stack sheet supplying apparatus according to claim 23, further comprising a convey means disposed at a downstream side of said separation supply means, lift command is generated after the sheet starts to be conveyed by said convey means, after the lifting said separation supply means is stopped, thereafter, when a trail end of the sheet leaves said supply means said supply means is lowered, and when the trail end of the sheet leaves said convey means said supply means starts to supply a next sheet.

26. A stack sheet supplying apparatus according to any one of claims 1 to 15, 16 to 21, 23 and 25, wherein said supply means is arranged in each of plural positions along an axial direction of said supply means said supply means arranged in said plural positions being liftable and lowerable independently of each other, and said detection means is arranged in each of plural positions corresponding to said plural positions of said supply means.

27. A sheet reading apparatus comprising:

a stack sheet supplying apparatus according to any one of claims 1 to 15, 16 to 21, 23 and 25; and a reading means disposed at a downstream side of said stack sheet supplying apparatus and adapted to read the sheet.

28. A stack sheet supplying apparatus according to any one of claims 1 to 4, 15, 16, 23, or 25, wherein said supply means includes a supply rotary member and rock means for supporting said supply rotary member and being freely rockable about a rotational axis, said supply means arranged in each of plural positions along the rotational axis shared with each other, said supply means arranged in said plural positions being liftable and lowerable independently of each other, and said detection means is arranged in each of plural positions corresponding to said plural positions of said supply means.

29. A stack sheet supplying apparatus comprising:

sheet stacking means for stacking sheets;

supply means for supplying a sheet from said sheet stacking means, said supply means having weight and being liftable and lowerable so that said supply means reaches a supply position in which said supply means is in contact with an upper surface of the sheet resting on said sheet stacking means by the self-weight of said supply means to supply the sheet;

lift/lower means for lifting and lowering said supply means by engaging with a part of said supply means, said lift/lower means being disengaged from the part of said supply means when said supply means reaches the supply position;

drive means for driving said lift/lower means;

detection means for detecting said supply means at the supply position; and control means for controlling ON/OFF of said drive means based on a detected result of detection means.

30. A stack sheet supply apparatus according to claim 29, wherein when said detection means detects said supply means at the supply position during a lowering of said lift/lower means, said drive means is turned OFF.

31. A stack sheet supplying apparatus according to claim 29, wherein, after said supply means supplies the sheet, said drive means is turned ON to lift said supply means to a lift position, and when a separation of said supply means from said supply position is detected, said drive means is turned OFF, and wherein said lift position is a retracted position situated between a home position and said supply position.

32. A stack sheet supplying apparatus according to claim 29, wherein a hole is formed in the part of said supply means, and said lift/lower means has engagement means for engaging with said hole.

33. A stack sheet supplying apparatus according to claim 31, wherein said supply means is arranged in each of plural positions along an axial direction of said supply means, said supply means arranged in said plural positions being liftable and lowerable independently of each other, and said detection means is arranged in each of plural positions corresponding to said plural positions of said supply means.

* * * * *

UNITED STATES PATENT AND TRADEMARK OFFICE

CERTIFICATE OF CORRECTION

PATENT NO. : 6,131,898

DATED : October 17, 2000

INVENTOR(S) : MASAKAZU HIROI, ET AL

It is certified that error appears in the above-identified patent and that said Letters Patent is hereby corrected as shown below:

On the title page, [57] ABSTRACT

Line 4, "lower" should read --lowering--.

Figure 14:
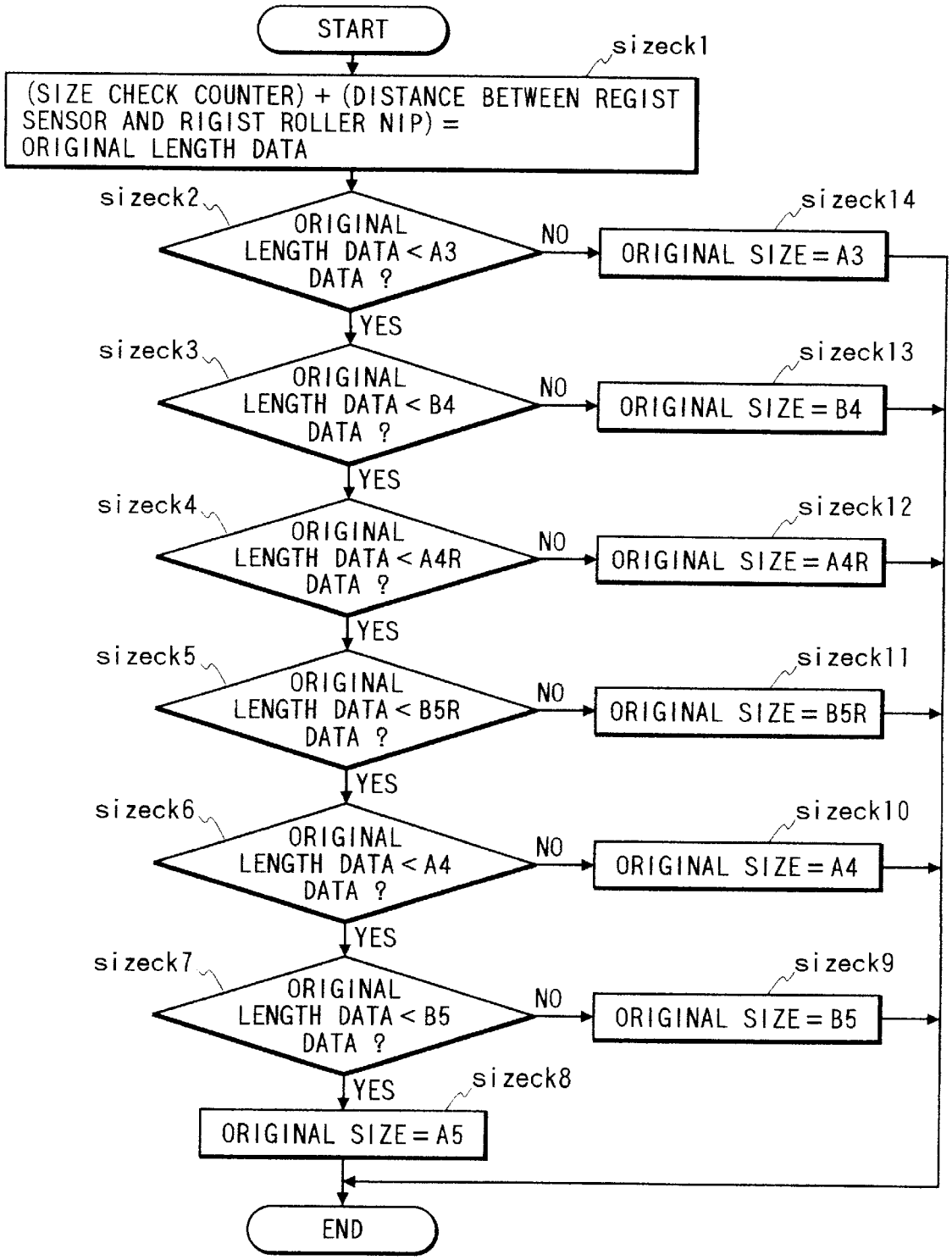
FIG. 14 is a flow chart for explaining size check treatment.

SHEET NO. 17
Figure 14, "RIGIST" should read --REGIST--.
COLUMN 5
Line 36, "moved" should read --moves--; and
Line 45, "the" should be deleted.
COLUMN 12:
LINE 50,"212" should read --212c--.

UNITED STATES PATENT AND TRADEMARK OFFICE

CERTIFICATE OF CORRECTION

PATENT NO. : 6,131,898

DATED : October 17, 2000

INVENTOR(S) : MASAKZAU HIROI, ET AL.

It is certified that error appears in the above-identified patent and that said Letters Patent is hereby corrected as shown below:

Column 29
Line 4, "to" should be deleted.

Signed and Sealed this

First Day of May, 2001

*Attest:*

Nicholas P. Godici

NICHOLAS P. GODICI

*Attesting Officer*

*Acting Director of the United States Patent and Trademark Office*